US008001897B2

(12) United States Patent
Gretsch

(10) Patent No.: US 8,001,897 B2
(45) Date of Patent: Aug. 23, 2011

(54) SYSTEMS FOR CHECKING THE LOADING OF A PRINT FORME MAGAZINE AND SYSTEMS FOR TRANSPORTING AT LEAST ONE PRINT FORME STORED IN A PRINT FORME MAGAZINE TO A CYLINDER

(75) Inventor: Harald Karl Gretsch, Eibelstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 449 days.

(21) Appl. No.: 12/223,384

(22) PCT Filed: Jan. 23, 2007

(86) PCT No.: PCT/EP2007/050624

§ 371 (c)(1),
(2), (4) Date: Jul. 30, 2008

(87) PCT Pub. No.: WO2007/090732

PCT Pub. Date: Aug. 16, 2007

(65) Prior Publication Data

US 2009/0000503 A1 Jan. 1, 2009

(30) Foreign Application Priority Data

Feb. 10, 2006 (DE) ..... 10 2006 006 136

(51) Int. Cl.
*B41F 27/12* (2006.01)

(52) U.S. Cl. ..... 101/477; 101/480

(58) Field of Classification Search ..... 101/415.1, 101/477, 480, 481, DIG. 46
See application file for complete search history.

(56) References Cited

U.S. PATENT DOCUMENTS 4,727,807 A 3/1988 Suzuki et al.
(Continued)

FOREIGN PATENT DOCUMENTS

CN 1677093 A 5/2005
(Continued)

OTHER PUBLICATIONS

Datalogic, Bar Code & More, Datalogic Communication Division,"Strichcode-Fibel", Datalogic S.p. A., 1998, 4 pp. (in German).

(Continued)

*Primary Examiner* — Ren Yan
(74) *Attorney, Agent, or Firm* — Jones, Tullar & Cooper, P.C.

(57) ABSTRACT

A system for checking the loading of a print form magazine, which stores at least two print forms, utilizes at least one code reader to read a code which is carried by the print forms. The code reader reads the coding of the printing forms in a secondary region. The coding of at least two printing forms, which are arranged adjacently, horizontally or vertically together, is read by the code reader. The code reader has an image sensor and an illumination system for lighting the secondary region. A system is also provided for transporting at least one print form stored in the print form magazine to a cylinder. An analytical unit can be connected to the code reader, or to another registration device, and stores information regarding the transport of each printing form, that is stored in the print form magazine, to the cylinder. The analytical unit that may be connected to the code reader is provided with a signaling device.

34 Claims, 41 Drawing Sheets

U.S. PATENT DOCUMENTS

| | | | | |
|---|---|---|---|---|
| 4,903,817 | A | 2/1990 | Yaguchi et al. | |
| 5,111,744 | A | 5/1992 | Wieland | |
| 5,127,328 | A | 7/1992 | Wieland | |
| 5,443,006 | A | 8/1995 | Beisel et al. | |
| 5,495,805 | A | 3/1996 | Beisel et al. | |
| 5,537,926 | A | 7/1996 | Beisel et al. | |
| 6,101,945 | A | 8/2000 | Hara et al. | |
| 6,167,806 | B1 * | 1/2001 | Chretinat et al. | 101/220 |
| 6,257,141 | B1 | 7/2001 | Hashimoto et al. | |
| 6,505,556 | B2 | 1/2003 | Miyauti | |
| 6,904,844 | B2 | 6/2005 | Koizumi et al. | |
| 7,156,022 | B2 | 1/2007 | Schneider et al. | |
| 7,159,516 | B2 | 1/2007 | Schneider et al. | |
| 7,331,287 | B2 | 2/2008 | Schneider et al. | |
| 7,530,309 | B2 | 5/2009 | Schneider et al. | |
| 2002/0050216 | A1 | 5/2002 | Miyauti | |
| 2005/0172846 | A1 | 8/2005 | Schneider et al. | |
| 2005/0213795 | A1 | 9/2005 | Sawamura | |

FOREIGN PATENT DOCUMENTS

| | | | |
|---|---|---|---|
| DE | 39 40 795 | A1 | 6/1991 |
| DE | 39 40 796 | A1 | 6/1991 |
| DE | 41 30 359 | A1 | 3/1993 |
| DE | 44 42 265 | A1 | 5/1996 |
| DE | 698 02 352 | T2 | 9/2002 |
| DE | 103 41 306 | A1 | 4/2004 |
| DE | 103 14 340 | B3 | 8/2004 |
| DE | 103 14 341 | B3 | 8/2004 |
| DE | 103 45 290 | A1 | 4/2005 |
| EP | 0100779 | A1 | 2/1984 |
| EP | 0329872 | A1 | 8/1989 |
| EP | 0 214 549 | B1 | 10/1991 |
| EP | 1 002 646 | A1 | 5/2000 |
| EP | 1 208 980 | A2 | 5/2002 |
| EP | 1 435 292 | A1 | 7/2004 |
| EP | 1464492 | A2 | 10/2004 |
| EP | 1473153 | A2 | 11/2004 |
| EP | 1 559 572 | A1 | 8/2005 |
| JP | 60052343 | A | 3/1985 |
| JP | 03227243 | A | 10/1991 |
| JP | 05169638 | A | 7/1993 |
| JP | 09300594 | A | 11/1997 |
| JP | 10-202840 | | 4/1998 |
| JP | 11348225 | A | 12/1999 |
| WO | 2004/085157 | A1 | 10/2004 |
| WO | 2004/085158 | A2 | 10/2004 |
| WO | 2004/085158 | A3 | 10/2004 |
| WO | 2004/085159 | A1 | 10/2004 |
| WO | 2004/085160 | A1 | 10/2004 |
| WO | WO 2004/085153 | A2 | 10/2004 |

OTHER PUBLICATIONS

Kipphan, Helmut (Ed.), "Handbuch der Printmedien: Technologien and Produktionsverfahren," Springer Verlag, Heidelberg, ISBN 3-540-66941-8, 2000, pp. 335-339; 943-951 (in German).

Kipphan, Helmut (Ed.), "Handbook of Print Media: Technologies and Production Methods," Springer Verlag, Heidelberg, ISBN 3-540-67326-1, 2001, pp. 321-325; 905-913 (in English).

* cited by examiner

SYSTEMS FOR CHECKING THE LOADING OF A PRINT FORME MAGAZINE AND SYSTEMS FOR TRANSPORTING AT LEAST ONE PRINT FORME STORED IN A PRINT FORME MAGAZINE TO A CYLINDER

CROSS-REFERENCE TO RELATED APPLICATIONS

This application is the U.S. national phase, under 35 USC 371, of PCT/EP2007/050624, filed Jan. 23, 2007; published as WO 2007/090732 A2 and A3 on Aug. 16, 2007 and claiming priority to DE 10 2006 006 136.5, filed Feb. 10, 2006, the disclosures of which are expressly incorporated herein by reference.

FIELD OF THE INVENTION

The present invention is directed to systems for checking the loading of a printing forme magazine and to systems for supplying at least one printing forme stored in a printing forme magazine to a cylinder. At least two printing formes are stored in the printing forme magazine. Each printing forme is provided with a code that is read by a code reader.

BACKGROUND OF THE INVENTION

A device for storing a dressing to be exchanged on a cylinder of a printing press is known from WO2004/085153 A2. A plurality of dressings are to be arranged on the cylinder. The dressing to be exchanged is stored in a receiving arrangement. The receiving arrangement has at least one code reader which detects a characterizing feature applied to the dressing for its identification. A control unit compares the detected characterizing feature with a allocation plan for the intended printing process, and inspects all the dressings stored in the receiving arrangement to determine whether the dressings are stored in the receiving arrangement in the correct order for the intended printing process. In the event of a discrepancy in the comparison, the control unit will generate a report warning of an incorrect mounting, before the dressing is mounted on the cylinder.

A method for supplying printing formes to a cylinder is known from EP 1 435 292 A1. An allocation plan for the printing formes that are to be supplied to the respective cylinder is stored in a memory unit. A code on each of the respective printing formes is compared with the allocation plan. The printing formes are supplied to the cylinder in accordance with the allocation plan.

A device for assigning the mounting position for a printing plate in a rotary press is known from EP 1 002 646 A1. A printing forme, which is identified by its page number, is assigned to a mounting position on the rotary press by a linkage with an imposition scheme, and the machine-identified mounting position is displayed. The mounting position of the printing plate cannot be derived from the code which is located on the printing plate. The content of the display does not relate to a message indicating a possible incorrect mounting.

A device for the automatic changing of printing formes on a cylinder of a printing press is known from U.S. Pat. No. 4,727,807. A plurality of printing formes are to be arranged on the cylinder. Printing formes, which are suspended from a transport system, and which are to be supplied to a printing group, are taken down at the printing group to which they are assigned and are stored intermediately in a receptacle, once a code reader has read a code that is applied to each printing forme and has determined its assignment to the printing group. The limitation of this device is that printing formes are assigned by their codes to a specific printing group, but not to their mounting position on the cylinder. When multiple printing formes are to be arranged on the cylinder, their mounting on the cylinder in accordance with an allocation plan provided for said cylinder is not assured.

A device for assigning dressings to be mounted on cylinders of a printing press is known from US 2002/0050216 A1. When the dressings are to be mounted manually by press operators, the dressings are assigned in the correct locations on the cylinders by the operators reading characteristic marks that are applied to the dressings. With this procedure, errors resulting, for example, from mistakes made by the operators cannot be excluded. No message indicating a possible improper mounting is provided.

A method and a device for automatically supplying a printing plate to a plate cylinder or for removing it from a plate cylinder of a rotary printing press are known from DE 39 40 795 A1. The method for automatically supplying a printing plate to a plate cylinder of a rotary printing press, and wherein the plate cylinder has, for example, devices for clamping and for tightening the printing plate, provides that the printing plate is placed in a storage chamber of a printing plate supply and/or removal arrangement, the plate cylinder is rotated into a printing plate infeed position, and the printing plate is fed, by the use of a number of transport rollers, to a clamping device of the plate cylinder. The method for automatically removing a printing plate from a plate cylinder of a rotary printing press, and wherein the plate cylinder has, for example, devices for loosening and for releasing the printing plate, is characterized in that the plate cylinder rotates forward into a released printing plate position, a clamp flap that holds the end of a printing plate is opened, the plate cylinder is then rotated backwards; a clamp flap that holds the starting end of a printing plate is then opened, and the printing plate is then fed, by the use of a number of transport rollers, to a storage chamber of a printing plate supply and/or removal device. The device that is used to perform the above described processes has at least one transport roller that is configured as a drive roller and one transport roller that is configured as a contact pressure roller The contact pressure roller is adjustable in relation to the drive roller. In addition, various actuators, a contact pressure roller, which is mounted so as to pivot to press the printing plate against the plate cylinder, and ejection fingers can be provided. The ejection fingers can be equipped with tips, which are arranged so as to pivot into the periphery of the plate cylinder. The storage chamber of the printing plate supply and/or removal device can also be mounted so as to pivot on a joint.

DE 39 40 796 A1 describes a device for automatically changing a printing plate on a plate cylinder of a rotary printing press. The plate cylinder has, for example, a device for clamping and for tightening the printing plate. The printing plate changing device has two storage chambers, so that a printing plate, that has been released on the plate cylinder, can be guided, via transport rollers, into the one storage chamber, while a printing plate that has been stored in the other storage chamber is fed, via transport rollers, to a clamping device of the plate cylinder.

A device for automatically supplying a printing plate to a forme cylinder of a printing press, or for removing a printing plate from a forme cylinder, is known from EP 0 214 549 B1. The printing plate to be supplied to the forme cylinder is guided to the forme cylinder, while being held in a desired position by the use of lateral positioning elements. The printing plate is supplied from an essentially horizontal storage position.

A method for operating a system that is configured at least for supplying at least one printing forme stored in a printing forme magazine to a cylinder is known from DE 103 14 341 B3. A code reader detects a code on the printing forme. Errors, such as a double loading or an incorrect loading at a printing point on the cylinder, can be identified via a message transmitted by the system, preferably at a control console for the printing press.

SUMMARY OF THE INVENTION

The object of the present invention is to provide systems for use in checking the loading of a printing forme magazine, and to provide a method for operating a system for use in supplying at least one printing forme, stored in a printing forme magazine, to a cylinder, which system can be realized cost-effectively and which increase process dependability in the operation of the printing press.

This object is attained according to the invention by the provision of a system in which at least two printing formes are stored in a printing forme magazine. Each of these printing formes has at least one code. At least one code reader is provided and detects the codes on the printing formes in a detection zone. The detection zone of the code reader detects the codes on the at least two forme cylinders that are arranged adjacent to each other. The two codes are detected simultaneously while the printing formes are arranged either horizontally or vertically in the printing forme magazine. The code reader includes an image sensor and an illumination device that illuminates the detection zone.

The benefits to be achieved with the present invention consist especially in that process dependability in a printing press operation is increased. An incorrect placement of printing formes, stored in a printing forme magazine is detected before their respective loading onto a forme cylinder of a printing press, thereby allowing the potential error to be corrected. In this way; an incorrect pre-print run can be prevented. Wasted paper copies of the printed product, resulting from the incorrect placement of printing formes is avoided. Consumable materials, such as a printing substrate, such as, for example, paper, and ink, are not wasted, thereby reducing costs. Because printing forme magazines can execute a change, of printing formes on a forme cylinder of a printing press within a very short time, which expeditious change of printing formes cannot be achieved manually, the full effect of this time advantage can be felt in the time for set-up of the printing press, as it is not canceled out by a manual correction in the plate loading. To change the printing formes on a forme cylinder, an automatic printing forme magazine requires only approximately 10% to at most 20% of the time that would be needed to change these printing formes manually. If an incorrect loading of a printing forme magazine is detected prior to the start of a new, planned production process, sufficient time generally remains in a printing plant to correct this error. Therefore, no delay in the production sequence occurs.

A further benefit of the present invention consists of the fact that only a small number of code readers are required, thus allowing the costs of the system, for use in checking the loading of a printing forme magazine, to be kept within reasonable limits. Each printing forme is not assigned its own code reader. Rather, the codes of a plurality of printing formes, which are stored in the printing forme magazine, can be detected simultaneously or in sequence, using the same code reader. This contributes considerably to a cost-effective implementation of the system for checking the loading of a printing forme magazine, since each code reader represents a considerable portion of the cost of the overall system. This benefit of the present invention is made possible by subdividing a detection range for the code reader into a plurality of individually activatable inspection zones, in which each of the inspection zones can be read out selectively.

It is also advantageous, in accordance with the present invention, that a printing forme can be tracked, in its respective use, based upon a detection of its individual code. This recording option is very helpful for statistical evaluations.

BRIEF DESCRIPTION OF THE DRAWINGS

Preferred embodiments of the present invention are represented in the accompanying drawings and will be described in greater detail in what follows with a description of additional advantages.

The drawings show.

DESCRIPTION OF THE PREFERRED EMBODIMENTS

Figure 1:
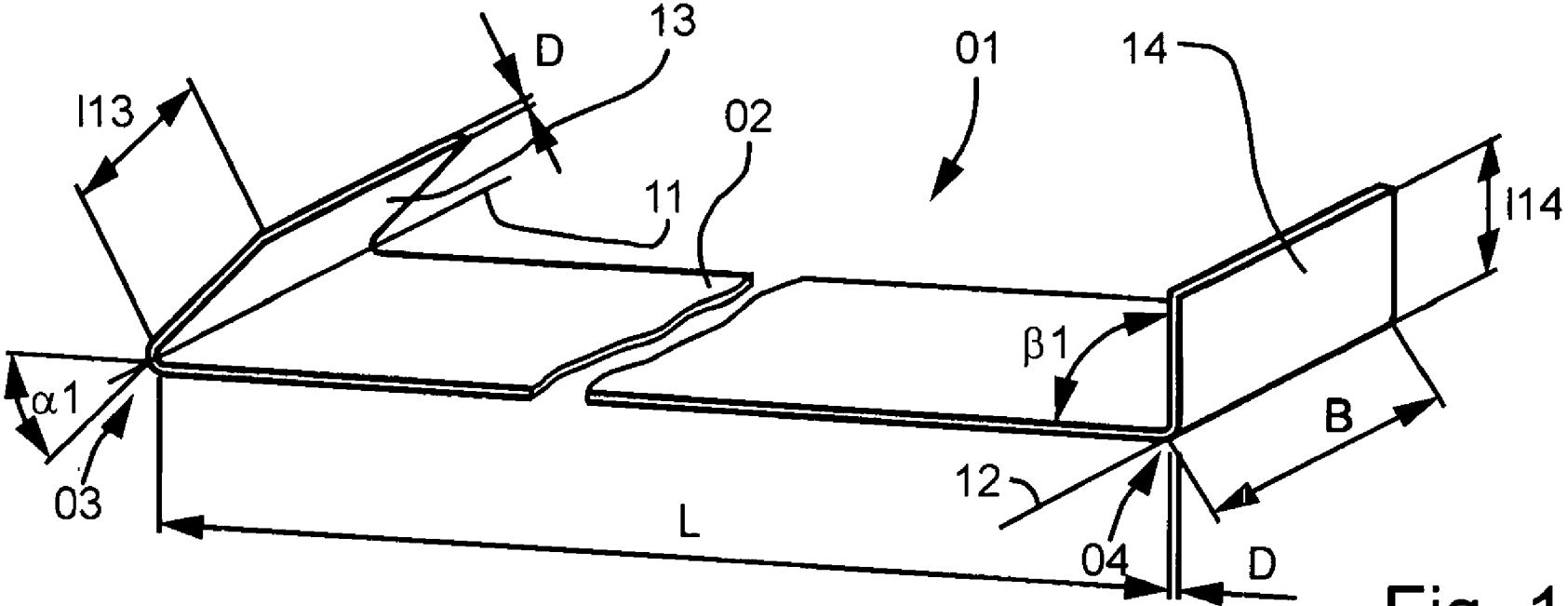
FIG. 1 a perspective representation of a dressing.
Figure 2:
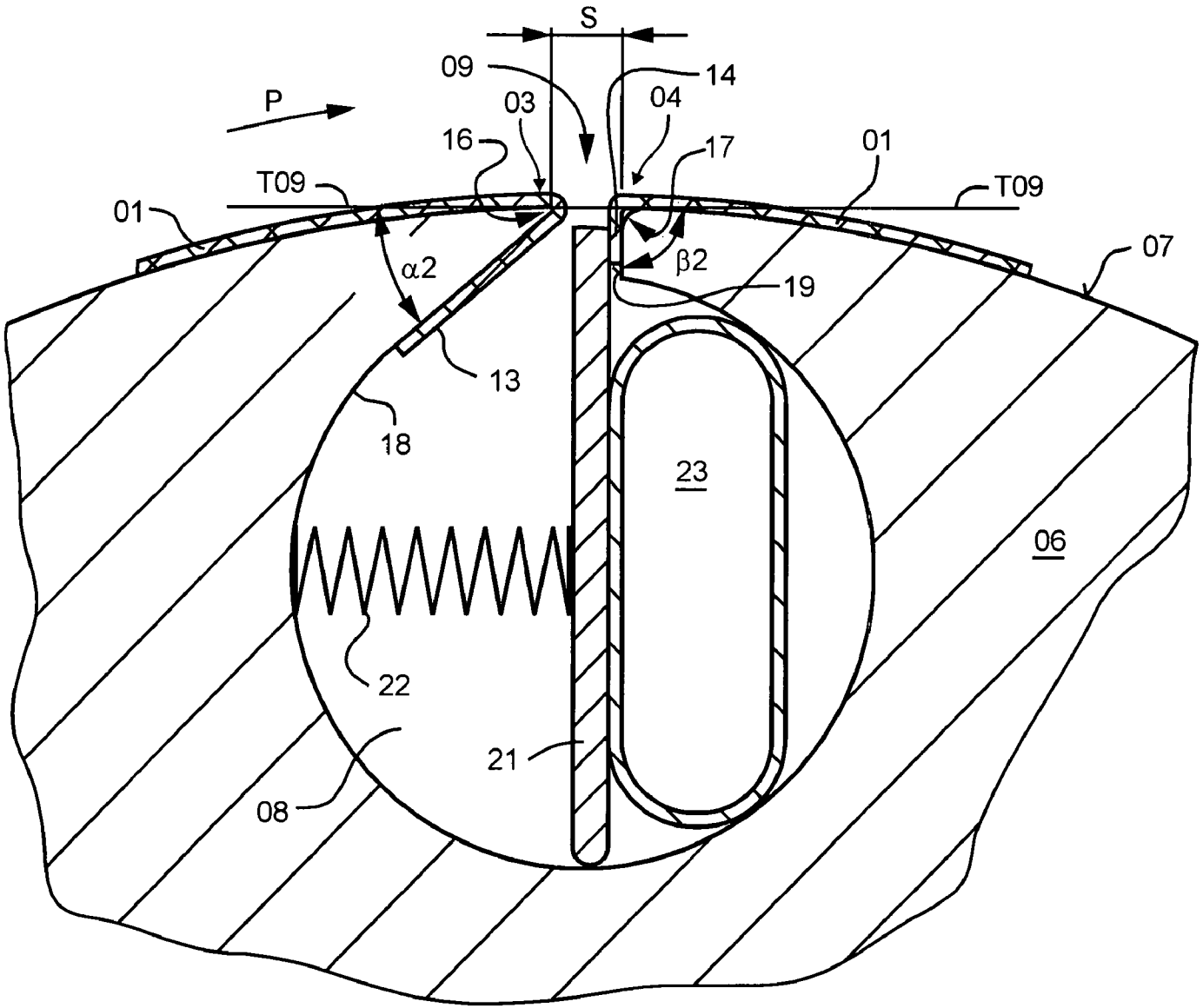
FIG. 2 a simplified cross-sectional representation of a holding device for a dressing arranged on a cylinder.

Referring initially to FIG. 1, a dressing 01, which is configured, for example, as a plate-shaped printing forme 01 or as a support plate that supports a printing blanket, has a substantially rectangular surface with a length L and a width B. The length L can have measured values, such as, for example, between 400 mm and 1300 mm and the width B can have measured values, such as, for example, between 280 mm and 1500 mm. Preferred measured values for the length L lie, for example, between 360 mm and 600 mm and preferred values for the width B lie, for example, between 250 mm and 430 mm. The surface of the dressing 01 has a bearing area, which will be referred to in what follows as a bearing surface 02, on which bearing surface 02 the dressing 01 rests when it is arranged on a circumferential surface 07 of a cylinder 06, as may be seen in FIG. 2. The reverse side of the dressing 01 from the bearing surface 02 is a working surface, which working surface, if the dressing 01 is configured as a printing forme 01, is provided with a print image or which at least can be provided with such a print image. The dressing 01 has two ends 03; 04 that are situated opposite one another, each such end 03; 04 preferably having angled suspension legs 13; 14. The ends 03; 04 delimit the bearing surface 02, and each of the suspension legs 13; 14 preferably extends completely, or at least partially, over the width B of the dressing 01. The bearing surface 02 of the dressing 01 is flexible at least over the length L When the dressing 01 is arranged on the circumferential surface 07 of the cylinder 06, the curvature of the bearing surface 02 can be adjusted, as seen in FIG. 2. When the printing forme 01 is arranged on the cylinder surface 07, the length L of the bearing surface 02 extends in the direction of the circumference of the cylinder 06. The width B of the bearing surface 02 extends in the axial direction of the cylinder 06. If the dressing 01 is configured as a printing forme 01, it can be suited either for a printing process that utilizes a dampening agent, such as, for example, a wet offset printing process, or for a so-called waterless printing process, such as, for example, a dry offset printing process.

As is shown in FIG. 2, the suspension legs 13; 14 of the dressing 01 are fastened by the use of a holding device. The holding device is arranged in a groove 08. That groove 08, as a rule, extends in an axial direction, with respect to the cylinder 06. An end 03 of the dressing 01, which is aligned first, with respect to the production direction P of the cylinder 06, is referred to as its leading end 03, while the opposite end 04 is the trailing end 04 of the dressing 01. At least the ends 03; 04 of the dressing 01, with the suspension legs 13; 14 formed thereon, are made of a rigid material, such as, for example, a metal material, such as an aluminum alloy. If the printing forme 01 is to be used in a dry offset printing process, the printing forme 01 can also be made of a plastic material or even of a rigid paper. Ordinarily, the material thickness D of the dressing 01, as depicted in FIG. 1, or the material thickness D of at least the suspension legs 13; 14 of the dressing 01 amounts to a few tenths of a millimeter, such as, for example, to 0.2 mm to 0.4 mm, and preferably to 0.3 mm. Thus, the dressing 01 is made, in its entirety or at least at its ends 03; 04, of a dimensionally stable material, so that the ends 03; 04 can be permanently deformed by bending them against a material-specific resistance.

At least at one end 03; 04 of the dressing 01, as seen in FIG. 1, but preferably at both ends 03; 04, an angled suspension leg 13; 14 is formed along a bending edge 11; 12. The suspension leg 13; 14 can be inserted into a narrow, and especially into a slit-shaped opening 09 in the groove 08 of the cylinder 06, as seen in FIG. 2, where leg 13; 14 can be fastened by a holding device, such as, for example, by a clamping device. For example, in relation to the length L of the non-curved, flat bearing surface 02 of the dressing 01, which has not been mounted, at its end 03, a suspension leg 13 is bent at the bending edge 11 at an opening angle $\alpha$1, or, at its end 04, a suspension leg 14 is bent at the bending edge 12 at an opening angle $\beta$1, all as seen in FIG. 1. The opening angles $\alpha$1; $\beta$1 both generally lie between 30° and 140°. If the opening angle $\alpha$1 is assigned to the leading end 03 of the dressing 01, it is preferably embodied as an acute angle, and specifically as an angle measuring 45°. The opening angle $\beta$1 at the trailing end 04 of the dressing 01 is frequently preferably greater than 80°, or is an obtuse angle, and especially is an angle measuring 85° or 135°. The angled suspension leg 13 at the leading end 03 has a length l13, which lies, for example, within a range of 4 mm to 30 mm, and especially lies between 4 mm and 15 mm. The angled suspension leg 14 at the trailing end 04 has a length l14, which measures, for example, between 4 mm and 30 mm, and especially lies between 8 mm and 12 mm. The shorter length is preferred, in order to ensure the easiest possible removal of the suspension legs 13; 14 from the opening 09 of the groove 08.

FIG. 2 shows, in a simplified cross-sectional view, a cylinder 06 with a circumferential surface 07 and a groove 08, which has a narrow, slit-shaped opening 09 directed toward the cylinder surface 07, and with a slit width S. The slit width S measures less than 5 mm, and preferably lies within a range of 1 mm to 3 mm. In the production direction P of the cylinder 06, the opening 09 has a front edge 16 and a rear edge 17. Between a wall 18, which extends from the front edge 16 to the groove 08, and an imaginary tangent line T09, which lies on the circumferential surface 07 of the cylinder 06 on the opening 09, an acute opening angle $\alpha$2 is formed, and which measures between 30° and 50°, and preferably measures 45°. The angled suspension leg 13 at the leading end 03 of the dressing 01 can therefore preferably be suspended at this front edge 16 of the opening 09 in a positive connection, because the opening angle $\alpha$1 at the leading end 03 of the dressing 01 is preferably matched to the opening angle $\alpha$2. The situation is the same with the trailing end 04 of the dressing 01. Between a wall 19, which extends from the rear edge 17 of the opening 09, in the direction of the groove 08, and an imaginary tangent line T09, which lies on the opening 09 in the circumferential surface 07 of the cylinder 06, an opening angle $\beta$2 is formed, which measures between 80° and 95°, and preferably measures 90°, or between 120° and 150°, and preferably measures 135°. The angled suspension leg 14 at the trailing end 04 of the dressing 01 can therefore preferably be suspended at this rear edge 17 of the opening 09, in a positive connection, because the opening angle $\beta$1 at the trailing end 04 of the dressing 01 is at least approximately matched to the opening angle $\beta$2.

At least one preferably pivotably mounted holding element 21 and one preferably pre-tensioned spring element 22, for example, are arranged in the groove 08. The spring element 22 forces the holding element 21, for example, against the angled suspension leg 14 at the trailing end 04, which is suspended from the rear edge 17 of the opening 09. The suspension leg 14 at the trailing end 04 is held against the wall 19 that extends from the rear edge 17 to the groove 08. To release the pressure exerted by the holding element 21, an actuating element 23, which preferably is a pneumatically actuable actuating element 23, is provided in the groove 08. This element, when actuated, pivots the holding element 21 against the force of the spring element 22. Therefore, the holding device, described above by way of example, consists substantially of the holding element 21, the spring element 22 and the actuating element 23.

The cylinder 06, described by way of example, is preferably embodied such that a plurality of preferably similar dressings 01 can be arranged on its circumferential surface 07. If the cylinder 06 is configured as a forme cylinder, it can be loaded, for example, with up to six plate-type printing forms 01, arranged side by side in its axial direction. More than one dressing 01 can also be arranged on the cylinder 06 in the direction of its circumference. It is possible to provide, for example, two grooves 08 in the cylinder 06, extending beneath its circumferential surface 07. Each of these two grooves 08 will typically extend axially in relation to the cylinder 06, and each have openings 09 that extend axially in relation to the cylinder 06 for fastening dressings 01. The plural openings 09 are typically arranged offset, for example by 180°, in relation to one another on the circumference of the cylinder 06, particularly when two dressings 01 are to be arranged on the cylinder 06, one in front of another along its circumference. With this loading of the cylinder 06 with two dressings 01 arranged one in front of another along its circumference, the leading end 03 of the one dressing 01 is fastened in the one groove 08, while the trailing end 04 of the same dressing 01 is fastened in the other groove 08. This applies correspondingly to the other dressing or dressings 01 arranged on this cylinder 06. If several dressings 01 are arranged side by side in the axial direction of the cylinder 06, these can also be advantageously arranged offset in relation to one another. The offset can relate, for example, to individual dressings 01 or to groups of dressings 01, each of which are arranged, for example, offset in relation to one another by half the length L of the dressing 01. However, such an offset requires that additional grooves 08 with allocated openings 09, or at least requires that partial sections of the additional grooves, are provided in the cylinder 06, with these additional grooves being arranged along the circumference of the cylinder 06, offset, for example by 90°, in relation to the previously mentioned grooves 08 and openings 09. A printing press that has, for example, six printing formes 01 arranged side by side in the axial direction of the cylinder 06, and also has, for example, two printing forms 01 arranged one in front of another in the circumferential direction of the cylinder 06, in other words, a so-called 6/2 machine, is typically used, for example, in newspaper printing.

Figure 3:
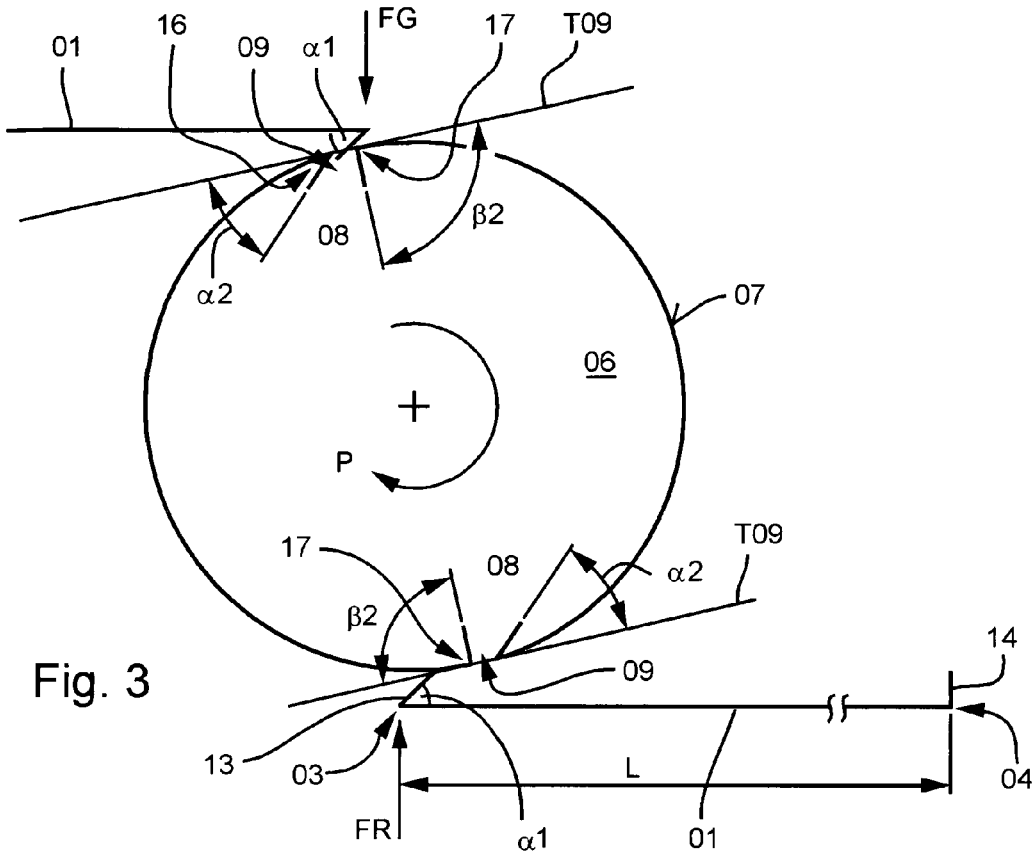
FIG. 3 dressings that have been brought tangentially to a cylinder, and on which dressings a radial force acts during their mounting.

A method for mounting a flexible dressing 01 on a cylinder 06 of a printing press is described by way of example in what follows. Two dressings 01 can be arranged on the cylinder 06, one in front of another along the cylinder's circumference. Each dressing 01 has a leading end 03 and a trailing end 04 in relation to the production direction P of the cylinder 06, as seen in FIG. 3. A suspension leg 13 is formed at the leading end 03 of the dressing 01. This suspension leg 13 is preferably angled in relation to the linear length L of the dressing 01, at a maximum opening angle $\alpha 1$ of 90°, and preferably of 45°. At least one preferably slit-shaped opening 09, with a first edge 16 and a second edge 17, viewed in the production direction P of the cylinder 06, is provided in the cylinder 06. The edges 16; 17 preferably extend parallel to one another in the axial direction of the cylinder 06. The leading end 03 of the dressing 01 is brought to the cylinder 06, preferably tangentially with respect to the cylinder's production direction P, for example, by the application of a thrusting force acting on the trailing end 04 of the dressing 01. The dressing 01 is brought up to the point at which the suspension leg 13 at the leading end 03 of the dressing 01 rests on the cylinder 06 behind the second edge 17 of the opening 09. In the course of a rotation of the cylinder 06 in its production direction P, the suspension leg 13, formed on the leading end 03 of dressing 01, engages in the opening 09 of the cylinder 06 as a result of a radial force FR, which acts on at least the leading end 03 and which is directed toward the cylinder 06. This leading end suspension leg 13 becomes hooked onto the first edge 16. In the case in which the dressing 01 rests against the circumferential surface 07 of the cylinder 06, supported by its suspension leg 13, formed at its leading end 03, the radial force FR can, for example, be the gravitational force FG of the dressing 01 acting on the circumferential surface 07 of the cylinder 06, as depicted at the top of FIG. 3.

Figure 4:
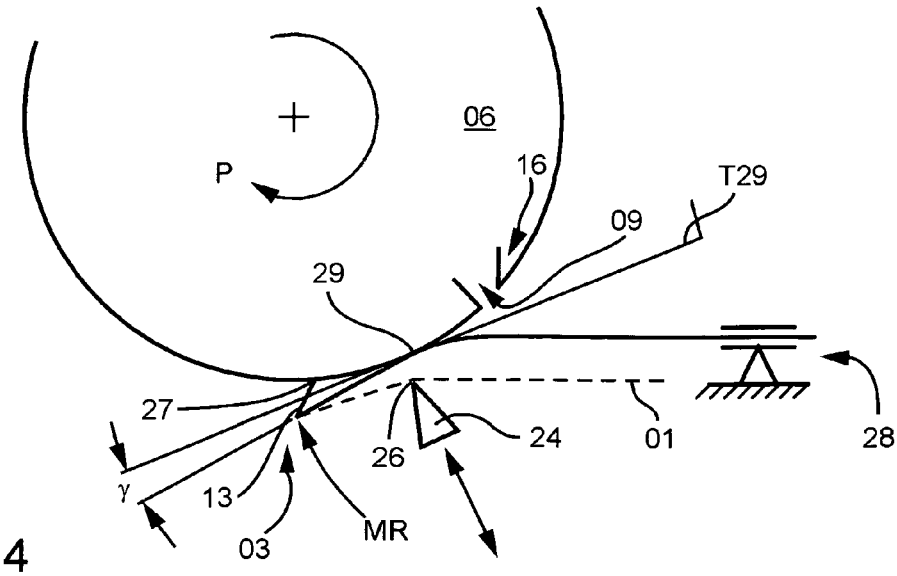
FIG. 4 elastically pre-tensioned dressings in the course of their being mounted on a cylinder.

In addition to using the gravitational force FG of the dressing 01, or as an alternative thereto, the leading end 03 of the dressing 01 can be elastically pre-stressed, as depicted in FIG. 4. The suspension leg 13, which is formed on the leading end 03 of the dressing 01, now springs into the opening 09 under the force of a restoring moment MR directed toward the cylinder 06, as soon as the opening 09 in the cylinder 06 and the contact line 27 of the suspension leg 13 with the circumferential surface 07 of the cylinder 06 are located directly opposite one another, as a result of a relative movement between the dressing 01 and the cylinder 06. Such relative movement occurs especially by virtue of the rotation of the cylinder 06 in the production direction P.

The restoring moment MR results from the condition that the dressing 01 is made of an elastically deformable material, and therefore inherently has an elastically resilient property. That property is utilized in such a way that, as the leading end 03 of the dressing 01 is being brought toward the cylinder, it is guided, for example, over an edge 26 of a support element 24. The edge 26 preferably extends axially with respect to the cylinder 06 and is spaced apart from the cylinder 06. The leading end 03 of the dressing 01 is bent at that point such that a bending stress builds up on the leading end 03 of the dressing 01, with a spring force directed toward the cylinder 06, representation of the dressing 01 as indicated by a dashed line in FIG. 4. At least until the leading end 03 of the dressing 01, which has been guided over the edge 26 of the support element 24, rests on the circumferential surface 07 of the cylinder 06, the trailing end 04 of the dressing 01 is fed in from a spatial direction that is fixed in relation to the cylinder 06. Accordingly, the dressing 01 is stabilized during the mounting process by the line of contact 27 of its suspension leg 13, which is attached at the leading end 03, with the circumferential surface 07 of the cylinder 06, and by its support against the edge 26 of the support element 24, and by a positional fixation 28 of the trailing end 04. The support element 24 can be configured, for example, as a rolling element 24, and especially and can be configured as a roller 24, or as one or more rollers 24 which may be arranged axially side by side with respect to the cylinder 06. The roller or rollers can be placed against the cylinder 06, for example, to function as a contact pressure element 24. The support element 24 is preferably positioned close to the cylinder 06, all as seen in FIG. 4.

The leading end 03 of the dressing 01 can also be brought against the cylinder 06 in such a way that this leading end 03, after coming into contact with the circumferential surface 07 of the cylinder 06, turns away from the circumferential surface 07 of the cylinder 06 at an acute angle $\gamma$ with respect to an imaginary, second tangent line T29, which lies on the circumferential surface 07 of the cylinder 06 in a contact point 29, as shown in the representation of the dressing 01, indicated in FIG. 1 by a continuous line. However, the bending of the leading end 03 of the dressing 01, which is being conducted in this manner, should only be so extensive that the suspension leg 13 formed on that leading end 03 still rests securely against the circumferential surface 07 of the cylinder 06. To support the secure positioning of the suspension leg 13 on the circumferential surface 07 of the cylinder 06, for example, the support element 24 can be placed in contact with the dressing 01. The leading end 03 of the dressing 01 is thus held close to the circumferential surface 07 of the cylinder 06.

During the course of the relative movement between the cylinder 06 and the dressing 01, preferably occurring during the rotation of the cylinder 06 in its production direction P, but also possibly occurring during a suitable movement of the dressing 01, for example, opposite the production direction P of the cylinder 06, the suspension leg 13 on the leading end 03 of the dressing 01 becomes hooked at the first edge 16 of the opening 09 of the cylinder 06. A roller element 24, which is engaged against the cylinder 06, can then support the mounting of the dressing 01 on the cylinder 06, since the roller element 24 rolls the dressing 01 onto the cylinder 06. At the trailing end 04 of the dressing 01, the suspension leg 14 is formed. This dressing trailing end suspension leg 14 is pressed, by the roller element 24, into the opening 09 in the cylinder 06 as the dressing 01 is being rolled onto the cylinder 06.

Figure 5:
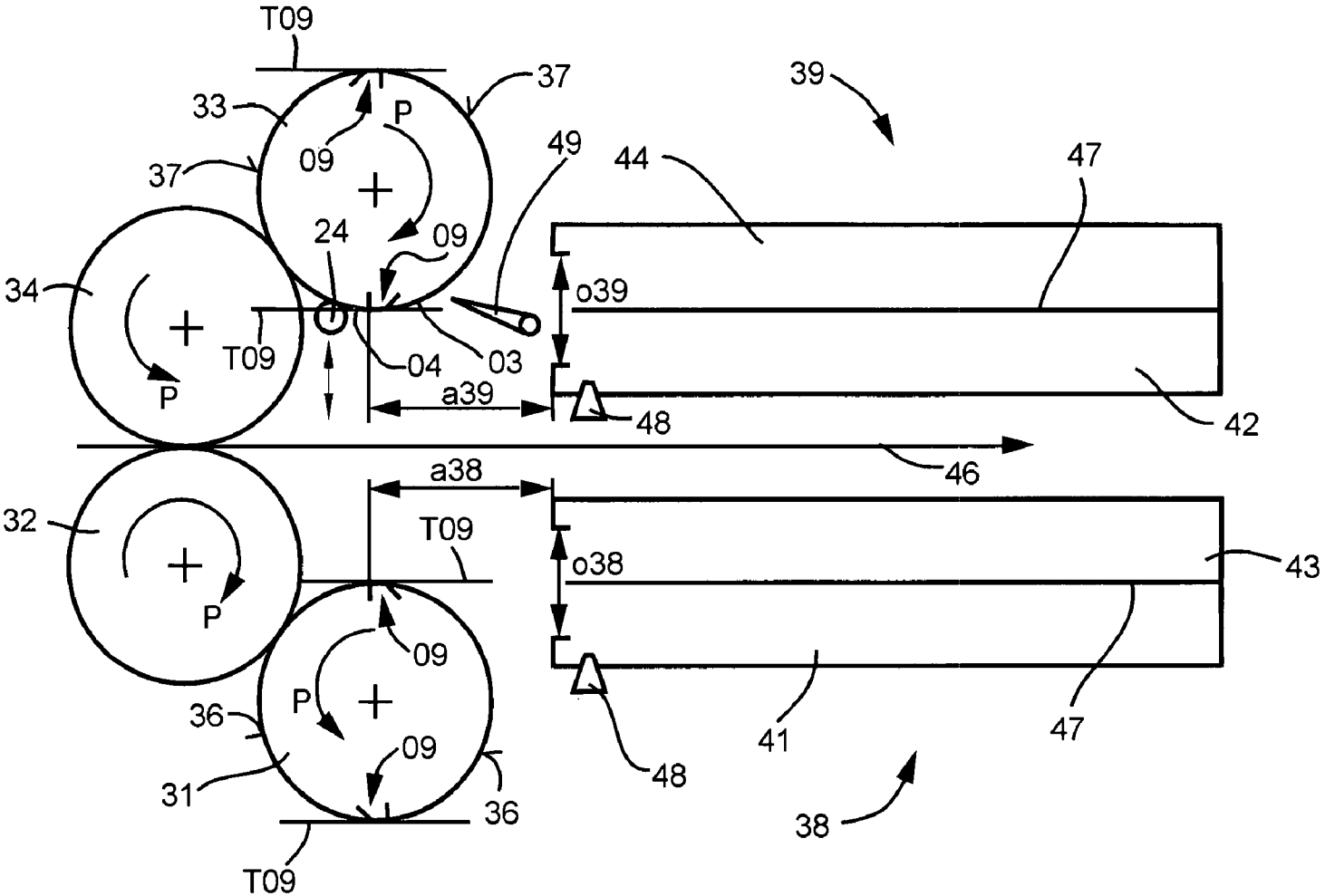
FIG. 5 a schematic depiction of a four-cylinder printing press with printing forme magazines.

A device for implementing the aforementioned method will now be described using the example of a rotary offset printing press including, for example, a vertical blanket-to-blanket printing group in a four-cylinder construction and with, for example, the horizontal feed of a printing substrate 46, and preferably a paper web 46, as depicted in FIG. 5. The rotary offset printing press can operate either in a wet offset printing process or in a dry offset printing process. In this example, there is provided a first pair of cylinders 31; 32, consisting of a forme cylinder 31 and a rubber blanket cylinder 32, which roll off against one another and which are arranged below the paper web 46. There is also provided second pair of cylinders 33; 34, and also consisting of a forme cylinder 33 and a rubber blanket cylinder 34, which roll off against one another and which are arranged above the paper web 46. Both cylinder pairs 31; 32, 33; 34 are provided in the printing group. The paper web 46 is fed between the two rubber blanket cylinders 32; 34, which are placed against one another. Several, such as, for example, five or six, printing points, for use with differently colored inks, are preferably provided in the printing press. In the discussion which follows, for the sake of simplicity, and without restricting the invention, it is assumed that at least the forme cylinders 31; 33 are identical in structure and dimensions.

The forme cylinder 31 is loaded, or at least can be loaded, about its circumference with two printing formes 36, and the forme cylinder 33 is loaded, or at least can be loaded, in the same manner with two printing formes 37. The printing formes 36; 37 each have a length L that corresponds, for example, to half the circumference of the forme cylinder 31; 33. The width B of each of the printing formes 36; 37 is dependent, among other things, upon the number of printing formes 36; 37 to be arranged axially along the respective forme cylinder 31; 33. For example, up to six printing formes 36; 37 can be arranged side by side in the axial direction of the respective forme cylinder 31; 33. The forme cylinders 31; 33 are preferably double-width and double-circumference in configuration. Printing blankets, which are arranged on the rubber blanket cylinders 32; 34, span the full circumference of the rubber blanket cylinders 32; 34.

As has already been discussed with reference to FIGS. 1 and 2, the printing formes 36; 37 have angled suspension legs 13; 14 at their end surfaces with respect to the length L, and with which the printing formes 36; 37 are fastened to the respective forme cylinders 31; 33. The suspension legs 13; 14 are each introduced into one of the slit-shaped openings 09, which are formed in the circumferential surface of the forme cylinder 31; 33, and which extend axially in relation to the forme cylinder 31; 33. If applicable, the suspension legs are held in place by a holding device that is arranged in the forme cylinder 31; 33, preferably in a groove 08. At the leading end 03 of each printing forme 36; 37, the opening angle $\alpha 1$ between the angled suspension leg 13 and the linear length L of the printing forme 36; 37 preferably measures 45°.

At the trailing end 04 of each printing forme 36; 37, the opening angle $\beta 1$ between the angled suspension leg 14 and the linear length L of the printing forme 36; 37 preferably measures 90°. The slit width S of the openings 09 formed in the forme cylinders 31; 33 preferably measures between 1 mm to 5 mm, and especially measures 3 mm.

To change one or more of the printing formes 36; 37 that are arranged on the forme cylinders 31; 33, for example, a first printing forme magazine 38 is provided for the forme cylinder 31 and is arranged below the paper web 46. A second printing forme magazine 39 is provided for the forme cylinder 33 and is arranged above the paper web 46. Each printing forme magazine 38, 39 has a receiving arrangement 41; 42, such as, for example, a chute 41; 42, which is configured to receive at least one used printing forme 36; 37 that is to be removed from the respective forme cylinder 31; 33. Each magazine 39 also has a receiving arrangement 43; 44, such as, for example, a chute 43; 44, which is configured to receive a new printing forme 36; 37 to be mounted on the respective forme cylinder 31; 33. Each receiving arrangement 41; 42; 43; 44 preferably has a plurality of storage positions for used printing formes 36; 37 that are to be removed and for new printing formes 36; 37 that are to be mounted. The printing forme magazine 38; 39 that is assigned to the respective forme cylinder 31; 33 is placed against that respective forme cylinder 31; 33, by virtue of a pivoting movement. In order to change a printing forme 36; 37, the first forme cylinder 31 and the second forme cylinder 33, for example, are moved out of contact with their respective rubber blanket cylinders 32; 34, with which they are operatively connected. Alternatively, or in addition to the forme cylinders 31; 33, which have been moved out of contact, the rubber blanket cylinders 32; 34 can also be moved out of contact with the paper web 46. In changing one or more printing formes 36; 37, the relevant forme cylinder 31; 33 is uncoupled from the paper web 46, while the other pair of cylinders 32; 34 in the printing group can remain in production.

In the printing forme magazines 38; 39, the chutes 41; 43 or 42; 44, which are intended to receive at least one used or new printing forme 36; 37, are each advantageously arranged at least substantially parallel to one another. In other words, these chutes are preferably arranged one on top of another in a layered construction. In this arrangement, for example, a dividing wall 47 can separate the chutes 41; 43 or 42; 44 from one another in the respective printing forme magazine 38; 39, as seen in FIG. 5. Each chute 41; 43 or 42; 44 preferably has at least two storage positions for the printing formes 36; 37 to be stored in it. To enable adequate access to the chutes 41; 43 or 42; 44, even when the paper web is in motion, such as, for example, in order to allow the removal of a used printing forme 36; 37 from the chutes 41; 42 or to place a new printing forme 36; 37 in the chutes 43; 44, these chutes 41; 43 or 42; 44 are preferably accessible from the side that faces away from the forme cylinder 33 or from a side of the printing forme magazine 38; 39 that extends parallel to the direction of travel of the paper web 46. Each of the printing forme magazines 38; 39 preferably extends over the length of the barrel of the forme cylinder 31; 33, but extends at least over the width B of the printing forme 36; 37, and each is capable of holding one printing forme 36; 37 preferably completely, in other words, over its entire length L, in its respective one of the chutes 41; 43 or 42; 44. The chutes 41; 43 or 42; 44 are located, for example, in a housing. The housing has an opening o38; o39. Each opening o38; o39 can, in each case, be aligned parallel with the barrel of the respective forme cylinder 31; 33. A printing forme 36; 37 can be fed through the respective opening o38; o39 to the respective forme cylinder 31; 33, or can be introduced from that forme cylinder 31; 33 into the chute 41; 43. For this purpose, the openings o38; o39 in the printing forme magazines 38; 39 are moved toward the forme cylinders 31; 33 to a considerably smaller distance a38; a39 in relation to an opening 09 in the forme cylinders 31; 33, with that distance a38; a39 being smaller than the length L of the printing formes 36; 37. Advantageously, distances a38; a39 are between 2% and a maximum of 50% of the length L of the printing formes 36; 37, and especially are short distances a38; a39 of up to only 10% of the length L. It is advantageous to arrange at least the printing forme magazine 39, which is positioned above the paper web 46, so as to be movable. This printing forme magazine 39 can, for example, be moved or pivoted from a position of rest, which is preferably located above the printing group, to a working position against the associated forme cylinder 33. The movable arrangement of the printing forme magazines 38; 39 results in improved accessibility to the printing group, for example, for performing work that must be performed from there, such as, for example, maintenance work. In the working position, preferably the chutes 41; 43 or 42; 44 of the printing forme magazines 38; 39, but at least the storage positions for the printing formes 36; 37, are preferably oriented horizontally or at a slight inclination, preferably less than 15° from the horizontal H. The openings o38; o39 of the printing forme magazines 38; 39 advantageously point toward one of the openings 09 in that forme cylinder 31; 33 with which the respective printing forme magazine 38; 39 works.

A movably arranged printing forme magazine 38; 39 can be fixed in place in its working position in front of a forme cylinder 31; 33 at its distance a38; a39 and in its orientation in relation to the forme cylinder 31; 33 by the use of a stop mechanism 48, as depicted in FIG. 5. The stop mechanism 48 can be embodied, for example, as a beveled bolt, which is stationary, for example, in relation to the forme cylinder 31; 33. Beveled bolt 48 engages in an opening in the housing of the printing forme magazine 38; 39, and centers the openings o38; o39 of a printing forme magazine 38; 39, which has, for example, been pivoted against the forme cylinder 31; 33, with respect to the barrel of the forme cylinder 31; 33. It is advantageous to bring the forme cylinder 31; 33 into a predefined position, in accordance with the side register, for example, and to reset it with respect to the side register, before an exchange of a printing forme 36; 37 between the forme cylinder 31; 33 and the printing forme magazine 38; 39 occurs. As an alternative to adjusting the forme cylinder 31; 33, the printing forme magazine 38; 39 can also be moved laterally in relation to the forme cylinder 31; 33 to a predefined position, so that the exchange of a printing forme 36; 37 between the printing forme magazine 38; 39 and the forme cylinder 31; 33 can be accomplished in a selective manner and without lateral offset.

It is advantageous to arrange an articulated, and preferably pivotable guide plate 49 near the forme cylinder 33, and in front of the opening of the printing forme magazine 39. Guide plate 49 can be oriented toward the forme cylinder 33, as seen in FIG. 5, and can be used to selectively guide a trailing end 04 of a printing forme 37, which has been released from an opening 09 in the forme cylinder 33, to the chute 42 for the purpose of receiving the printing forme 37 that is to be removed. In particular, the guide plate 49 serves to block incorrect access, by a printing forme 37, which is to be removed from the forme cylinder 33, to the chute 44, in which at least one new printing forme 37 is made available or at least can be made available. It can also be advantageous to position a similar guide plate 49, which, for purposes of clarity, is not specifically illustrated in FIG. 5, on the printing forme magazine 38, which is arranged below the paper web 46 and which works with the forme cylinder 31.

Figure 36:
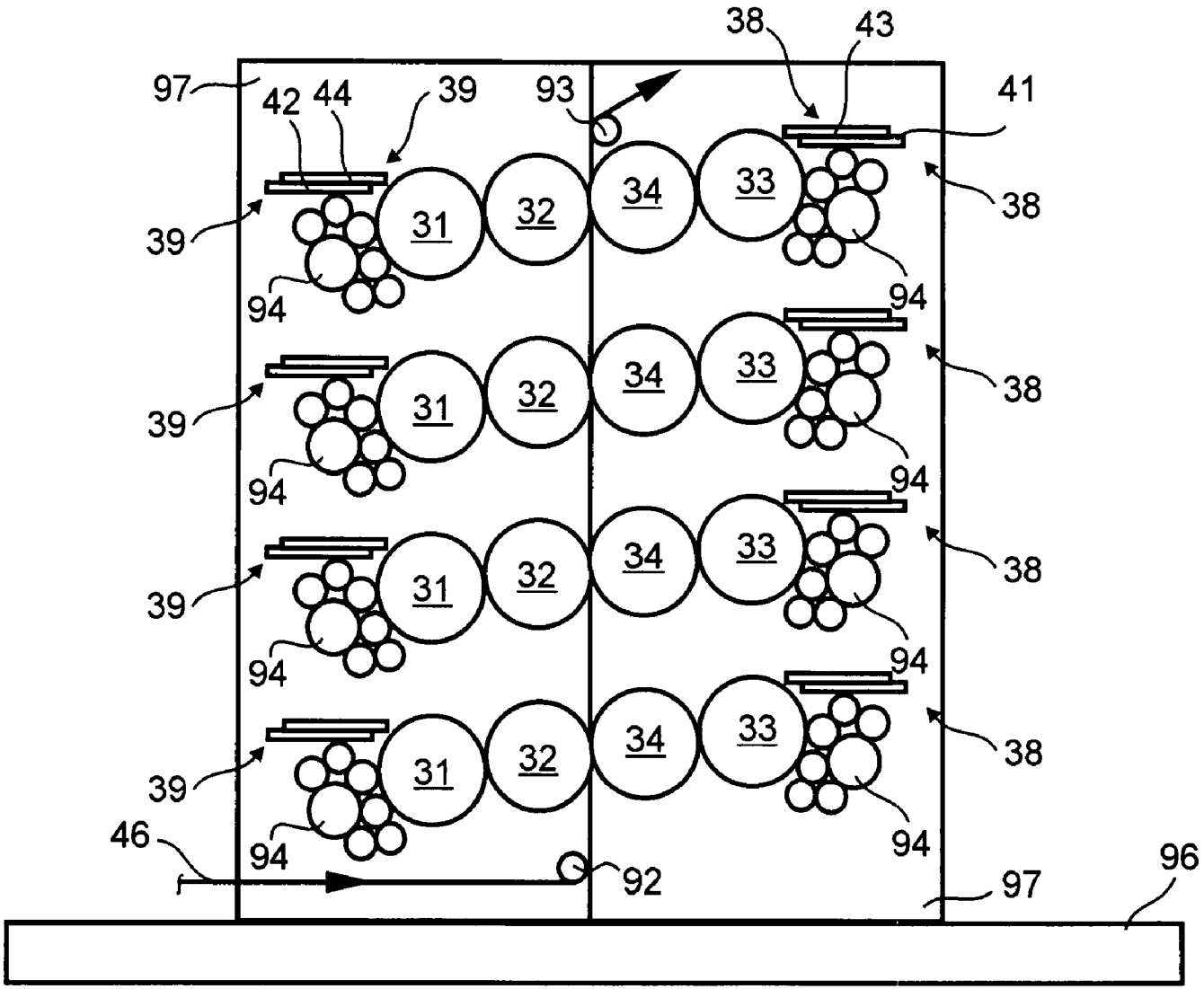
FIG. 36 a schematic depiction of a preferred embodiment of a printing press with printing forme magazines.

A further preferred embodiment of a printing press with printing forme magazines results in connection with a printing press, and for example, more specifically in connection with a multicolor offset printing press that operates in a wet offset printing process or in a dry offset printing process, and in which printing press the printing groups are preferably arranged one above another, in at least one frame 97 on a base 96, in a bridge construction or in a compact figure-eight construction, or in other words, a printing press with eight printing points, the structural height of which is low, as is shown by way of example in FIG. 36. In this arrangement of a printing press, a printing substrate 46, preferably a paper web 46, is fed to the printing press and is guided vertically through the printing groups. In the printing press depicted in FIG. 36, four printing groups arranged, in sequence, in the direction of transport of the paper web 46 are shown by way of example. Each such printing group has a transfer cylinder 32; 34, cooperating with a forme cylinder 31; 33, and situated to the right and to the left of the paper web 46. The transfer cylinders 32; 34 that are positioned opposite one another in such a printing group, and in engagement with the paper web 46, roll off against one another. The paper web 46 is brought to the first printing group, for example, by a first paper guide roller 92 that is arranged in front of the first printing group, and the web is conducted away from the fourth printing group by a second paper guide roller 93 that is arranged downstream from the fourth printing group. At least one inking unit 94 is assigned to each forme cylinder 31; 33, the construction of which will not be discussed in further detail here. A printing forme magazine 38; 39 is assigned to each forme cylinder 31; 33, with each magazine preferably having two chutes 41; 42; 43; 44. As with the preferred embodiment, which was described above in connection with FIG. 5, preferably each printing forme magazine 38; 39, but at least its storage position for a printing forme 36; 37 to be stored, is preferably oriented, in its working position, substantially horizontally or with only a slight inclination of less than 15°, in relation to the forme cylinder 31; 33. When the printing forme magazine 38; 39 is in its working position, at least one printing forme 36; 37 can be exchanged between the chutes 41; 42; 43; 44 and the forme cylinder 31; 33. Either a printing forme 36; 37 that is no longer required for implementing a print job can be removed from the forme cylinder 31; 33 and introduced into the chute 41; 42, or a new printing forme 36; 37, that is required to implement the print job to be accomplished, can be removed from the chute 43; 44 and mounted on the forme cylinder 31; 33. In this preferred embodiment, the structural characteristics of the printing forme magazines 38; 39 can correspond to those of the preferred embodiment which was described previously in connection with FIG. 5. It is advantageous for the performance, and especially for the completion, of a printing forme change to be monitored by sensors. The printing forme magazines 38; 39, together with the forme cylinders 31; 33, can also be controlled in such a way that a printing forme change can be selectively initiated, preferably from a control console that is assigned to the printing press. Because the printing forme magazines 38; 39 can be prepared for a printing forme change, during the running production of the printing press, the set-up time, which requires that the printing groups be shut down, is reduced to the shortest possible period of time of, for example, less than two minutes, and preferably is reduced to less than ninety seconds, for a complete change of all the printing formes 36; 37 of the printing groups which are arranged in this printing press. Depending upon the configuration of the printing groups, for example, ninety-six printing formes 36; 37 can be used simultaneously in the above-described printing press. Such a rapid printing forme change, even with a large number of printing formes 36; 37, increases the efficiency of the printing press with this increase in efficiency being substantially due to the extremely short down time.

Figure 6:
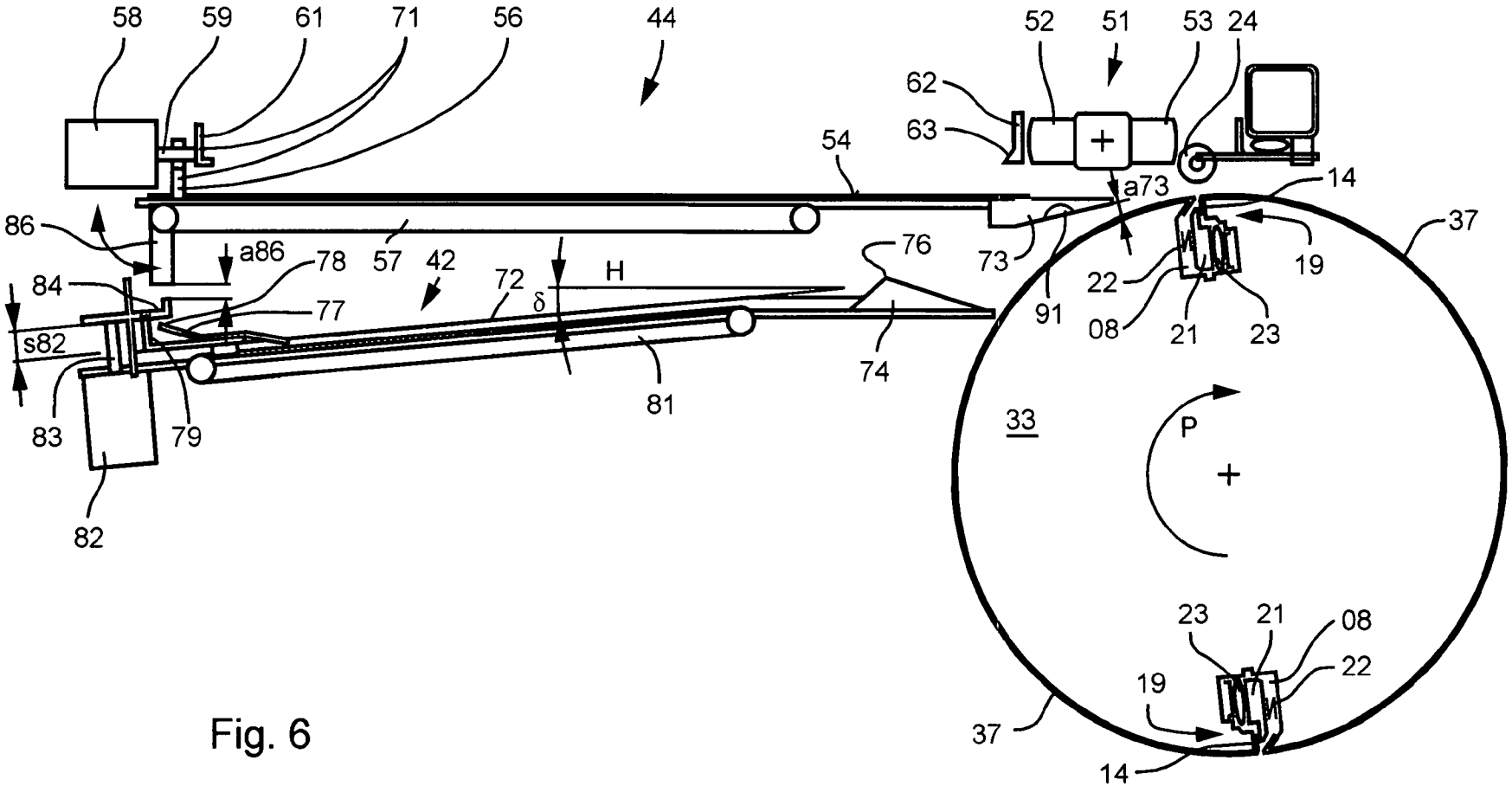
FIG. 6 a device for changing a dressing on a forme cylinder of a printing press.

Further details with regard to a method and to a device for implementing the method in accordance with the present invention will now be described, by way of example, with reference to FIG. 6 through 35. FIG. 6 shows a forme cylinder 33 with two grooves 08, which are offset on the circumference of the forme cylinder 33 by 180°, and two printing formes 37 arranged, one in front of another, along the circumference. The suspension leg 14, which is set at a right angle on the trailing end 04 of each printing forme 37 in the production direction P of the forme cylinder 33, is held in place against a wall 19 by a holding element 21 that is arranged in the groove 08 and is pressurized by a spring element 22. The wall 19 extends from a rear edge 17 of an opening 09, which opens the groove 08, up to the groove 08. The holding element 21 can be released by actuating a pneumatic actuating element 23 that acts counter to the spring element 22. On the wall 18, which extends from the front edge 16 of the same opening 09 to the groove 08, the acutely angled suspension leg 13 is attached in a positive connection at the leading end 03 of the other printing forme 37, which is arranged along the circumference of the forme cylinder 33. For details on how the printing formes are held in place, reference is again made to FIG. 2.

FIG. 6 also shows a contact pressure element 24 in the form of a contact pressure cylinder 24 or a contact pressure roller 24, which can be engaged against the forme cylinder 33 via pneumatic actuation. An alignment device 51, which is mounted to pivot parallel with its axial direction, is also provided near the forme cylinder 33, and is configured with two diametrically arranged wing-shaped stops 52; 53 which both act laterally upon a printing forme 37. The alignment device 51 uses one of its stops 52; 53 to temporarily fix a printing forme 37, which is to be mounted, in place in relation to the side register, as that printing forme 37 is being moved toward the forme cylinder 33. In this case, each of the stops 52; 53 is configured, for example, as a lateral guide plate. The stops 52; 53 are arranged, for example, on a pivotable cross member, such as, for example, on a square tube. The stops 52; 53 differ, for example, in their positions in relation to the axial direction of the forme cylinder 33. For a single-width printing forme 37, for example, the stop 52, and for a printing forme 37 in panorama format the stop 53, is placed in use via a corresponding pivoting of the alignment device 51. The stops 52; 53 can be adjusted axially with respect to the forme cylinder 33 in accordance with the necessary width of the printing forme 37.

Further details on the printing forme magazine 39 can also be seen in FIG. 6. The preferred embodiment, which is shown in FIG. 6 through 35, is based on a variant for the printing forme magazine 39. An upper chute 44, which is used to provide a printing forme 37 to be mounted on the forme cylinder 33, can be operated as an autonomous component, independently of a lower chute 42, which is used to receive a printing forme 37 that has been removed from the forme cylinder 33. The two chutes 42; 44 can be used as individual structural components that can be used independently of one another and which are therefore autonomously functional. This autonomous configuration is of interest if, for example, only the loading of the forme cylinder 33 with new printing formes 37 is to be automated, whereas the removal of used printing formes 37 is to be performed manually by a press operator. If both chutes 42; 44 are embodied in the printing forme magazine 39, a fully automated printing forme changer results. The two chutes 42; 44 each have all the devices necessary for storing and for conveying printing formes 37. The two chutes 42; 44 are preferably both very compact in construction. In particular, despite their ability to each receive at least two printing formes 37, the two chutes 42; 44 have a low structural height. The structural height measures, for example, less than 150 mm, and preferably measures less than 100 mm.

In the preferred embodiment of the present invention, which is shown schematically in FIG. 6 through FIG. 35, the chute 44 is arranged horizontally and is aligned tangentially to the forme cylinder 33, and specifically to its surface. In this manner, the gravitational force FG that is exerted on the printing forme 37, is utilized in the best possible way to support, and to accomplish the functions described below. A support 54, on which the angled suspension legs 13; 14 of a first printing forme 37 to be mounted on the forme cylinder 33 can be set or placed, is located in the chute 44. A printing forme 37 that is placed on the support 54 rests there, for example, along its entire linear length L. The support 54 is preferably configured not as a solid surface, but is configured in the form of parallel strips 54 or of sliding rails 54. The suspension leg 14 at the trailing end 04 of the first printing forme 37 lies in the chute 44 on the side of chute 44 that faces away from the forme cylinder 33, against a preferably vertical stop 56. The stop 56 can be moved, via the use of a conveyor mechanism 57, linearly, and parallel to the support 54, in the direction of the opening o39 of the printing forme magazine 39. Stop 56 is moved in order to convey this first printing forme 37, via a translatory movement of stop 56, and preferably without deformation of the first printing forme 37, out of the chute 44 at least until the suspension leg 13 at the leading end 03 of this first printing forme 37 can engage in the slit-shaped opening 09 of the forme cylinder 33. The stop 56 therefore acts as the contact position for the first printing forme 37 in the chute 44, and functions at the same time as a pushing element 56. If this first printing forme 37 has at least one register stamp on the suspension leg 14 at its trailing end 04, the stop 56 can, for example, advantageously also be configured as a register pin 56. In this configuration, the stop 56 is connected to the conveyor mechanism 57 and extends perpendicular, in relation to the support 54. When the first printing forme 37 is placed against the stop 56, a pre-registration of printing forme 37, with respect to its side register, takes place. The conveyor mechanism 57 is configured, for example, as a belt drive 57 or as a linear drive 57, preferably as a pneumatic linear drive 57, and especially is configured as a pistonless, double-sided linear drive 57.

Figure 13:
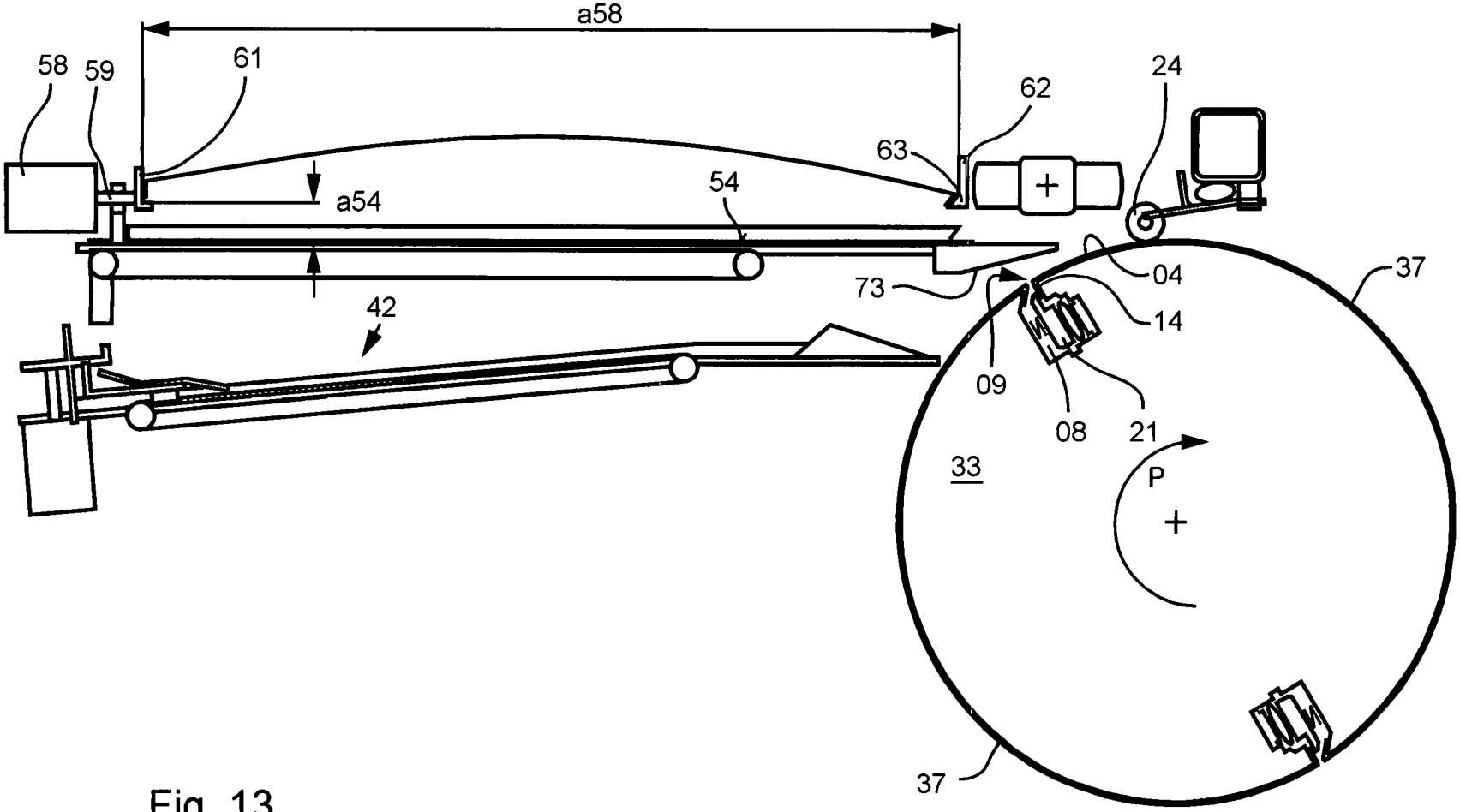
FIG. 13 through 35 a schematic representation of a process sequence for changing printing formes on a forme cylinder.

A holder 58, which especially is configured as a printing forme holder 58, for use in holding at least a second printing forme 37, that is to be mounted on the forme cylinder 33, is located in the chute 44. As is shown in FIG. 13, the second printing forme-37 is held above the support 54, such as, for example, at a distance a54 above the support 54, by the printing forme holder 58. The printing forme holder 58 has a piston 59 or a pushing element 59, which can be moved parallel with the support 54, for example, on the side of the support 54 that faces away from the forme cylinder 33. At the end of piston 58 a holding element 61, such as, for example, an L-shaped bracket 61, is arranged. The second printing forme 37 is held above the support 54 between the bracket 61 of the extended pushing element 59 and another holding element 62, such as, for example, a rigidly arranged stop 62, which stop 62 is arranged in the area of the opening o39 of the printing forme magazine 39. In this case, the distance a54 has a value, which value preferably lies between two and four times the length 114 of the suspension leg 14 at the trailing end 04 of the second printing forme 37. The second printing forme 37 is clamped by adjusting an inside distance a58, between the bracket 61 of the extended pushing element 59 and the stop 62, to be shorter than the linear length L of the second printing forme 37. The stop 62, that is located in the area of the opening o39 of the printing forme magazine 39, preferably has an inclined surface 63, against which inclined surface 63 the suspension leg 13 at the leading end 03 of the second printing forme 37 can be supported. The inclined surface 63 of the stop 62, and the L-shaped bracket 61, against which the suspension leg 14 at the trailing end 04 of the second printing forme 37 can be supported, are oriented to face one another. Because the second printing forme 37 is flexible, especially along its length L, it arches when it is clamped between the bracket 61 and the stop 62. The pushing element 59 of the printing forme holder 58 is preferably capable of moving linearly parallel to the support 54, and preferably has two stable operating positions. A first stable operating position is in the retracted state, in which the second printing forme 37 is released, and a second stable operating position is in the extended state, in which extended state the second printing forme 37 is clamped. In one variation of the printing forme holder 58, the positions of the movable pushing element 59 and of the rigid stop 62 are exchanged. The pushing element 59 is now located in the area of the opening o39 of the printing forme magazine 39, and the stop 62 is now located on the side of the chute that faces away from the forme cylinder 33. As an alternative to the above-described linear movability, the bracket 61 or the stop 62 can also be arranged so as to be able to pivot around a pivoting axis that is aligned parallel with the width B of the printing forme 37. A printing forme 37 that is clamped between the bracket 61 and the stop 62 is located at its upper or first storage position. A printing forme 37, that has been placed on the support 54, assumes a lower, second storage position in this state. The printing forme 37, which has been placed in the second storage position, is intermediately stored before being conveyed to the forme cylinder 33. With an actuation, which preferably is initiated remotely, such as, for example, an actuation which is initiated from a control console that is a part of the printing press, the printing forme 37 changes from its upper, first storage position to its lower, second storage position inside the chute 44, as seen in FIG. 13, for example. Printing formes 37, which are stored in the first storage position and in the second storage position are spaced from one another, for example, along their length L, at the distance a54. They thus do not come into contact with one another, and consequently cannot damage one another.

Figure 7:
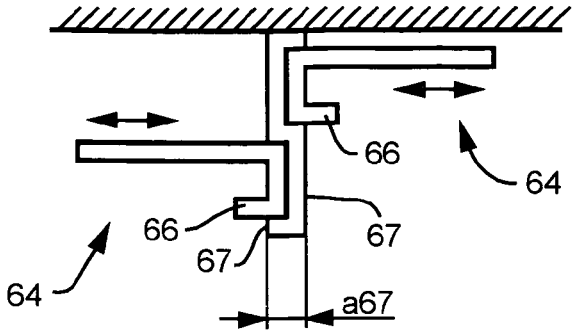
FIG. 7 a detailed view of guide rails for use in the lateral holding of a second printing forme in a chute of the device for changing a dressing.
Figure 8:
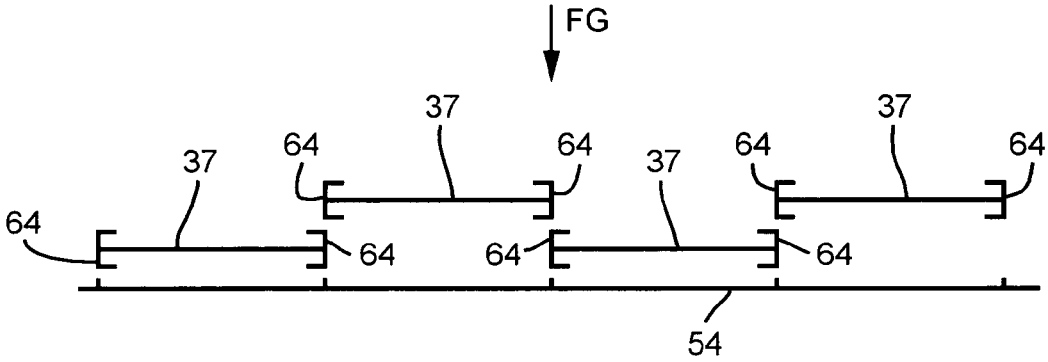
FIG. 8 a schematic depiction of printing formes arranged side by side in the axial direction of the forme cylinder in a chute.
Figure 9:
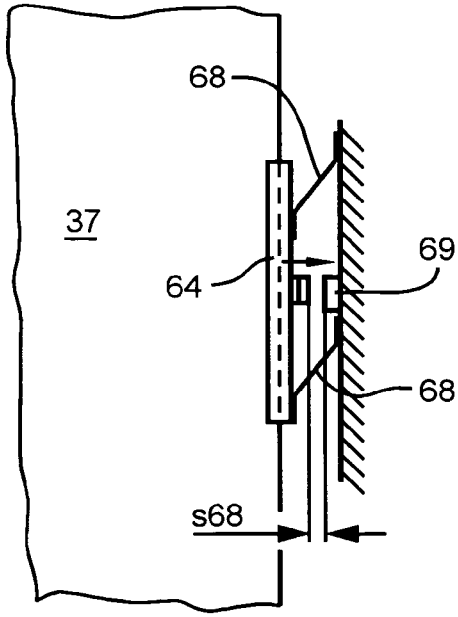
FIG. 9 a suspension of a guide rail that can be moved in a chute.

A further preferred embodiment of the printing forme holder 58, which preferred embodiment advantageously permits an especially low structural height for the chute 44, provides for the second printing forme 37 to be held in an upper storage position above the support 54, which extends within a single plane in the axial direction of the forme cylinder 33, by the use of at least one holding element 64. The holding element 64 is configured, for example, as a guide rail 64, and preferably is configured as two guide rails 64 that extend parallel to one another, as is depicted in FIG. 7 through 9. The guide rails 64 hold the second printing forme 37, which is present in the chute 44, in the upper storage position, on the two longitudinal sides of that forme, and over at least a portion of its length L. The embodiment of the printing forme holder 58 with these guide rails 64 assumes that the suspension legs 13; 14, which are situated at the ends 03; 04 of the second printing forme 37 do not extend over the full width B of the printing forme 37, and thus these ends 03; 04 do not extend up to the longitudinal sides of the printing forme 37. Therefore, the longitudinal sides of the printing forme 37 form a projection, in relation to the suspension legs 13; 14, in the area of the bearing surface 02 of the printing forme 37. This projection is necessary to make the guiding of the printing forme 37, in the guide rails 64, possible. The holding element 64, and in particular each guide rail 64, consists, for example, of a U-shaped bracket, which encompasses one of the longitudinal sides of the printing forme 37 with a certain amount of play, and into which bracket the second printing forme 37 can be inserted from the side that faces away from the forme cylinder 33. The second printing forme 37 is preferably supported by the guide rails 64 along a narrow area of its side. The holder acts especially as a vertical support and therefore also acts as a support against the gravitational force FG acting upon the printing forme 37. The guide rails 64 are preferably made of a dimensionally stable material, such as metal or plastic.

To place a second printing forme 37, which is held by the guide rails 64, on the support 54, at least one of the guide rails 64 is capable of being moved in the direction of the width B of the second printing forme 37. Preferably, both such guide rails 64 are capable of being moved in opposite directions along the width B of the second printing forme 37, so that they move away from one another for at least a short period of time, thereby increasing their distance from one another such that they no longer support the longitudinal sides of the printing forme 37 vertically. The second printing forme 37 now falls between the guide rails 64 onto the support 54 by virtue of the gravitational force FG acting on it. If, in a first operational mode, the holding element 64 holds the second printing forme 37 in the upper storage position, such as, for example, by the use of an electrical or a magnetic force, the holding element 64 switches from its first operational mode to a second operational mode, preferably via remote control. In this second operational mode, the holding-element 64 causes the printing forme 37 and the holding element 64 to be released from one another, and causes the printing forme 37, upon being released from the holding element 64, to change to the storage position that preferably lies directly vertically below the upper storage position. This is a result of a free fall of the printing forme 37 in the chute 44, and therefore occurs merely by virtue of the gravitational force FG acting upon the printing forme 37. The second printing forme 37 is held in both the lower and the upper storage positions in the chute 44 at an inclination of less than 15°, and preferably is held horizontally. At least the longitudinal extension of the guide rails 64, which are configured as support bearings for the second printing forme 37, also have only this slight inclination or also extend horizontally.

A release of the second printing forme 37 from the guide rails 64, which are acting upon it laterally, is preferably aided by a stop 67, as may be seen in FIG. 7, which stop 67 extends perpendicular to the bearing surface 02 of the second printing forme 37. Stop 67 is preferably rigidly arranged in the chute 44, and is preferably arranged on each of the two longitudinal sides of the second printing forme 37. In the course of opposite movements of the guide rails 64 holding this printing forme 37, directed along the width B of the second printing forme 37, the printing forme 37 remains in a stable position in the plane that is defined by the bearing surface 02 of the printing forme 37, by virtue of the stops 67 that are arranged on both sides. The stops 67 push the printing forme 37 off the guide rails 64, which guide rails 64 are moving away from one another. The printing forme 37 comes into contact with the stops 67 while the vertical support is simultaneously drawn away from the printing forme 37 by virtue of the movement of the guide rails 64. The second printing forme 37 is preferably released via a drive 69, as seen in FIG. 9, which drive 69 can be controlled, for example, from the control console that is a part of the printing press. The drive 69 acts upon the guide rails 64 and moves them along an adjustment path s68, also depicted in FIG. 9.

If a plurality of printing formes 37 are to be arranged on the forme cylinder 33 side by side in its axial direction, and if a plurality of printing formes 37 are to be arranged side by side in the chute 44, in the axial direction of the forme cylinder 33, it is advantageous to arrange the guide rails 64, which act on adjacent second printing formes 37, in two different planes over the support 54 in the printing forme magazine 39 so that these guide rails 64 are offset vertically in relation to one another, as seen in FIG. 8. Planes that are arranged successively in the axial direction of the forme cylinder 33 are preferably arranged alternatingly offset from one another, as is depicted schematically in FIG. 8. With the offset arrangement of the planes that form the first storage position of the printing forms 37, a distance a67 between adjacent printing formes 37, which are arranged side by side in the axial direction of the forme cylinder 33, such as, for example, printing formes 37 which are arranged adjacent to one another, can be kept as short as possible. The measure of the distance a67, which is shown in FIG. 7, preferably corresponds to a distance which printing formes 37 have, when these printing formes 37 are arranged side by side, or are adjacent, on the forme cylinder 33 in its axial direction. From planes that are arranged side by side in the axial direction of the forme cylinder 33, such as, in each case, printing formes 37 that have been moved from a first storage position and placed on the support surface 54, and are therefore in their second storage position, such printing formes 37 can be fed to the forme cylinder 33 via the conveyor device 57 either separately or preferably together simultaneously. The latter procedure is advantageous for a rapid change of printing formes 37 on the forme cylinder 33. Printing formes 37 that have been stored in different planes which are arranged side by side, in the axial direction of the forme cylinder 33, can change to their respective second storage position simultaneously or at least in rapid succession. Printing formes 37 that have been fed together simultaneously to the forme cylinder 33 are arranged side by side on the forme cylinder 33 in its axial direction, In the example which is shown in FIG. 8, four second printing formes 37 are arranged side by side in their respective first storage positions, in the axial-direction of the forme cylinder 33. Each of these four second printing formes 37 is respectively held in a guide rail 64 along its longitudinal sides. In this case, the vertical offset of the printing formes 37, with respect to each other, amounts to only a few millimeters, such as, for example, to 4 mm to 6 mm, and corresponds to approximately the structural height of the guide rails 64, and preferably corresponds to one or two times their structural height. The guide rails 64 are movable longitudinally, in relation to the width B of the second printing forme 37, for example, by virtue of a linear displacement of the guide rails 64. However, this can also be implemented by virtue of a pivoting movement of the guide rails 64. The guide rails 64 are capable of pivoting on a pivoting axis, wherein the pivoting axis extends parallel to the side of the printing forme 37 that is supported by the guide rails 64. For example, a guide rail 64 can be attached, for example, to at least one pivoting arm 68, as depicted schematically in FIG. 9, which pivoting arm 68 is capable of pivoting, for example, in the plane that is defined by the bearing surface 02 of the second printing forme 37, and which is indicated in FIG. 9 by a directional arrow. The pivoting arm 68, one end of which is connected to the guide rail 64, and the other end of which is preferably fixed in place in the chute 44, can be configured, for example, as a spring element 68, such as, for example, as a leaf spring 68, which acts laterally on the guide rail 64. The guide rail 64, which is connected to the pivoting arm 68, can be moved, via the drive mechanism 69, such as, for example, via a controllable, especially a remotely controllable, magnet 69, into an operational position in which it holds the second printing forme 37, or into an operational position in which it is released from this printing form 37. The adjustment path s68, which is traveled by a movable guide rail 64, as it moves longitudinally in relation to the width B of the second printing forme 37, lies within a range of a few millimeters, such as, for example, between 2 mm and 10 mm, and preferably is 4 mm. In this embodiment as well, a stop 67 is preferably provided, and against which stop 67 the printing forme 37 comes into contact with its side that is being supported against the guide rail 64, while the guide rail 64 withdraws its support from the printing forme 37 by being moved.

In this case, two printing formes 37, that are adjacent in the axial direction of the forme cylinder 33, can come into contact with opposite sides of the same stop 67. During a change of position from the upper storage position to the lower storage position, the printing forme 37 can also slide vertically upward with one of its sides against the stop 67, so that the printing forme 37, which has been released from the upper storage position, now reaches the lower storage position in a guided movement. The stop 67 then performs the function of a lateral guide, which extends to the support 54, for a printing forme 37 that is changing its storage position.

Expressed in general terms, a method for storing at least two dressings 01; 36; 37, which have been removed in sequence from the same cylinder 06; 31; 33 of a printing press, includes the following steps. A dressing 01; 36; 37, which has previously been removed from the cylinder 06; 31; 33, is conveyed from a first storage position to a second storage position. The dressing 01; 36; 37, which was removed after the previously removed dressing 01; 36; 37 is stored in the first storage position of the previously removed dressing 01; 36; 37. The previously removed dressing 01; 36; 37, in its second storage position, and the subsequently removed dressing 01; 36; 37, in the first storage position of the previously removed dressing 01; 36; 37, are stored at a distance that is orthogonal along their length L. The dressings 01; 36; 37 are stored with their respective bearing surfaces 02 at least largely overlapping, and preferably overlapping by at least 80%, or overlapping one another completely or nearly completely. The previously removed dressing 01; 36; 37 and the subsequently removed dressing 01; 36; 37 can then be stored, spaced from one another along their length L, either vertically or horizontally from one another. Preferably, the previously removed dressing 01; 36; 37 is conveyed via a linear movement, and especially via a linear movement which connects the two storage positions immediately and directly with one another, orthogonally to its bearing surface 02, or via a movement of its trailing end 04, into its second storage position, which will be described in greater detail in what follows.

It is advantageous, in accordance with the present invention, to provide at least one data acquisition device 71, such as, for example, a code reader 71, which is depicted schematically in FIG. 6 and which reads a code which is preferably flat in configuration and which code is preferably applied to the suspension leg 14 at the trailing end 04 of each printing forme 37. In other words, the code reader 71 detects a characterizing feature which identifies a printing forme, for the purpose of comparing this feature, in a process that is preferably performed electronically in a control unit, with an allocation plan provided for the forme cylinder and stored in the control unit. Such a comparison is done to check whether the printing formes 37 that have been introduced into the chute 44 correspond with the allocation plan for the intended printing process, and/or whether the printing formes 37 that have been introduced into the chute 44 are also present in the correct order for the intended loading. In this way, even before the printing formes 37 are physically mounted on the forme cylinder 33, an appropriate report, such as, for example, an error message, which may be a message that is warning the press operator of an incorrect mounting, can be generated and sent, for example, to a control console that is assigned to the printing group, and can be displayed there or at the printing group. Further details regarding a system for checking the loading of a printing forme magazine 39, in accordance with the present invention, will be discussed in connection with FIG. 43.

The code can preferably be configured, in addition to being one that can be read by humans, as a barcode, for example. A barcode is a generally well-known machine-readable printing that is comprised of bars and spaces of varying widths. The code can be applied by the use of a printing process, such as, for example, by the use of an offset printing process, a flexographic printing process, an intaglio printing process, a laser printing process, a thermographic printing process or an inkjet printing process, to a non-printing area of the printing forme 37, and preferably to at least one of its edges. However, it is particularly advantageous to apply the code to the printing forme 37 in connection with the exposure of the printing surface of the same, because then no additional process step is necessary. In this case, the code is configured and is arranged, for example, on a suspension leg 13; 14 of the printing forme 37, before that suspension leg 13; 14 is angled in a bending process which is accomplished during its preparation for use.

Various types of barcodes exist. Even if barcodes always comprise a flat arrangement of symbols, one-dimensional (1-D code), two-dimensional (2-D code) and three-dimensional (3-D code) barcodes can be differentiated. In the latter, color forms the third dimension. For the most part, barcodes are standardized in terms of their graphic representation and their informational content, for example, in ISO/IEC 15415 (2-D codes), ISO/IEC 15416 (1-D codes), ISO/IEC 15418 (data structures) or ISO/IEC 15420. Known 1-D codes include, for example, the alphanumeric code 39 according to ISO/IEC 16388, the code 128 according to ISO/IEC 15417 or the purely numeric code interleaved 2/5 according to ISO/IEC 16390. A 2-D code, which also encodes information perpendicular to its primary direction, is, for example, a matrix code, such as, for example, a data matrix code, which is defined according to ISO/IEC 16022. Matrix codes can be read omnidirectionally using a camera system, such as, for example, using a CCD camera. A Reed-Solomon error correction doubles the data, so that approximately 25% of the code can be destroyed, without endangering the decoding. Additional matrix codes include, for example, QR-codes and Aztec codes.

Figure 37:
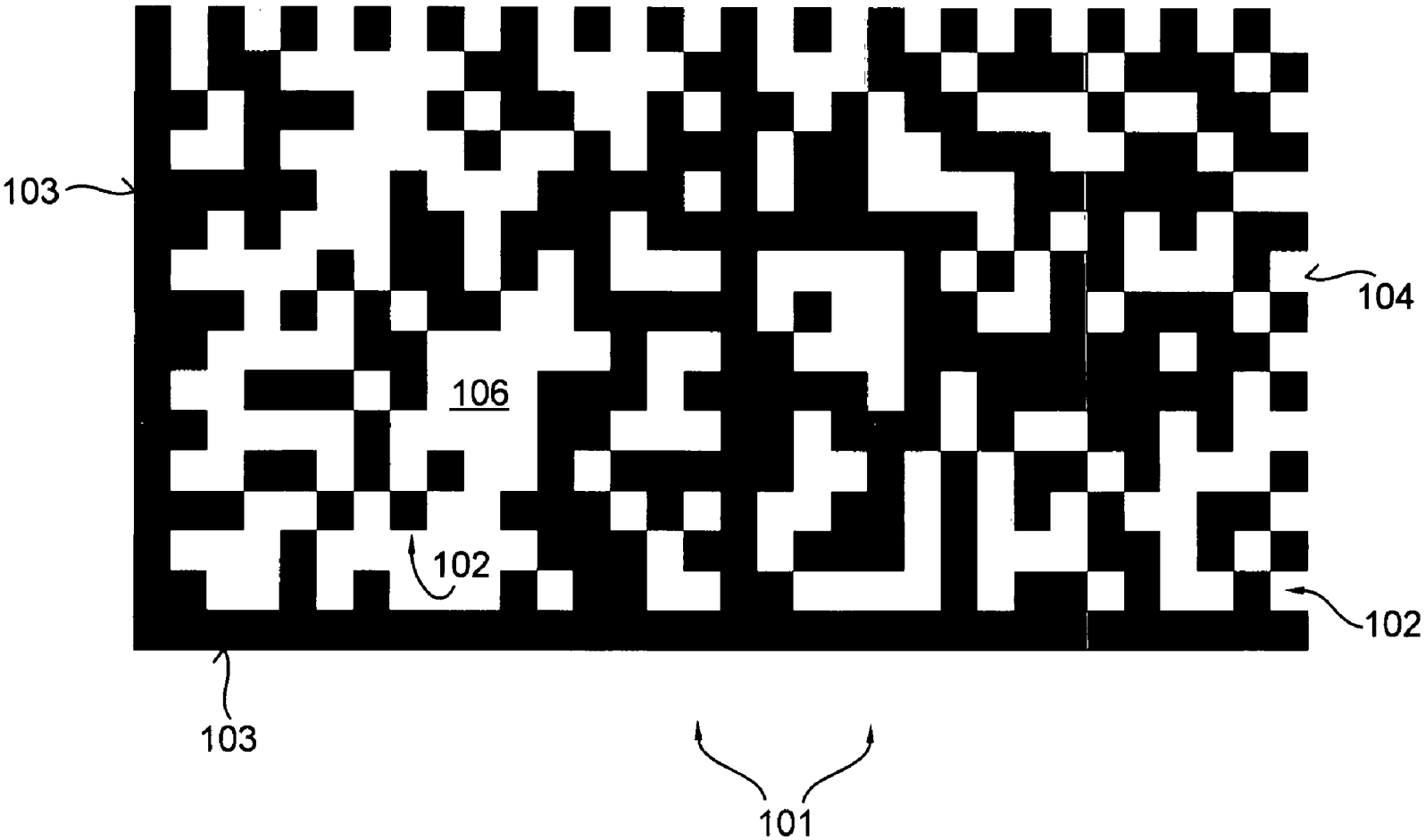
FIG. 37 a data matrix code for use in accordance with the present invention.

The data matrix code exists in various versions, for example, in the data matrix code ECC 200 version, in which the letters ECC stand for the English term "Error Checking and Correction Algorithm" and the number that follows these letters indicates a specific development stage for the data matrix code. The data matrix code consists of a rectangular area, the size of which may vary. This area has square structural elements, each of which has a binary value. They are implemented, for example, in black or white. One example of a data matrix code is represented in FIG. 37, in which two square data matrix code areas 101, each with square structural elements 102, are arranged. For some applications, additional data matrix code areas 101 can be joined together to form the code. The data matrix code areas 101 can be arranged both side by side and under and over one another, for example, in an arrangement consisting of a plurality of lines and columns.

In the case of a 1-D code, in one code plane 101, various bar thicknesses must be clearly identified. With the data matrix code, however, it is necessary only to determine the value of each quadratic structural element 102 represented in the code plane 101, whether it is configured, for example, in black or in white. Furthermore, a data matrix code requires much less space than a 1-D code, with the same informational content. Detecting a 2-D code always requires a camera system, which acquires the information two-dimensionally and evaluates the acquired image, for example, by the use of pattern recognition, such as, for example, by comparing the detected code pattern or marking pattern with a stored expected pattern. Accordingly, the camera system converts the detected structural elements 102 of the 2-D code into electronic, and preferably into digital, usable information. Because a camera system is used, 2-D codes must be illuminated on a flat surface with the use of an illumination device having at least one light source. The light which is reflected from the 2-D code is then imaged on an image plane of an image sensor, such as, for example, a CCD sensor or a CMOS sensor. The image sensor is typically a component of, for example, a line camera or an area camera. In general, the requirements of the data matrix code in terms of color contrast and print quality, are low. The light which is emitted by the light source of the illumination device, and the spectral sensitivity of the image sensor must be adjusted to the optical properties of the printing forme 37 that bears the 2-D code, and especially must be adjusted to its reflectance behavior and to its luminance behavior. For use in detecting a 2-D code, that has been applied to a printing forme 37 via exposure, a laser diode or a light-emitting diode, that emits white, yellow or greenlight, have proven advantageous for use as the light source of the illumination device. The light source can be arranged, for example, integrated into the code reader 71 which also has an image sensor. The embodiment of the code reader 71 with an automatic illumination source, to which parameters can be assigned, is advantageous. The image sensor, and the light source for the illumination device, are both arranged with their respective active directions at an angle of inclination of at least 5° in relation to a vertical line which is oriented on the code area 101, which is respective to the code plane 101, and preferably at an angle of inclination that ranges from 10° to 60°. To protect it against ink mist and other types of contamination, the code reader 71 should be mounted a minimum distance of, for example, 10 mm from the code surface 101, with its image sensor and light source being protected against contamination, such as, for example, by the provision of a pane of mineral glass or of acrylic glass.

The data matrix code shown in FIG. 37 has the following four main components: a fixed boundary line 103 is used for pattern recognition and is used to calculate the rotational position of the data matrix code, so that any reading angle is possible. A boundary line 104, which lies opposite the fixed boundary line 103, and which is also characterized as an unclosed boundary 104, is used to identify the number of lines and columns or in other words, the so-called matrix density. In the case of the ECC 200 data matrix code, the element in the upper right-hand corner is always white. The boundary lines 103; 104 delimit and enclose a memory area 106. The memory area 106 contains the actual binary information in encoded form. The size and/or the number of individual structural elements 102 in the memory area 106 therefore also define the amount of potential information. A blank zone characterized as the idle zone encompasses the data matrix code. It does not contain any information at all, and also is not used for position orientation. The width of the idle zone amounts to one field or one line and is required to delimit other optical image elements.

The memory area 106 of the data matrix code contains, for example, information with which printing formes 37 can be differentiated for the purpose of identifying them, and/or information with which the use of a single, specific printing forme 37 can be tracked. Thus, printing formes 37 that belong to different print images and/or to different color segments always have a code that differentiates them from one another. The code can have an index generated by a counter, for example, for the purpose, for example, of continuously counting through printing formes 37 that have been used or are to be used in sequence, and identifying these printing formes 37, and especially those that are identical and/or that will be used in sequence at the same mounting position of a specific forme cylinder 33, in terms of their respective sequence. Optionally, the code can contain information regarding the respective mounting location of the printing forme 37 in the printing press.

One alternative for configuring the coding in the form of a barcode consists in the use of transponder systems, and especially radio labels, which are referred to using their English acronym, RFID. RFID labels transfer their information in contactless fashion using an electromagnetic field. A further alternative for configuring the code can consist of stamp markings, for example, punched holes.

Figure 38:
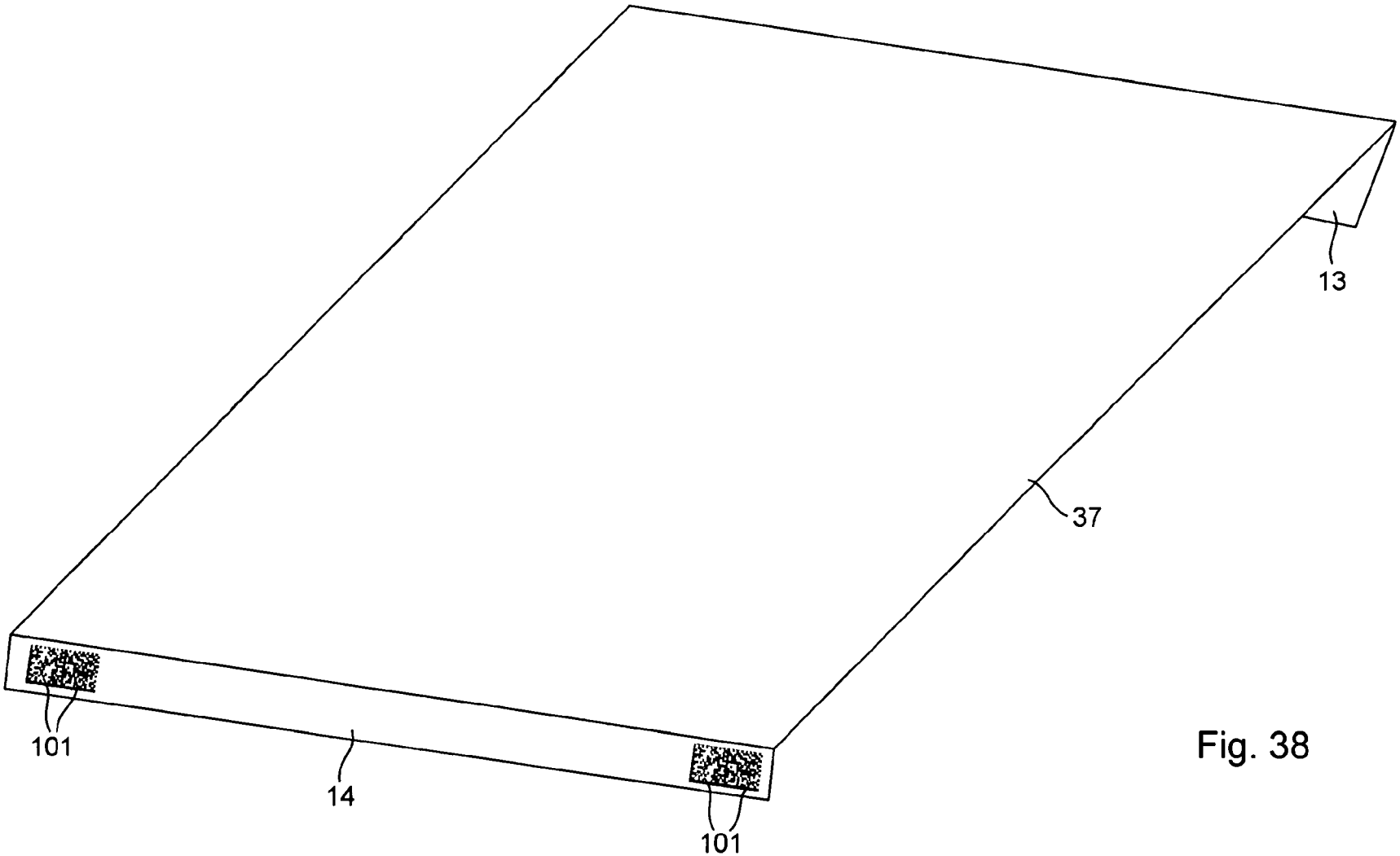
FIG. 38 a depiction of a suitable data matrix code applied to a printing forme.

FIG. 38 shows a printing forme 37 having a trailing suspension leg 14 and on which trailing suspension leg 14 two codes are applied over the width B of the printing form 37, and are spaced from one another. Specifically, for example, two data matrix code areas 101 are arranged in a line along the width B of the printing forme 37, each in a side area of the trailing suspension leg 14. As an alternative, or in addition to this arrangement of codes on the trailing suspension leg 14 of a printing forme 37, and especially in the case of a printing forme 37 in panorama format, a code can also be applied to the center area of the suspension leg 14 of this printing forme 37, as may be seen in FIG. 41. Each data matrix code area 101 can represent only a certain quantity of information. Depending upon the quantity of information to be presented in the code, two or more data matrix code areas 101 may be required, and these are preferably applied to the trailing suspension leg 14 of the printing forme 37.

The code reader 71 can be arranged, for example, in the chute 44, such as, for example, on the pushing element 56 for a first printing forme 37 that is resting on the support 54, or also on the L-shaped bracket 61 for a second printing forme 37, all as is depicted schematically in FIG. 6. The code reader 71 is arranged in or on the chute 44, and preferably on an end of the chute 44 that faces away from the forme cylinder 33. A reading device of the code reader 71 is oriented either parallel to the length L of the printing forme 37 or is preferably oriented parallel to the width B of the printing forme 37. In one embodiment, the code reader 71 is preferably arranged in or on the chute 44 so as to be capable of moving with a linear guide. Alternatively, a movable mirror, which is preferably inclined 450 in relation to the width B of the printing forme 37, is provided, and which deflects a detected signal or a read signal from a code that has been applied to the printing forme 37 to a code reader 71, which code reader 71 is, in this arrangement, arranged on one side of the chute 44. The result is that, in order to read the code that has been applied to the printing formes 37 that are stored in the chutes 44, only a single code reader 71 is needed. By using only a single code reader 71 for use in reading the codes applied to a plurality of stored printing formes 37, considerable cost savings can be realized. When only a single code reader 71 is used, the code reader 71, or the mirror that directs the signals to the code reader, can either be moved parallel to the width B of the printing forme 37, generally in the axial direction of the forme cylinder 33, and preferably along a plurality of chutes 44, and/or can be moved vertically upward along the printing formes 37 that are stacked in one of the chutes 44. The code reader 71 or the mirror thus detects the codes of printing formes 37 that are stored in different storage positions.

Figure 39:
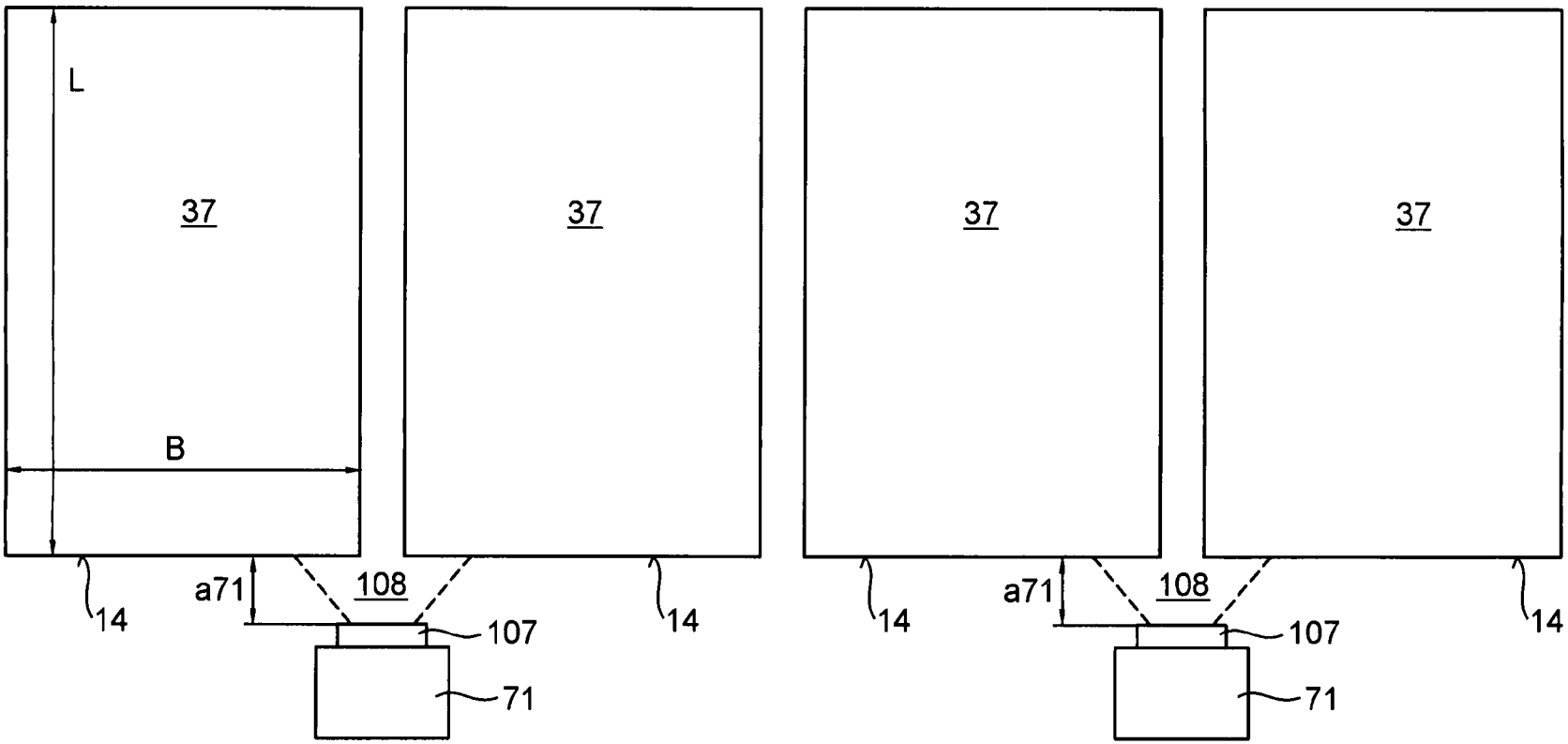
FIG. 39 a top plan view of a plurality of printing formes arranged side by side, with code readers assigned to the plurality of printing formes in pairs.
Figure 40:
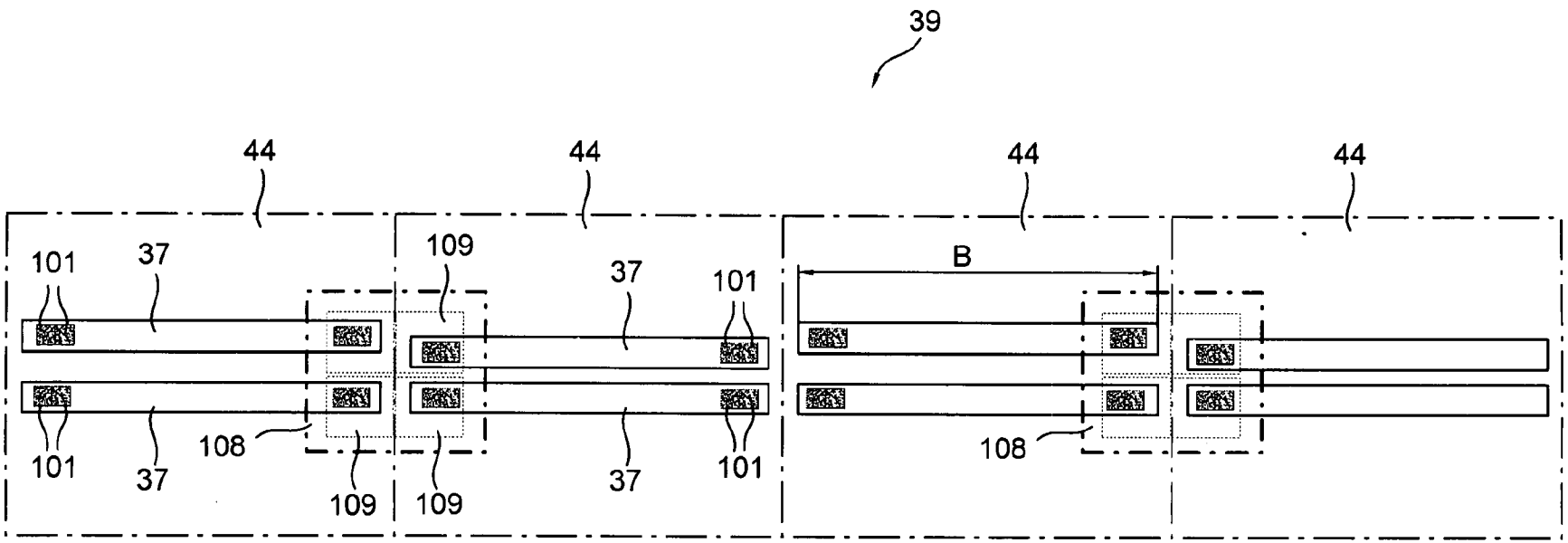
FIGS. 40 and 41 schematic depictions of arrangements of printing formes each having at least one code applied to their respective trailing suspension legs.
Figure 41:
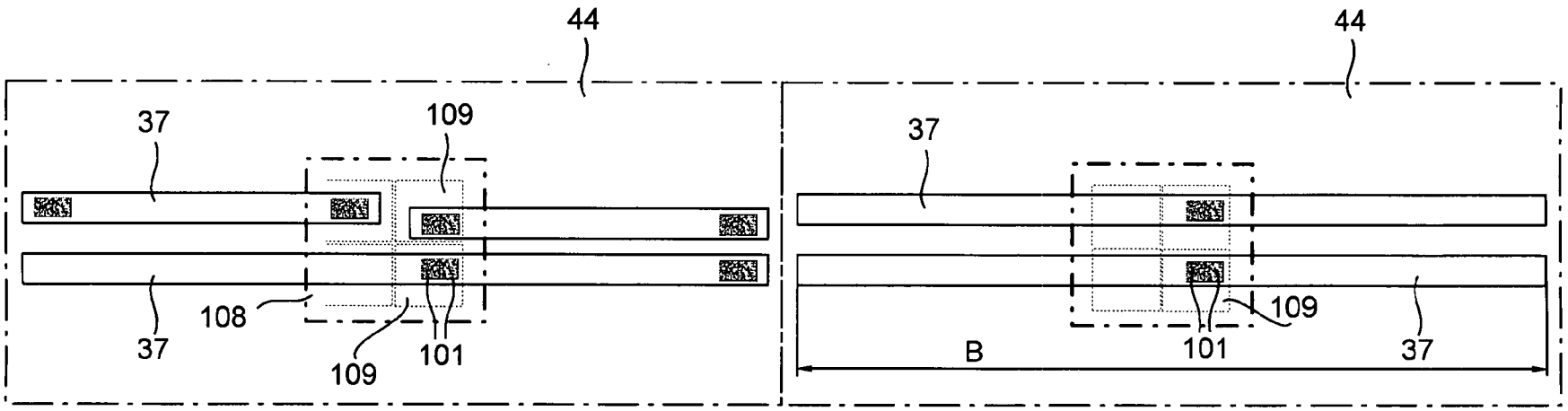

As has previously been described, in the example of printing forme magazines 38; 39 shown in FIG. 8, four printing formes 37 are each arranged in their respective storage positions, side by side in the axial direction of the forme cylinder 33. This arrangement can also be adjusted as needed to a different number of printing formes 37 that are arranged side by side, such as, for example, to only two printing formes 37 or even to six printing formes 37 which can be arranged side by side. FIG. 39 through 41 refer to the example shown in FIG. 8. For example, FIG. 39 shows a schematic, top plan view of an arrangement of, for example, four printing formes 37 which are arranged side by side, with each printing forme 37 having a length L and a width B. In each case, two printing formes 37, which are arranged side by side, are assigned to a shared code reader 71. Each such shared code reader 71 is configured, for example, as a camera system 71 or is incorporated into such a camera system. Each of these camera systems 71 has, for example, a CCD sensor 107 as its image sensor 107. At least two printing formes 37 are preferably arranged in a detection range 108 of each CCD sensor 107. The code reader 71 is thus able to detect all the codes arranged in its detection range 108 simultaneously, in that the image sensor 107 images the codes detected in the detection range 108 of the code reader 71, at the same time and in the same image plane.

In the example shown in FIG. 39, each of the respective CCD sensors 107 is oriented toward the trailing suspension legs 14 of the printing formes 37 which are arranged in the respective detection range 108. The detection range 108 of each CCD sensor 107 can be widened using an optical device, such as, for example, a wide angle lens, and can especially have a preferably obtuse opening angle along the width B of the printing formes 37. This allows each CCD sensor 107 to capture a plurality of codes, and especially to capture the respective codes of a plurality of different printing formes 37, in the same detection range 108, and therefore to detect them simultaneously. The CCD sensor 107 of each of the respective camera systems 71 is arranged at a distance a71 from the trailing suspension leg 14 of the printing formes 37 that are arranged in the respective detection range 108. This distance a71 amounts, for example, to at least 10 mm. The detection range 108 of the image sensor 107 is represented in FIGS. 40 and 41, for example, by a rectangular field which is encompassed by a dotted-dashed line. This field always lies within the same plane as do the data matrix code areas 101 that have been applied to the trailing suspension legs 14 of the printing formes 37, and is also oriented parallel to the respective data matrix code areas 101.

FIGS. 40 and 41 each show arrangements of printing formes 37, wherein at least one code is applied to the trailing suspension leg 14 of each of these printing formes 37. Each such code is configured, for example, in the form of two data matrix code areas 101, which are arranged in a line, longitudinally in relation to the width B of the respective printing forme 37. Each of these code areas is arranged, for example, at a respective side area of its respective printing forme 37, as seen in FIG. 38. FIG. 40 shows, by way of example, four chutes 44 of a printing forme magazine 39 which four chutes 44 are arranged side by side and are assigned to a cylinder 33, which is not specifically shown, to be loaded with printing formes 37 in its axial direction, such as is depicted in FIG. 5). Two printing formes 37 are stored, in each of the respective chutes 44, specifically one printing forme 37 is positioned in each of two storage positions that are arranged one above another. Preferably, on the end surface of each of the chutes 44, which chute end surface is opposite the cylinder 33, a code reader 71 that is configured, for example, as a camera system 71, is arranged. The respective detection zone 108 for each image sensor 107 that belongs to one of the camera systems 71 detects the respective codes of four printing formes 37, which are arranged adjacent to one another, together and at the same time. The codes of two printing formes 37 that are arranged side by side, adjacent to one another, in the axial direction of the cylinder 33 in two different chutes 44, and the codes of two printing formes 37 arranged one above another in the same chute 44 are all detected at the same time by a single code reader 71. The respective detection range 108 for each image sensor 107 that belongs to one of the camera systems 71 can have, for example, an angular, and especially can have a rectangular, and preferably can have a square cross-sectional surface, or, for example, can also have a round, preferably elliptical or circular, cross-sectional surface. All of the codes that are detected in the detection range 108 of the code reader 71 are imaged on the image plane of its image sensor 107. The cross-sectional surface of the detection range 108 of the code reader 71 and the image plane of the image sensor 107 are preferably arranged parallel to one another. In one variation of the present invention, the image plane of the image sensor 107 can be subdivided into a plurality of inspection zones 109, each of which inspection zones 109 can preferably be selectively activated by the respective camera system 71. Each code from one of the respective printing formes 37 that is detected by the detection range 108 is assigned to precisely one of the inspection zones 109 that belong to this detection range 108. Each of these inspection zones 109 thus detects precisely one of the codes detected from the detection range 108, and it also images precisely one of the codes detected from the detection range 108 on the image plane of the image sensor 107. In the arrangement shown in FIG. 40, each of the printing formes 37 is preferably assigned to precisely one of the printing points on the cylinder 33, so that the cylinder 33, in this depicted example, can be loaded with a total of eight printing formes 37, namely four such printing formes 37 in its axial direction and two such printing formes 37 in its circumferential direction. This arrangement can easily be expanded for a 6/2 cylinder 33 by arranging two additional chutes 44 side by side.

In contrast to FIG. 40, FIG. 41 shows two chutes 44 arranged side by side, which two chutes 44 are each configured to receive at least one printing forme 37 in panorama format, or in other words, a printing forme 37 that is of double-width in the axial direction of the cylinder 33, as depicted in FIG. 6. In the example shown in FIG. 41, one printing forme 37 in panorama format is stored in each of two storage positions arranged one above another in the chute 44 on the right. In the chute 44 on the left of this arrangement shown in FIG. 41, a single printing forme 37 in panorama format is stored in the lower storage position, and two single-width printing formes 37 are stored in the upper storage position. The panorama format printing formes 37 stored in this arrangement each have at least one code situated in an area that is near the midpoint of each formes' width B. Each code is embodied, for example, in the form of two data matrix code areas 101 arranged linearly, longitudinally in relation to the width B of the respective printing forme 37. If the code that has been applied to printing formes 37 in panorama format is applied near the center of the width B of these panorama printing formes 37, this code can be detected using the same arrangement of camera systems 71 as was previously described in connection with FIG. 40. An adjustment of these camera systems 71 is then unnecessary. These camera systems 71 can therefore advantageously be permanently installed, together with the chutes 44 for the printing forme magazine 39. As is represented in FIGS. 40 and 41, the positioning of the code on the trailing suspension leg 14 of the respective printing forme 37 of single or double width B serves to ensure that the code is always located within the detection zone 108 of the camera systems 71. Each of the detection zones 108 is subdivided, for example, into several, such as, for example, into four inspection zones 109. Each of the inspection zones 109 covers, for example, one quadrant of the respective detection zone 108. Precisely one code on one of the printing formes 37 can be detected with each of the inspection zones 109. The images of the codes recorded in the respective inspection zones 109 can therefore be read out, for example, sequentially.

Figure 42:
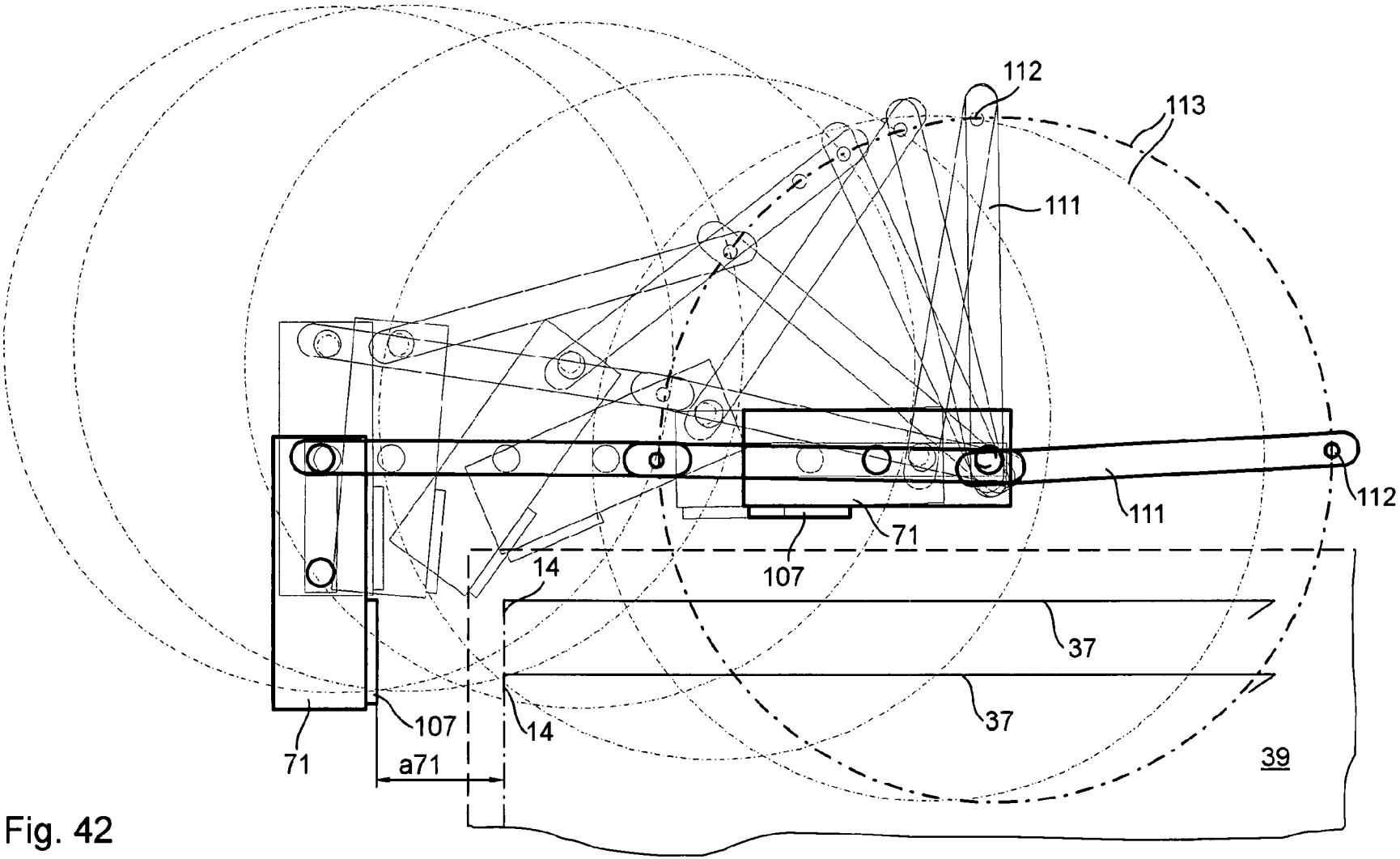
FIG. 42 a schematic depiction of a device for use in moving a code reader from its position of rest to its working position, and vice versa.

FIG. 42 shows a device for moving a code reader 71 from a horizontal position of rest to a vertical working position. The terms "horizontal" and "vertical" refer to the position of the cross-sectional surface of the detection zone 108 of the code reader 71. In a position of rest, the cross-sectional surface of the detection zone 108 of the code reader 71 is preferably located substantially perpendicular to the code plane 101 of the code applied to a printing forme 37. In a working position, the cross-sectional surface of the detection zone 108 of the code reader 71 is preferably arranged substantially parallel to the code plane 101 of the code to be detected, and which is applied to the printing forme 37. The image plane of the image sensor 107 of the code reader 71 is preferably also arranged either horizontally or vertically. Only in its substantially vertical arrangement, as depicted at the left of FIG. 42, is the image sensor 107 in a position to image the respective code to be detected on its image plane.

The device shown in FIG. 42 has two defined end positions for the code reader 71, and between which two defined end positions the code reader 71 moves. One or two opposite sides or ends of the code reader 71, with each of these sides or ends extending longitudinally in relation to the length L of at least one printing forme 37 stored in a printing forme magazine 39, are mounted, for example, on a set of rods 111. These rods 111 can be articulated, for example, via the provision of at least one joint 112, and which rods 111 are thus subdivided. In FIG. 42, characteristic curves 113 indicate the path of motion traveled by the code reader 71, and by its set of rods 111, as the code reader 71 is being moved from its horizontal position of rest to its vertical working position, or back in the opposite direction. The code reader 71 is preferably arranged in such a way that, in its position of rest, the image plane of its image sensor 107 is oriented with its optically active side pointing downward, in the direction of the force of gravity, so that dust and dirt will not collect on the image sensor 107. When the code reader 71 is in its working position, again as depicted at the left side of FIG. 42, its image sensor 107 is oriented toward a trailing suspension leg 14 of at least one printing forme 37. The code reader 71 is preferably moved from its horizontal position of rest to its vertical working position, and is also preferably moved in the opposite direction, via a manual displacement or through the use of a preferably remotely controllable drive which is not specifically shown. Such a remotely controllable drive can be actuated, for example, either electrically or pneumatically. The ability of the code reader 71 to move or to pivot is advantageous to the extent that it serves to improve the accessibility to the chutes 44 of the printing forme magazine 39 at each chute's end surface that is positioned farther away from the cylinder 33. The device shown in FIG. 42 for moving the code reader 71, from its horizontal position of rest to its vertical working position, is attached in a highly compact form, for example, above the printing forme magazine 39 that has the chutes 44. Connection and supply cables required to operate the code reader 71 are not specifically shown, in the interest of preserving clarity.

Figure 43:
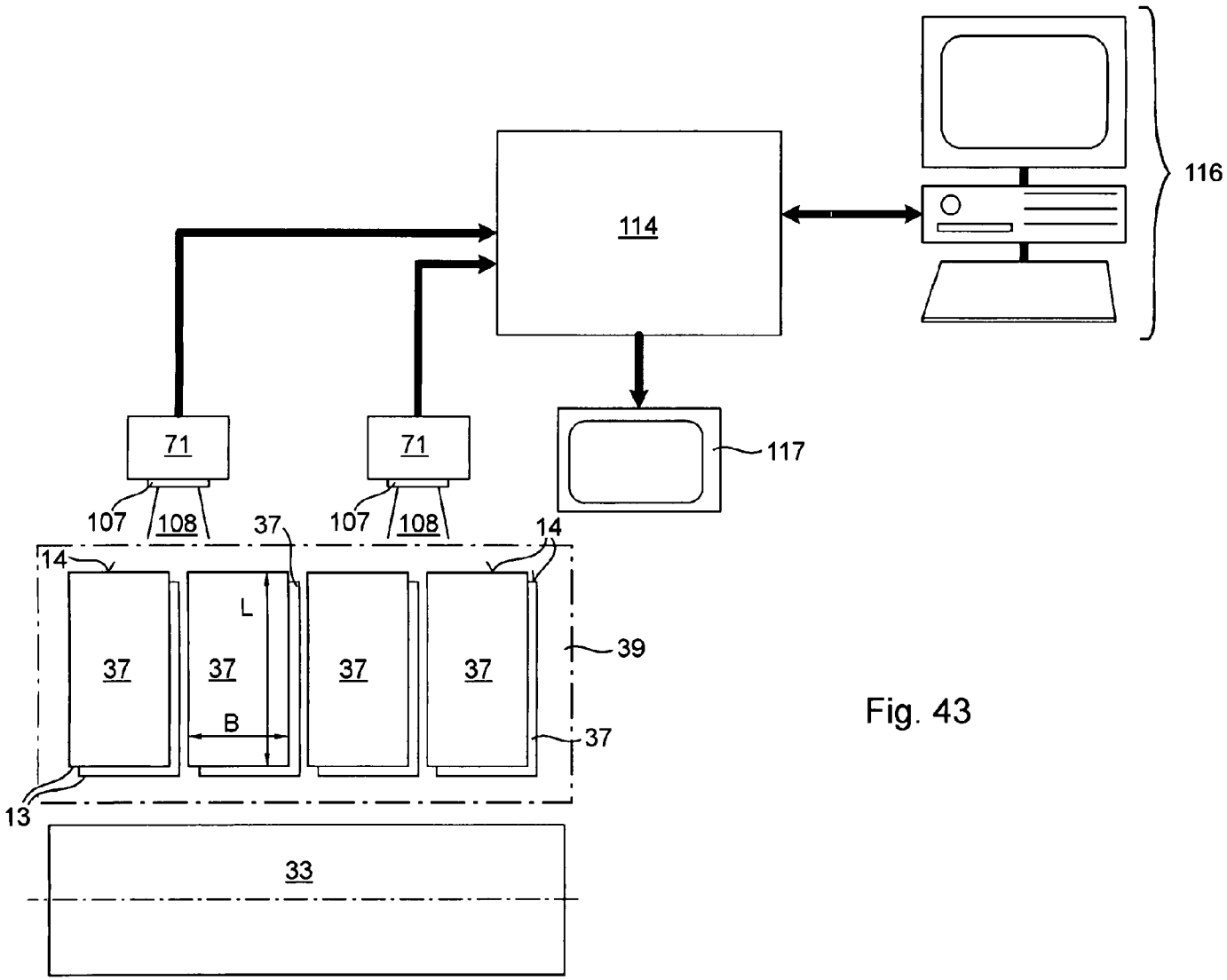
FIG. 43 a system for checking the loading of a printing forme magazine.

FIG. 43 shows a simplified block diagram of a system for checking the loading of a printing forme magazine 39. This checking is preferably implemented prior to a change of the printing formes 37 on a cylinder 33 of a printing press. In the example shown in FIG. 43, four printing formes 37 are stored in chutes 44 of the printing forme magazine 39, side by side in the axial direction of a cylinder 33 of a printing group of the printing press. In the printing forme magazine 39, for example, two printing formes 37 can be stored vertically one above another in the chutes 44. The circumferential surface of the cylinder 33 can thus be loaded with a total of eight printing formes 37. The printing formes 37, which are stored in the printing forme magazine 39, each have at least one code on their trailing suspension leg 14. Each of these codes is configured, for example, in the form of two data matrix code areas 101, arranged linearly, longitudinally in relation to the width B of the respective printing forme 37, as depicted in FIG. 38. On the side of the printing forme magazine 39 that is farther from the cylinder 33, two code readers 71 are installed. Each of these two code readers 71 detects, in its respective working position, and with the detection zone 108 of its respective image sensor 107, the codes of at least two printing formes 37 that are arranged side by side in the printing forme magazine 39. The respective codes of two of the printing formes 37, which are stored vertically one above another, can also fall within the same detection zone 108 of one of these image sensors 107, as depicted in FIG. 40 or in 41. Images of the codes that are each arranged in respective ones of the detection zones 108, and which images are preferably recorded separately and in sequence, are converted by the respective code reader 71 into electronic, preferably digital, image data, and these image data are then supplied to an evaluation unit 114. The code readers 71 are connected to the evaluation unit 114, for example, via a cable or via a wireless transmission link. This data connection and its data flow are each indicated in FIG. 43 by an arrow. The evaluation unit 114 can also be embodied as a component of a more complex camera system, comprising, for example, at least one of the code readers 71. The evaluation unit 114 can be assigned to a single camera system or can be assigned to a plurality of camera systems which are arranged in the printing press. The evaluation unit 114 can, for example, be integrated into a printing tower control system for the printing press.

In the evaluation unit 114, electronic data processing procedures are used to evaluate the image data acquired from the individual printing formes 37, with this data corresponding to the respective codes, by linking these data with data made available to the evaluation unit 114 from a production planning system 116, in order to determine whether the printing forme magazine 39 is loaded with the correct printing formes 37 for a planned production job. This inspection is used to determine whether the printing forme 37 that is required for the planned production job is stored in the respective chute 44 of the printing forme magazine 39. The production planning system 116 is represented abstractly in FIG. 43 as a PC system, comprising a control unit, a display device and an input unit, such as, for example, a keyboard. However, the production planning system 116 can also be embodied in, or at least can be included with a control console that is a part of the printing press, and can thereby be integrated into the machine control system. The control console is provided a data link, such as, for example, within an EDP system of the printing plant that operates the printing press. Because the data exchange between the evaluation unit 114 of the camera system and the production planning system 116 is bidirectional, the cable connection that exists between them is indicated by a double arrow.

The evaluation unit 114 is connected to a signaling device 117, via which signaling device 117 the evaluation unit 114 indicates at least a detected discrepancy between the identified, actually stored printing forme 37 and a printing forme 37 that is required at this location for the planned production job, and/or issues a suitable message that can be perceived by the printing press operator. The signaling device 117 can comprise a visual and/or an acoustic display. It can also be configured, for example, in the form of traffic light-type displays, which may be embodied, for example, as light-emitting diodes, and which displays are assigned to the individual chutes 44 of the printing forme magazine 39. A green signal, for example, indicates that a comparison of the detected code on a stored printing forme 37 with the data from the production planning system 116, preferably performed in the evaluation unit 114, has revealed no inconsistencies. A red signal indicates such an inconsistency. In the event of a incorrect placement of the printing formes 37 stored in the chutes 44 of the printing forme magazine 39, which is one of the most common errors that occur in the practical loading of a printing forme magazine 39 with printing formes 37, and wherein such an incorrect placement may involve either storage positions arranged horizontally side by side, or storage positions arranged vertically, one above another, the display of the signaling device 117 is also able to display the correct storage position in the printing forme magazine 39 for the respectively inspected printing forme 37. If more than merely an incorrect placement of printing formes 37, with respect to their storage positions in the printing forme magazine 39, has occurred, and a storage position has instead been loaded with an incorrect printing forme 37 that is not required for the planned production process, the display of the signaling unit 117 can also indicate this error. If the code on a printing forme 37 is unreadable, the display of the signaling unit 117 can further indicate that a reading error has occurred. It can also indicate at which of the storage positions of the printing forme magazine 39 the reading error has occurred. Therefore, the signaling unit 117 can be capable of reporting various types of errors. Should a certain error report be consciously allowed, a notice confirming knowledge of this displayed error can be provided by the printing press operator. All of the above-described reports from the signaling unit 117 contribute to increasing process dependability in the operation of the printing press. They alert printing press operators to any errors, and especially to errors in the loading of a printing forme magazine 39 with printing formes 37 and/or in the supplying of at least one of the printing formes 37 stored in the printing forme magazine 39 to a cylinder 33. These reports thereby assist the press operators in avoiding such errors or at least in correcting them promptly and prior to the start of production.

Figure 44:
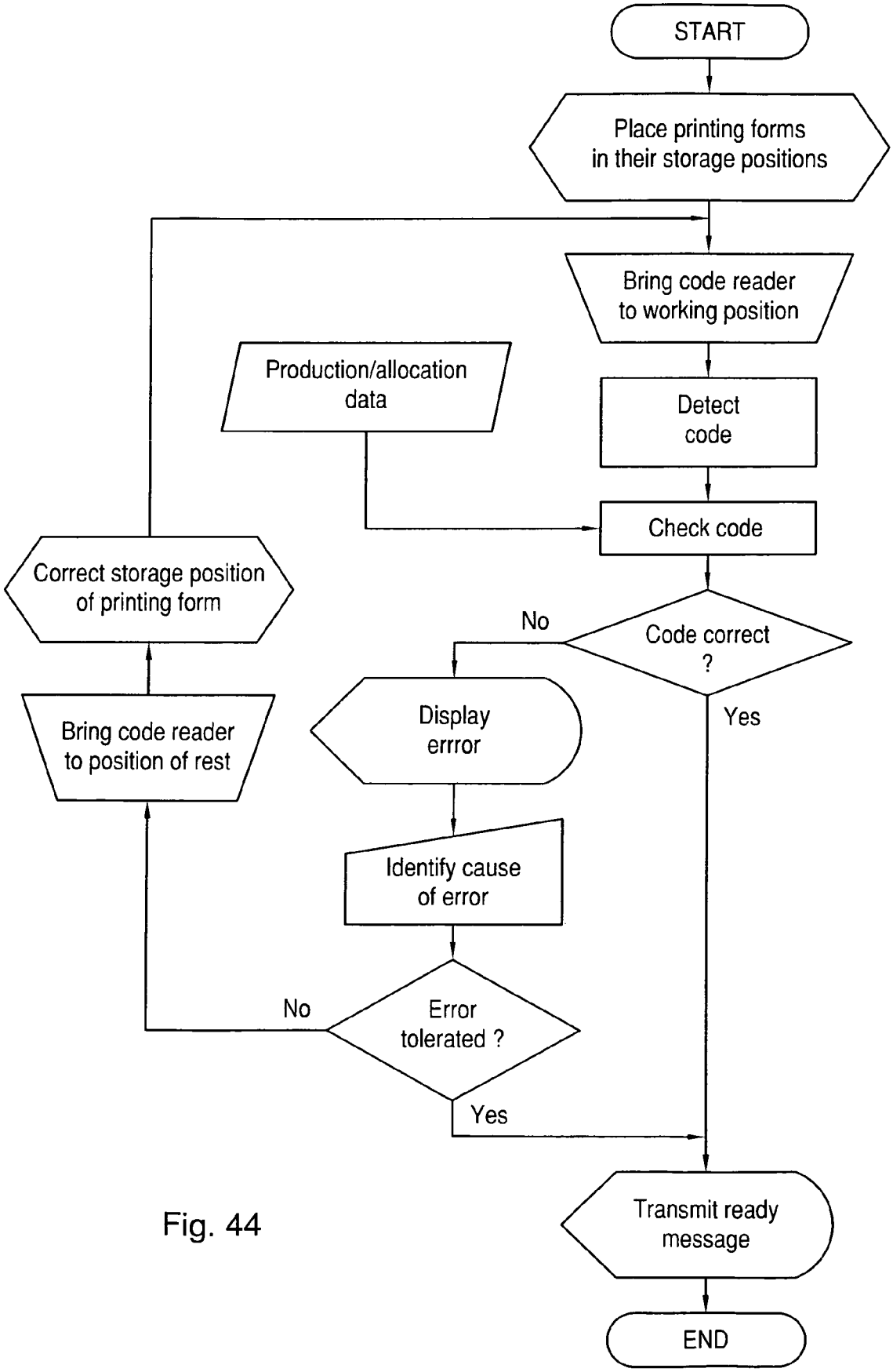
FIG. 44 a flow chart illustrating a process control of the system for checking the loading of a printing forme magazine in accordance with the present invention.

The process control for the system for checking the loading of a printing forme magazine, the details of which have been described in connection with FIG. 37 through 43, is represented in FIG. 44. The individual process steps and their respective dependence upon the fulfillment of certain prerequisites may be taken directly from the flow diagram.

Either the code reader 71 or at least one additional sensor 91, as seen in FIG. 6, can be used to monitor and/or to check whether an intended printing forme change has been successfully implemented. Errors, such as a double loading or an incorrect loading, such as, for example, the mounting of a printing forme 37 at an incorrect location, can then be prevented, or at least can be identified through a report, which preferably is issued at the control console for the printing press, before significant damage has occurred. It is also advantageous to record, in the evaluation unit 114 of the camera system that is assigned to the code reader 71, or in a recording device that is integrated, for example, into the control console, which supply and/or removal movements have already been executed in which chutes 42; 44 of the printing forme magazine 38; 39. From this recording of the supply and/or removal movements of printing formes 36; 37, it can also be concluded whether or not the printing point on the cylinder 31; 33, to which a printing forme 36; 37 is to be supplied, is even free for the mounting of a new printing forme 36; 37. Thus, it is advantageously provided that the evaluation unit 114, which is connected to the code reader 71, and/or another recording device records at least the supplying of each printing forme 37 that is stored in the printing forme magazine 39 to the cylinder 33. From the recording of at least a certain number of printing formes 37 that have already been supplied to a specific printing point on the cylinder 33, the evaluation unit 114 or the other recording device is able to derive information with regard to whether the printing point on the cylinder 33, to which the printing forme 37 that is currently stored in the printing forme magazine 39 is to be supplied, is free for the mounting of that specific printing forme 37. The recording process includes the detection of a specific event, which is preferably accomplished using a sensor, such as, for example, by using the code reader 71, with such an event involving, for example, the detection of the supplying of a specific printing forme 37, that has been stored in the printing magazine 39, to the cylinder 33. The process also includes an automatic, and preferably an electronic recording by respective memory units, of information that corresponds with the detected event. This information can be retrieved for further evaluation from the memory unit that holds it.

If the evaluation unit 114 or the other recording unit has information from a production planning system 116 at its disposal, the evaluation unit 114 and/or the other recording unit can display a mix-up in the printing formes 37, which are stored in storage positions of the printing forme magazine 39, following a comparison of the code detected on the stored printing forme 37 with the information from the production planning system 116. The evaluation unit 114, or the other recording unit, can also use its respective signaling unit 117 to display the correct storage position for a printing forme 37 that has been stored in an incorrect storage position in the printing forme magazine 39. The signaling unit 117 can also be used to indicate a printing forme 37 that has been incorrectly stored in a storage position of the printing forme magazine 39, and/or to indicate a printing forme 37 having an unreadable code and that has been stored in a storage position of the printing forme magazine 39.

In FIG. 6, a further, lower chute 42 is shown, which lower chute 42 serves to receive printing formes 37 that have been removed from the forme cylinder 33. This lower chute 42 has, for example, an inclined support 72, which, like the support 54 in the upper chute 44, is preferably configured not as a solid surface, but in the form of parallel strips 72 or sliding rails 72 for making available the printing formes 37 to be mounted on the forme cylinder 33. The inclination or declination of the support 72 widens the chute 42, preferably in the direction of the side of chute 42 that faces away from the forme cylinder 33. This chute 42 is thus more easily accessible to press operators on the side of chute 42 that faces away from the forme cylinder 33. This widening facilitates the removal of printing formes 37 that have been placed in the chute 42. The support 72 in the chute 42 is to be inclined, for example, in relation to a horizontal H, by an angle of inclination 5, wherein the angle of inclination 6 can measure, for example, between 5° and 15°, and preferably is approximately 7°. In the example shown in FIG. 6, the lower chute 42, which is intended for receiving printing formes 37 that have been removed from the forme cylinder 33, is located below an upper chute 44 which is intended to provide printing formes 37 to be mounted on the forme cylinder 33. This is a preferred, but not an imperative, arrangement of chutes 42 and 44. The chutes 42; 44 can also be arranged layered in reverse sequence, or can be arranged separated from one another.

One preferred embodiment of the chute 42 provides that at least two printing formes 37 can be stored side by side in the chute 42 in the axial direction of the forme cylinder 33. This embodiment enables a particularly rapid removal of printing formes 37, especially if at least two such printing formes 37 can be arranged on the forme cylinder 33 in its axial direction. This is because a plurality of printing formes 37 can now be removed from the forme cylinder 33 simultaneously. If, for example, at least four printing formes 37 can be arranged on the forme cylinder 33 in its axial direction, it is advantageous for reasons of stability, for example, to arrange two of the chutes 42 side by side in the axial direction of the forme cylinder 33. Each storage space in one of these chutes 42, which is defined by the width B of a printing forme 37, is then configured such that at least the same number of printing formes 37 can be stored there as the number of printing formes 37 that can be arranged along the circumference of the forme cylinder 33. The printing formes 37 are stored in a stack, one on top of another, in each storage space. It can be provided that preferably as many as ten printing formes 37, but at least as many as eight such printing formes 37, can be stored in each of the chutes 42. The printing formes 37, that have been removed from the forme cylinder 33, can be collected in the chutes 42, and the chutes 42 need not necessarily be emptied by the press operator following each change of printing formes 37. Regardless of the number of chutes 42 that are arranged side by side, the storage spaces have the same close spacing from one another in the axial direction of the forme cylinder 33, as do the printing formes 37 which are arranged on the forme cylinder 33.

On its side that faces the forme cylinder 33, the chute 42, adapted for use in receiving printing formes 37, which have been removed from the forme cylinder 33, has a guide element 73, which is arranged close to the circumferential surface 07 of the cylinder 33, at least in its operational state in which it is engaged against the forme cylinder 33. The guide element 73 is configured, for example, in the form of a guide plate 73, a wedge 73 or a roller element 73, such as, for example, as a roller 73, and has the task of guiding the trailing end 04 of a printing forme 37, that is to be removed from the forme cylinder 33, into the lower chute 42. A distance a73 between the guide element 73 and the circumferential surface 07 of the forme cylinder 33 is preferably not much greater than the length l14 of the angled suspension leg 14 at the trailing end 04 of the printing forme 37. In particular, the distance a73 of the guide element 73 has a value that is between one and two times the length l14 of the trailing suspension leg 14, as depicted in FIG. 1. Because a printing forme 37 that is to be removed from the forme cylinder 33 comes into contact, on its printed image side, with the guide element 73, its contact with a rotatably mounted roller element 73 is gentler on its surface than sliding over a flat, rigid wedge 73 would be. This consideration for the structure of the guide element 73 is especially important when the printing forme 37 will be used again, and for this reason any damage to its printed image side, resulting from scratching or flatting marks, must be avoided. A sensor 91 may be attached to the guide element 73, which sensor 91 checks, either by contact with the printing forme 37 to be removed from the forme cylinder 33 or, preferably, in a contactless fashion, such as, for example, inductively, whether the suspension leg 14 at the trailing end 04 of the printing forme 37 to be removed from the forme cylinder 33 has actually been released after an actuation of the holding element 21 that is located in the groove 08 of the forme cylinder 33. With its inspection, the sensor 91 sends a signal, for example, to the control console that is a part of the printing press. On the basis of the signal sent by the sensor 91, a decision is made as to whether the process of removing a printing forme 37 to be removed from the forme cylinder 33 can be continued, or whether measures to correct a defect in the removal must be initiated. A plurality of sensors 91, such as, for example, four or six such sensors 91, are preferably provided on the guide element 73, in the axial direction of the forme cylinder 33. At least one sensor 91 is preferably provided for each printing forme 37 that can be arranged side by side, in the axial direction of the forme cylinder 33.

Figure 14:
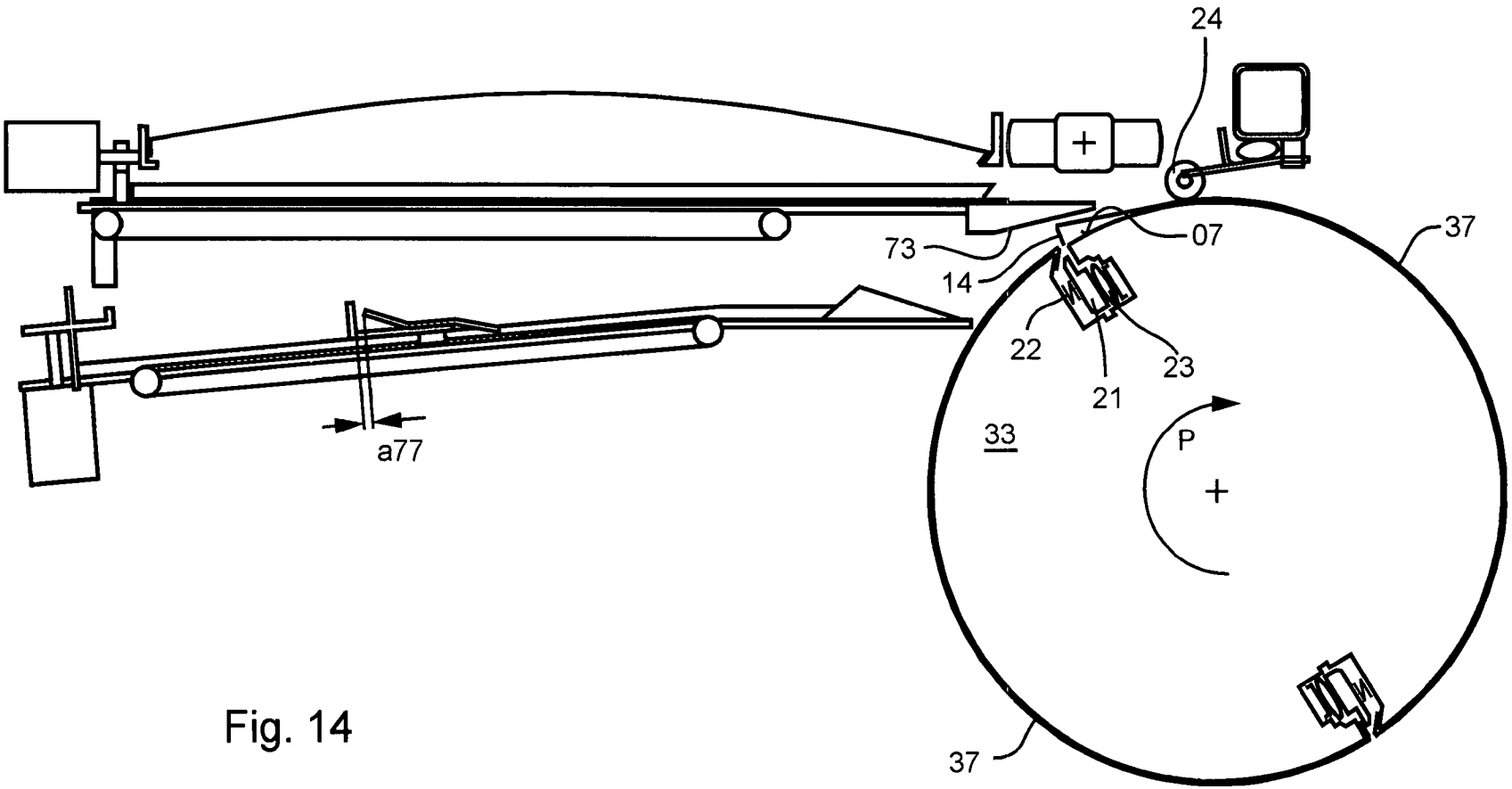

In one preferred embodiment of the present invention, after passing the guide element 73, the suspension leg 14 at the trailing end 04 of the printing forme 37 that is to be removed from the forme cylinder 33, is preferably placed on a first ramp 74, which first ramp 74 is arranged spaced from the guide element 73, before it reaches the support 72 in the chute 42. The first ramp 74 initially rises in the direction of the support 72, and, after reaching a peak point 76, descends again toward the support 72. The first ramp 74 is preferably rigidly connected to the support 72. In the continuation of the introduction of the printing forme 37 to be removed from the forme cylinder 33 into the chute 42, the suspension leg 14 on the trailing end 04 of the printing forme 37 arrives at a second ramp 77, a trailing edge of which preferably drops off abruptly at a steep incline to the support 72 after reaching its peak point 78. That trailing edge is located on second ramp 77, as can be seen in FIG. 6, on the side of second ramp 77 that faces away from the forme cylinder 33. In the direction in which the printing forme 37 is introduced into the lower chute 42, at a slight distance a77, as seen in FIG. 14, and behind the peak point 78 of the second ramp 77, a stop 79, which is rigidly connected to the second ramp 77, is arranged, and against which stop 79 the suspension leg 14 at the trailing end 04 of the printing forme 37 strikes. In this case, the distance a77 has a value of a few millimeters, and preferably has a value of less than the length l14, and especially has a value of less than half the length l14 of the angled suspension leg 14 at the trailing end 04 of the printing forme 37. When the suspension leg 14 at the trailing end 04 of the printing forme 37 comes into contact with the stop 79, it preferably engages behind the second ramp 77, in which the suspension leg 14 engages in the intermediate space formed by the distance a77. The second ramp 77, and the stop 79 which is connected to it, can be moved linearly and parallel to the support 72 by the use of a conveyor mechanism 81, in order to convey the printing forme 37 to be removed from the forme cylinder 33 all the way into the chute 42. The conveyor mechanism 81, which, particularly together with the steeply sloped end of the second ramp 77 for the angled suspension leg 14 at the trailing end 04 of the printing forme 37, forms a carrier system for conveying the printing forme 37 into the chute 42, is configured, for example, as a belt drive 81 or as a linear drive 81, and preferably is configured as a pneumatic linear drive 81, and especially as a double-sided linear drive 81 without a piston rod. Both the first ramp 74 and the second ramp 77 consist, for example, not of full-surface planes, but of a plurality of parallel guide rails which may be arranged like the teeth of a comb. The second ramp 77 can be formed, for example, from one or more appropriately curved metal strips.

A lifter 82, and particularly a printing forme lifter 82, is positioned in the side of the chute 42 that faces away from the forme cylinder 33, as seen in FIG. 6. The printing forme lifter 82 has, for example, a piston 83, which is preferably movable perpendicular to the support 72, and which is provided with a lifting arm 84, which lifting arm 84 is, for example, L-shaped, and especially is U-shaped, in configuration, with this lifting arm 84 being arranged at the end of the piston 83. The, wherein the angled suspension leg 14 at the trailing end 04 of the printing forme 37 is placed on or is set around the lifting arm 84. The printing forme lifter 82 preferably has two stable operating positions. A first stable operating position is one in which the piston 83 is retracted, and in which the lifting arm 84 is located below the level defined by the support 72. A second stable operating position is one in which the piston 83 is extended, and in which the lifting arm 84 raises the printing forme 37, that has been removed from the forme cylinder 33, off of the support 72. In this process, the printing forme lifter 82 executes a lifting stroke s82, which, as seen in FIG. 6, is greater than the length l14 of the angled suspension leg 14 at the trailing end 04 of the printing forme 37. The value of the lifting stroke s82 is preferably between one and two times the length l14 of the suspension leg 14. Thus, the printing forme lifter 82 raises a printing forme 37, that has been removed from the forme cylinder 33, from a preliminary first storage position to a final second storage position.

A securing element 86 in, for example, the form of a strip-shaped flap 86, which is preferably capable of pivoting around a pivoting axis that extends substantially parallel to the width B of the printing forme 37, is arranged above the printing forme lifter 82, and especially above its lifting arm 84, with its lower edge being spaced at a distance a86 from the lifting arm 84. The distance a86 is preferably shorter than the length l14 of the angled suspension leg 14 at the trailing end 04 of the printing forme 37. In FIG. 6, a directional arrow indicates the pivoting capability of the securing element 86. The securing element 86 prevents a printing forme 37, that has been raised by the printing forme lifter 82, from unintentionally sliding into the chute 42, or from being removed from the chute 42. A press operator must first pivot the securing element 86, before the raised printing forme 37 can be removed from the chute 42.

Figure 10:
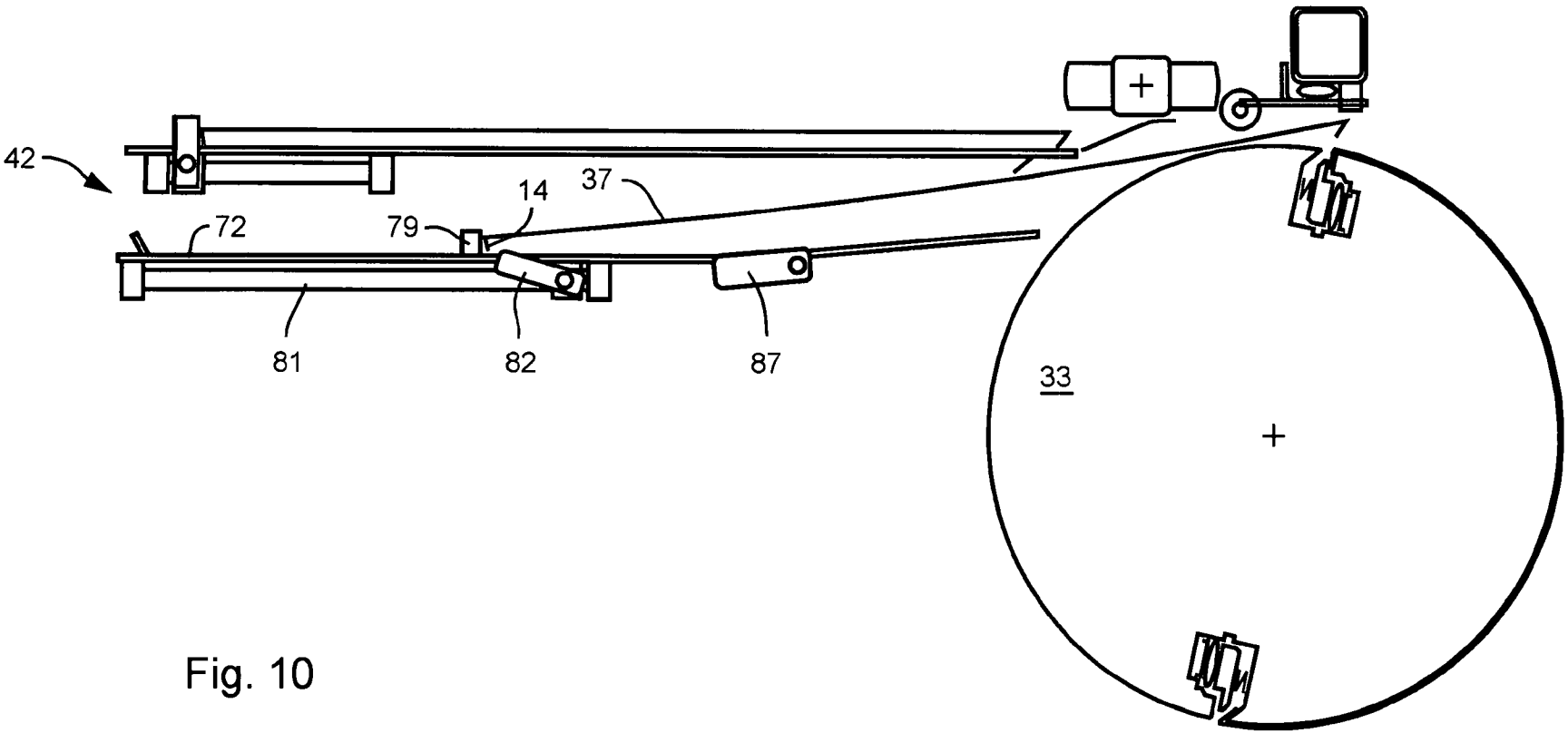
FIG. 10 through 12 a further preferred embodiment of a configuration of a lower chute of a device for changing a dressing.
Figure 11:
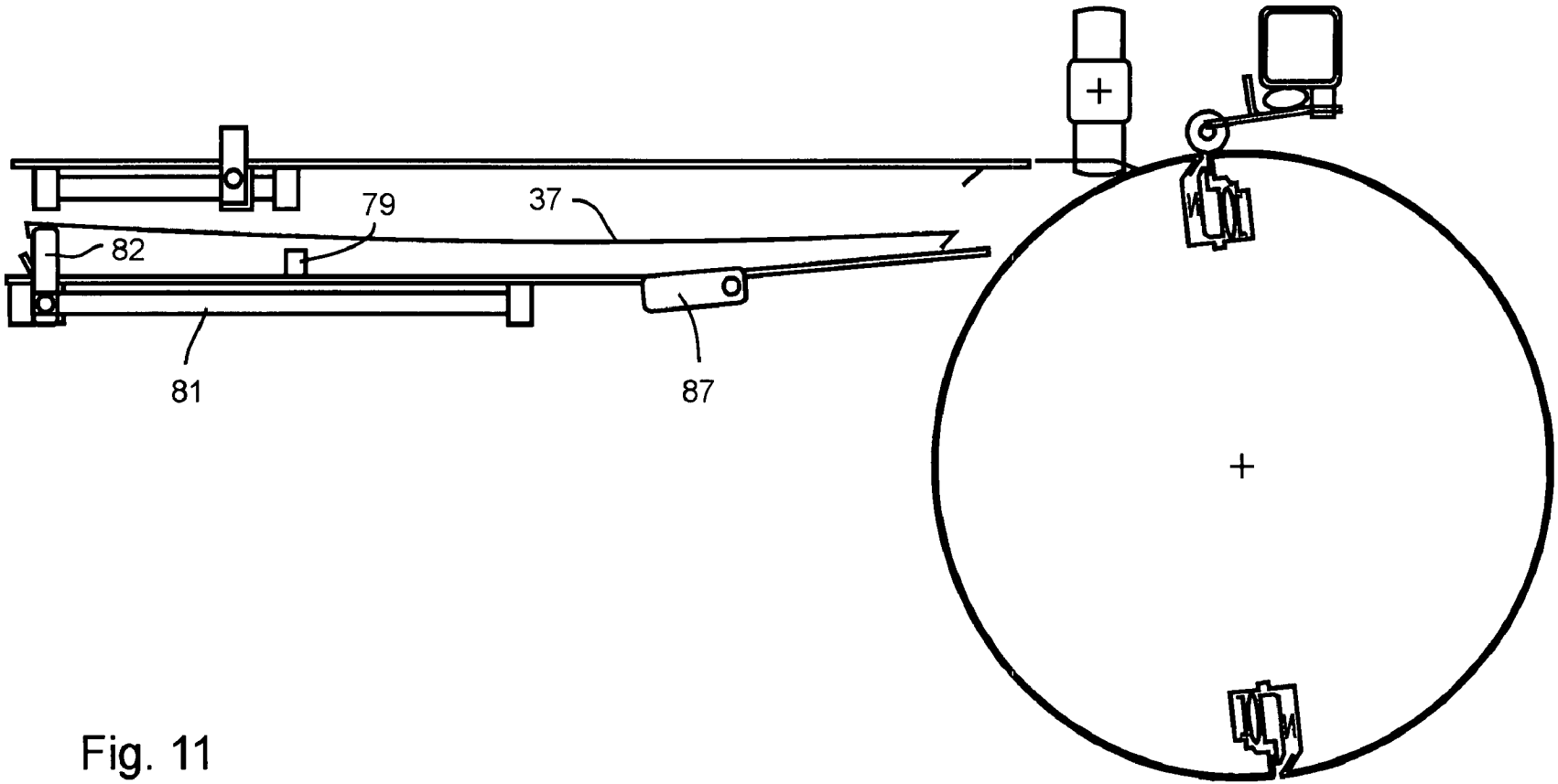
Figure 12:
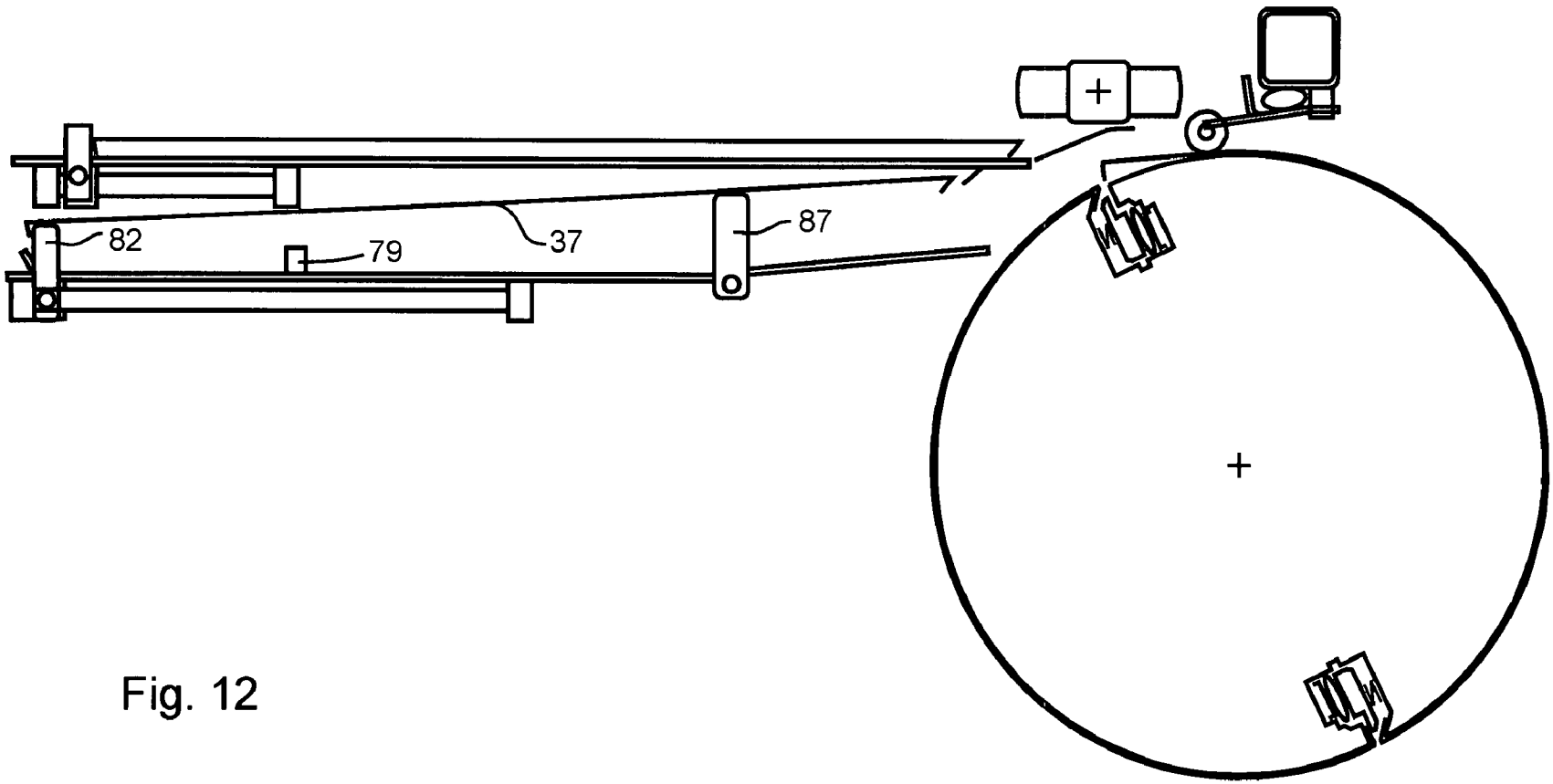

A further preferred embodiment of the components arranged in the chute 42 is shown in FIG. 10 through 12. This preferred embodiment provides for a stop 79, which is preferably rigidly arranged in the center area of the support 72. A printing forme lifter 82, which is connected to a conveyor mechanism 81 that can move linearly along the support 72, lifts the angled suspension leg 14 at the trailing end 04 of a printing forme 37 to be removed from the forme cylinder 33 over the stop 79. Printing forme lifter 82 and conveyor 81 preferably draws the printing forme 37, at its angled suspension leg 14, and in its position in which it has been raised by the printing forme lifter 82, up to the end of the lower chute 42 that faces away from the forme cylinder 33. The conveyor mechanism 81 and the printing forme lifter 82 can be forcibly connected in such a way that the printing forme lifter 82 raises the angled rear suspension leg 14 of the printing forme 37 as soon as the conveyor mechanism 81 executes a movement in the direction facing away from the forme cylinder 33. Furthermore, between the stop 79 and the end of the lower chute 42 that faces the forme cylinder 33, a further printing forme lifter 87 is provided. This further printing forme lifter 87 raises the leading end 03 of a printing forme 37, that has been removed from the forme cylinder 33 and that has been introduced into the chute 42, far enough that another printing forme 37 to also be removed from the forme cylinder 33 can also be introduced into the chute 42 between the support 72 and the raised printing forme 37.

With reference now to FIG. 13 through 35, methods for changing printing formes 37 on a forme cylinder 33 will now be described in detail. It is assumed, in the following discussion, that two printing formes 37 are arranged in the upper chute 44, which is for providing new printing formes 37 to be mounted on the forme cylinder 33, that two printing formes 37 are arranged along the circumference of the forme cylinder 33, and that the lower chute 42 for receiving printing formes 37 that have been removed from the forme cylinder 33 is empty, and thus is free of printing formes 37.

The forme cylinder 33 rotates so that the opening 09 of a groove 08, in which opening 09 the suspension leg 14 at the trailing end 04 of the printing forme 37 to be removed from the forme cylinder 33 is held by a holding element 21, is moved to a first position. In this position, the opening 09 is located below the guide element 73, which is a part of the lower chute 42. The controllable, and preferably pneumatically actuable contact pressure element 24 is placed against the forme cylinder 33, all as depicted in FIG. 13.

The preferably pneumatically actuable actuating element 23 pivots the holding element 21 against the force of a spring element 22, as depicted in FIG. 2. The suspension leg 14 at the trailing end 04 of the printing forme 37 snaps out of the opening 09 by virtue of its inherent elastic stress, and strikes the undersurface of the guide element 73. The engaged contact pressure element 24 secures the printing forme 37 against further release from the circumferential surface 07 of the forme cylinder 33, as seen in FIG. 14.

Figure 15:
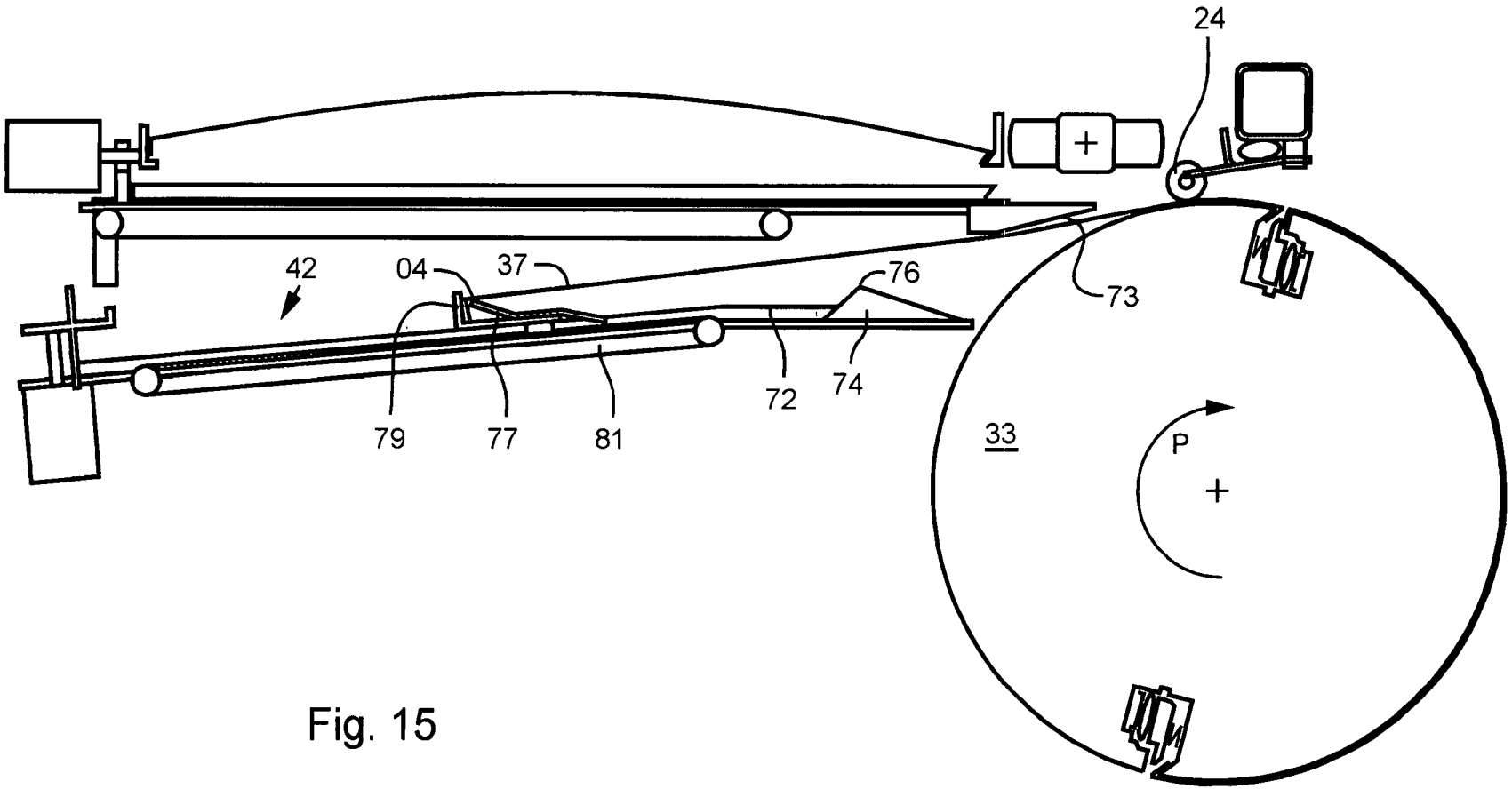
Figure 16:
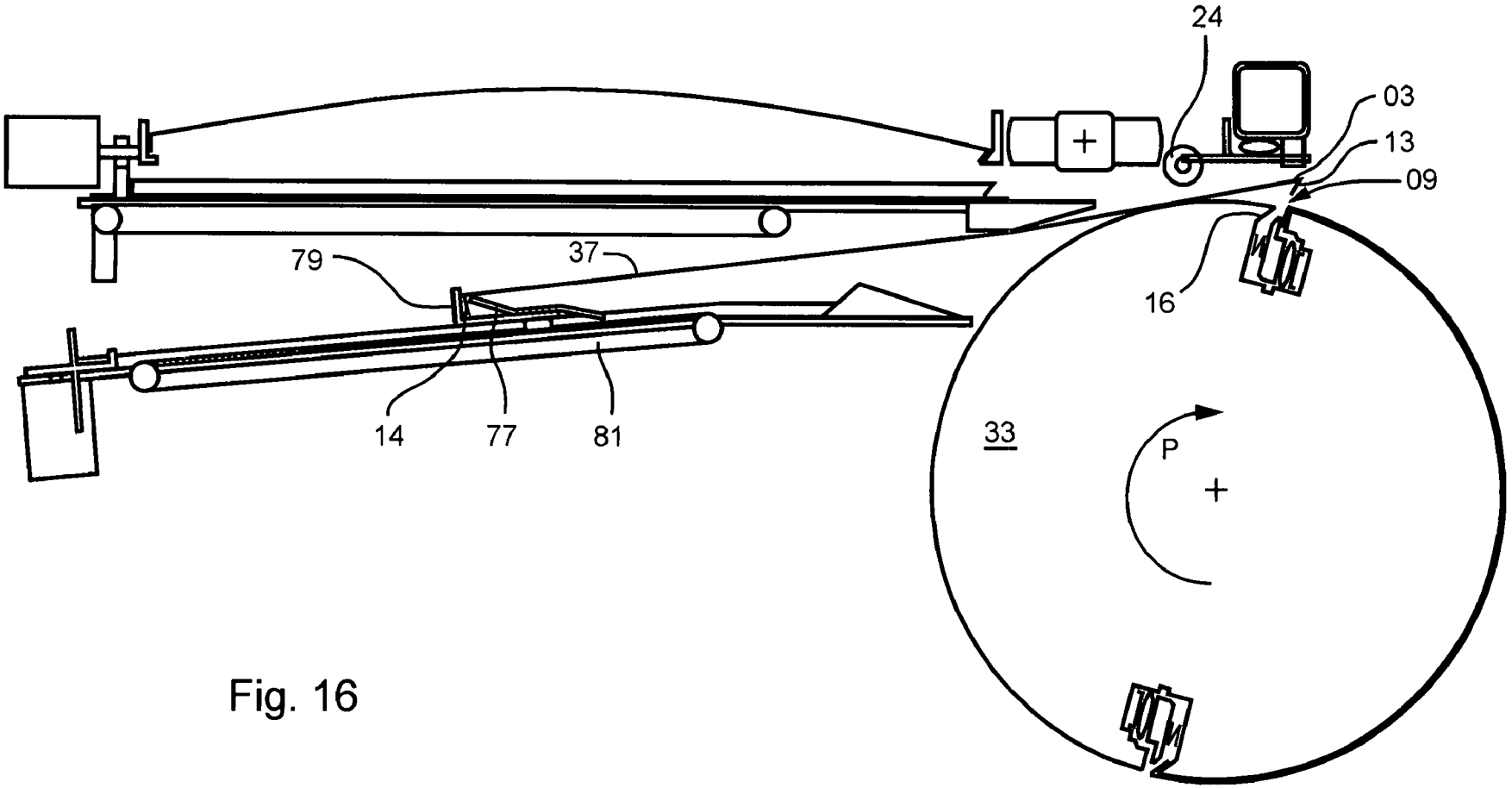

The forme cylinder 33 now rotates in the direction opposite its production direction P, thereby forcing the trailing end 04 of the printing forme 37 into the chute 42, as is depicted in FIG. 15. In the course of the introduction of the trailing end 04 of the printing forme 37 into the chute 42, the suspension leg 14 at the trailing end 04 of this printing forme 37 first slides along the guide element 73, and then comes to rest on the first ramp 74, which belongs to the chute 42. The suspension leg 14 slides upward along the ramp 74 and over its peak point 76, after which it reaches the support 72. While the contact pressure element 24 continues to be engaged against the forme cylinder 33, the printing forme 37 is pushed farther into the chute 42 by virtue of the rotation of the forme cylinder 33 in the direction opposite its production direction P. This further travel of the printer forme 37 into the chute 42 causes the suspension leg 14 on its trailing end 04 to also reach the second ramp 77, which second ramp 77 is connected to the conveyor mechanism 81, and to strike the stop 79, which is connected to the second ramp 77, all as seen in FIG. 15.

The contact pressure element 24 is then disengaged from the forme cylinder 33. The striking of the suspension leg 14 at the trailing end 04 against the stop 79 causes the angled suspension leg 13 at the leading end 03 of the printing forme 37, which is suspended in a positive connection from the front edge 16 of the opening 09, to be released from the opening 09. The printing forme 37 then lies with its leading end 03 unattached on the circumferential surface 07 of the forme cylinder 33, as may be seen in FIG. 16. From the time the suspension leg 14 at the trailing end 04 was released, up to this point depicted in FIG. 16, the forme cylinder 33 has executed less than half of one revolution. The angled suspension leg 14 at the trailing end 04 has become hooked between the second ramp 77 and the stop 79. The conveyor mechanism 81, which is connected to the second ramp 77 and the stop 79, can then draw the printing forme 37 all the way into the chute 42, as is being done in the depiction of FIG. 16.

Figure 17:
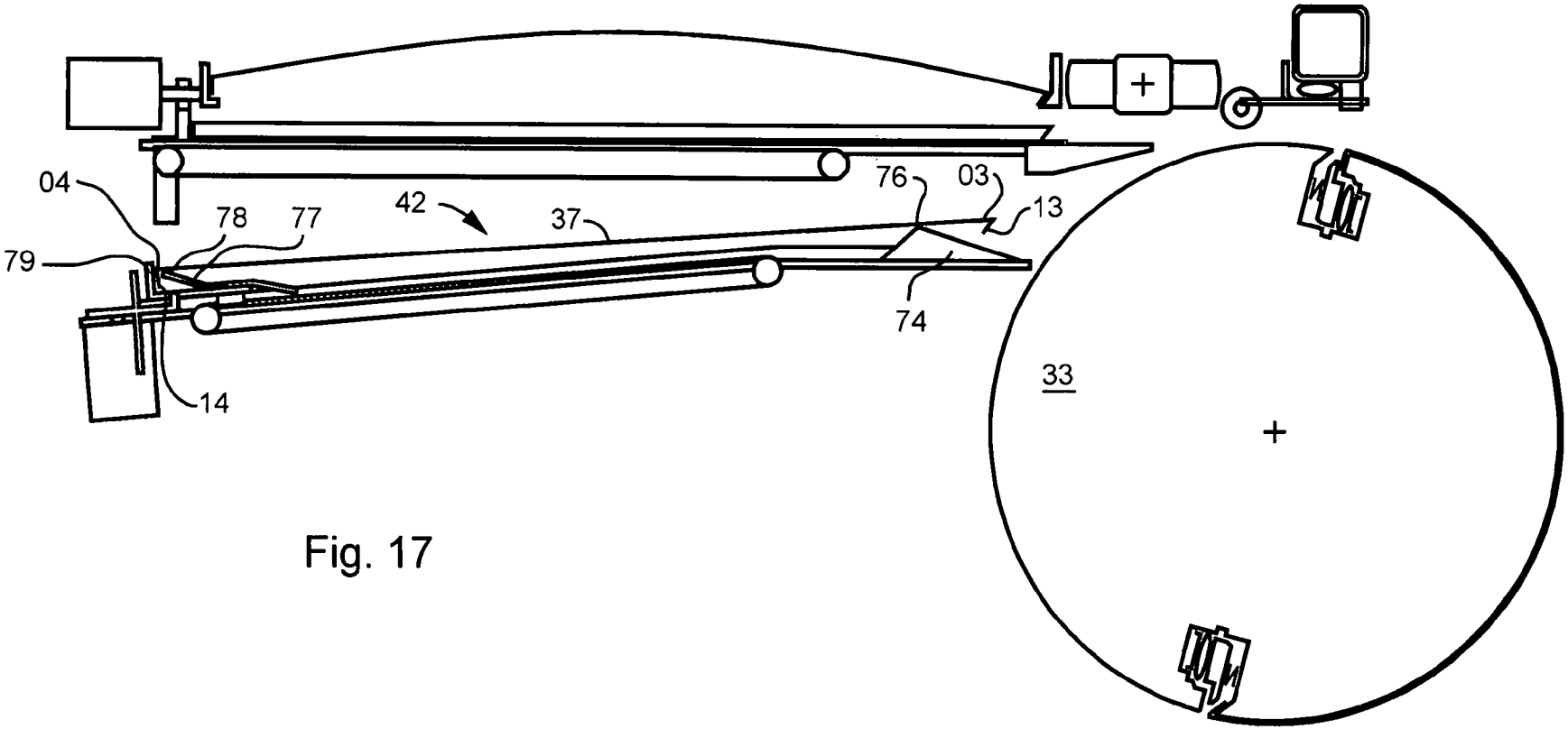

The printing forme 37 has now been removed from the forme cylinder 33 and is located along its length L in the chute 42, as is shown in FIG. 17. The suspension leg 14 at the trailing end 04 of the printing forme 37 lies on the peak point 78 of the second ramp 77, while its leading end 03 lies on the peak point 76 of the first ramp 74. At least the suspension leg 13 at the leading end 03 preferably hangs unattached. The seating of the now-removed printing forme 37 in the chute 42 preferably involves support of the printing forme 37 at two points, namely at the peak points 76; 78 of the two ramps 74; 77.

Figure 18:
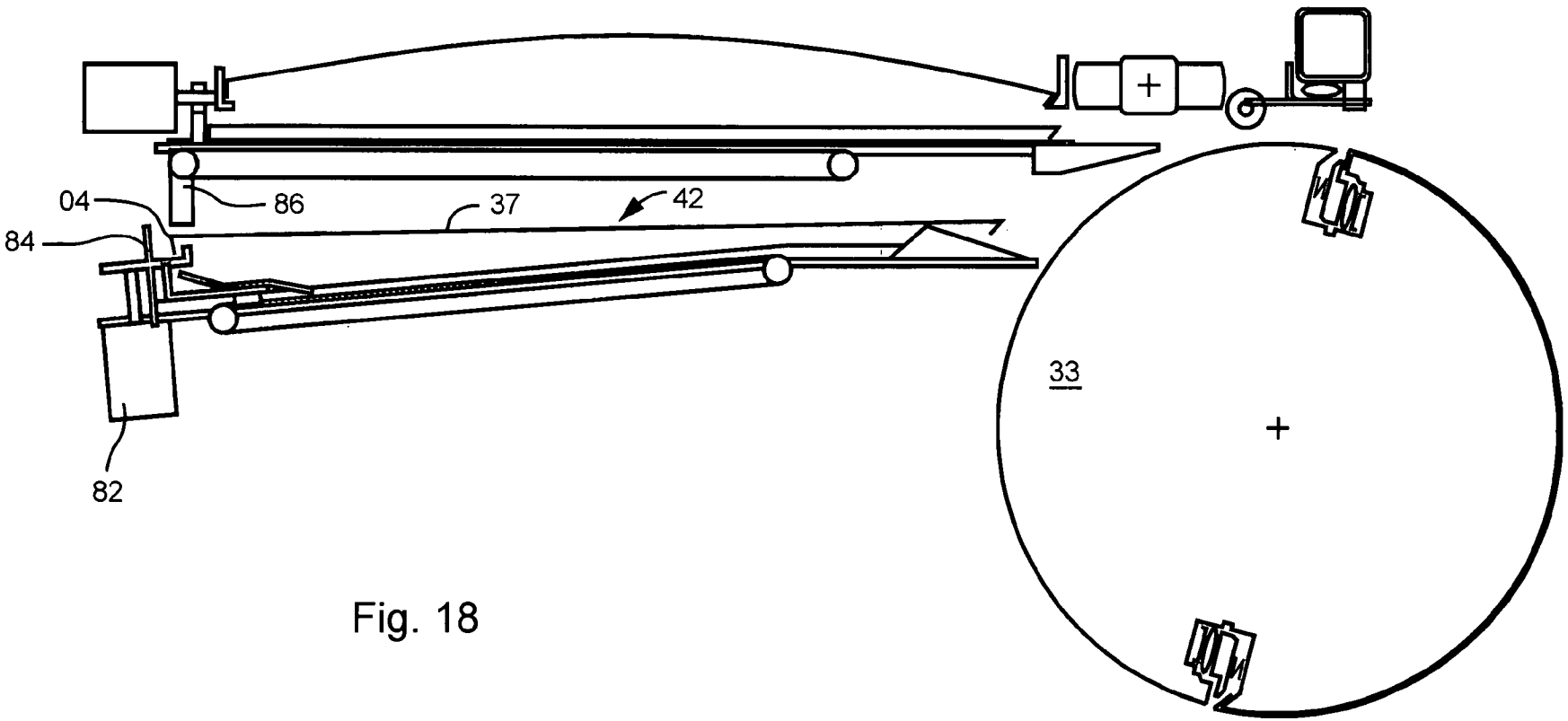

The printing forme lifter 82, which can, for example, be pneumatically actuated, now raises the trailing end 04 of the printing forme 37, which has been drawn into the chute 42, to slightly below the securing element 86. The rear suspension leg 14 now rests on the lifting arm 84 that is connected to the printing forme lifter 82, as is depicted in FIG. 18.

Figure 19:
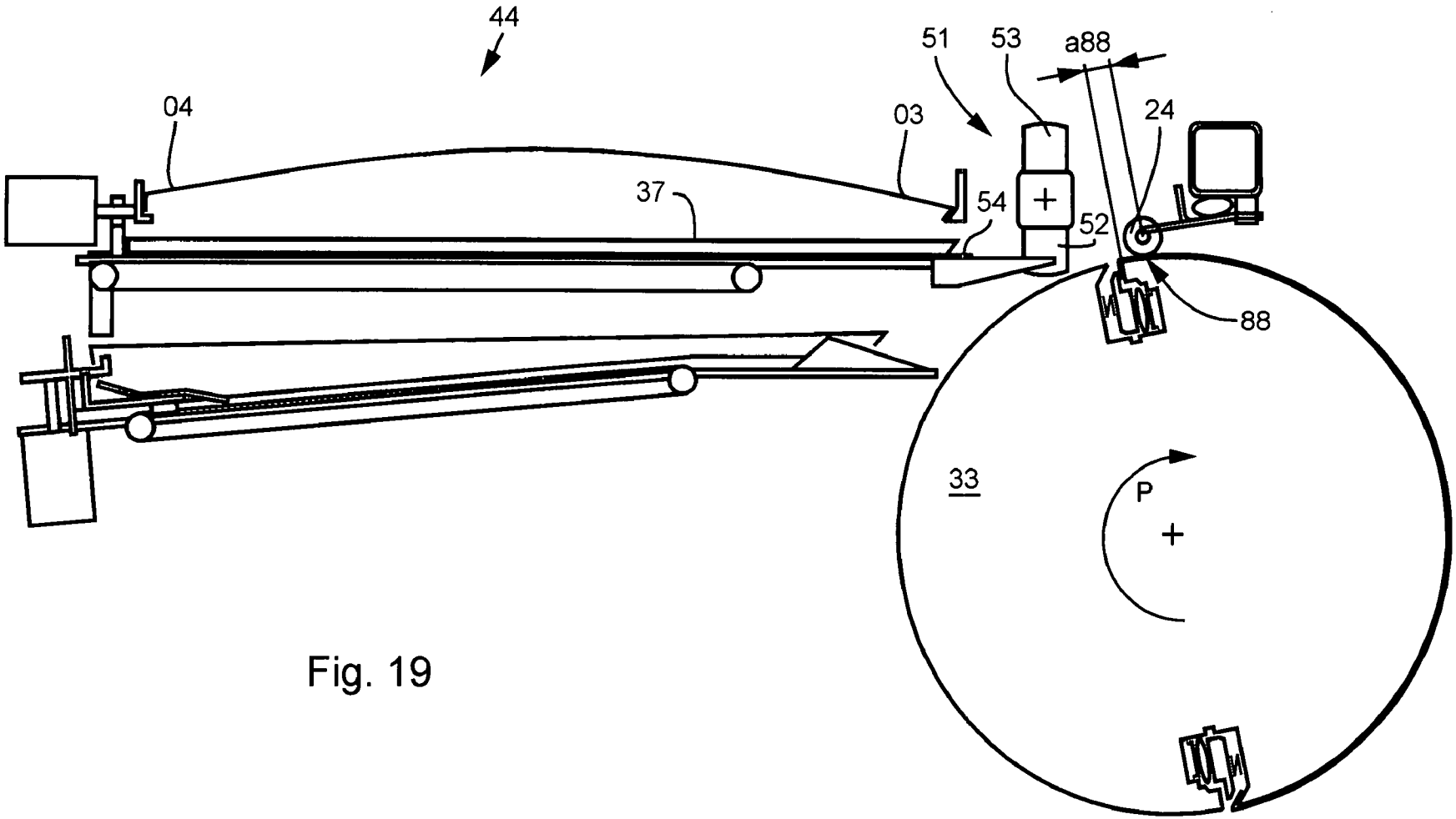
Figure 20:
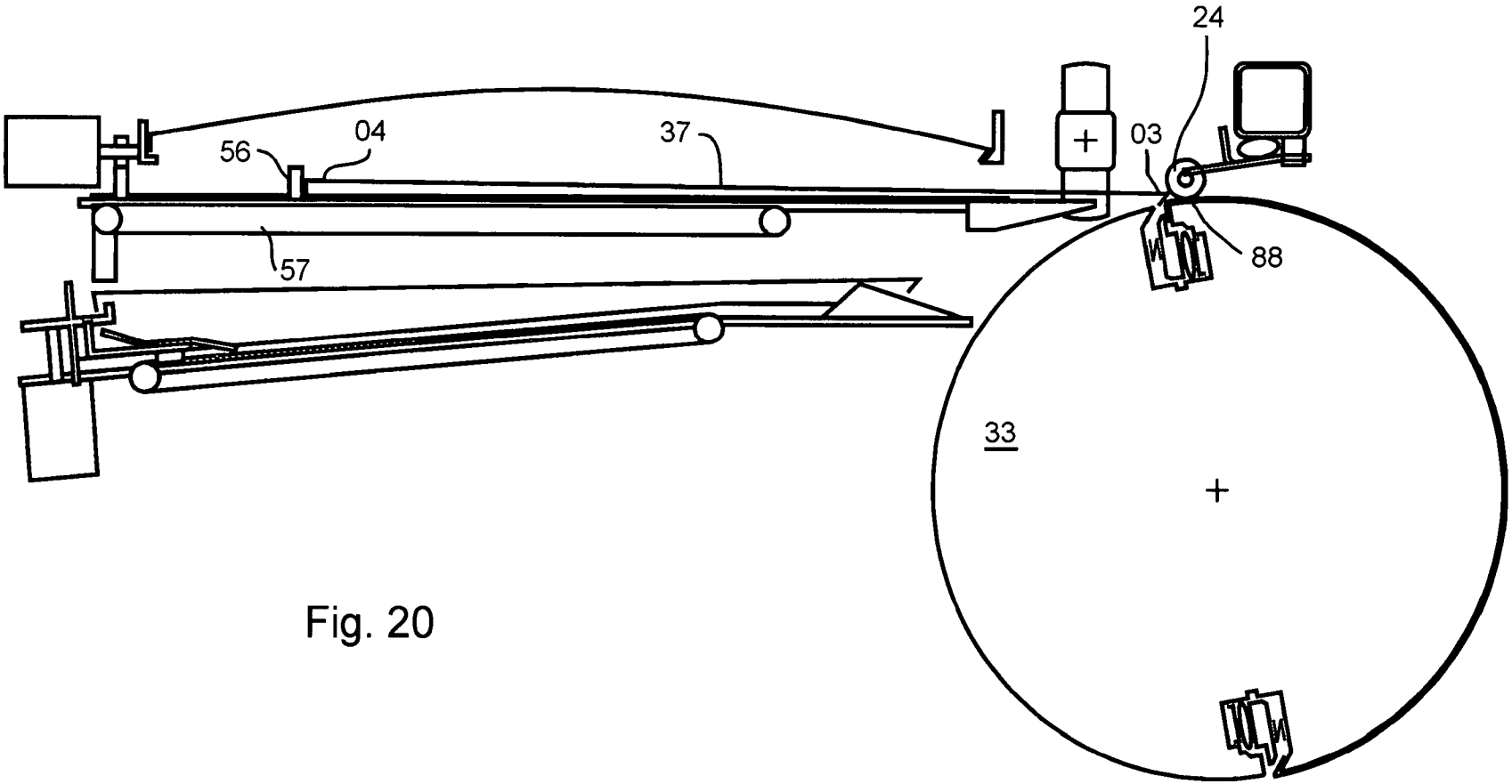

While a first printing forme 37, which is to be mounted on the forme cylinder 33, rests with its angled suspension legs 13; 14 on the support 54 in the upper chute 44, the forme cylinder 33 rotates farther in the direction opposite to its production direction P into a second position, in which the opening 09, from which the suspension leg 13 at the leading end 03 of the prior printing forme 37, which was previously removed from the forme cylinder 33, has been released, has passed a contact point 88 for the contact pressure element 24 that is engaged against the forme cylinder 33, as shown in FIG. 19. Now the rear edge 17 of the opening 09 in the production direction P of the forme cylinder 33 is located a distance a88 from the contact point 88. The distance a88 is within the range of a few millimeters, and preferably is fewer than 30 mm. This distance a88 therefore corresponds to an arc length of less than one-thirtieth of the circumference of the forme cylinder 33. The first position of the forme cylinder 33, for use in removing a printing forme 37 that is arranged on it, is generally not identical to its second position for use in receiving a new printing forme 37. The contact pressure element 24 is preferable engaged against the forme cylinder 33 as the opening 09 is passing the contact point 88, or after it has passed that contact point 88. The alignment device 51, which is positioned near the forme cylinder 33, preferably now pivots through 90°, with its diametrically arranged stops 52; 53, which were previously preferably horizontally aligned, now moved into a vertical position, as depicted in FIG. 19, so that a stop 52; 53, which is adjusted to the width B of the printing forme 37 to be mounted on the forme cylinder 33, dips into a transport plane for the printing forme 37 to be mounted on the forme cylinder 33. That transport plane, which is defined by the support 54 in the upper chute 44, and by the printing forme 37 to be mounted on the forme cylinder 33, is aligned with the stop 52; 53 in relation to the forme cylinder with respect to its side register during its transport out of the chute 44.

The first printing forme 37, which is to be mounted on the forme cylinder 33 in place of the previously removed first removed printing forme 37, is positioned with its suspension leg 14 at its trailing end 04 on the stop 56, which stop 56 is connected to a conveyor mechanism 57. The conveyor mechanism 57 is placed in operation, so that, in a movement that is preferably directed tangentially toward the forme cylinder 33, the stop 56 conveys the first printing forme 37 out of the chute 44 until its leading end 03 comes into contact with the contact pressure element 24, which is engaged against the forme cylinder 33. The suspension leg 13, which is angled at this leading end 03, comes to rest between the rear edge 17 of the opening 09 in the production direction P of the forme cylinder 33 and the contact point 88 of the contact pressure element 24 on the forme cylinder 33, as is depicted schematically in FIG. 20.

The forme cylinder 33 now changes its direction of rotation and begins to rotate in its production direction P. As a result, the suspension leg 13 at the leading end 03 of the printing forme 37, which has been placed on the forme cylinder 33, slides into the opening 09 and preferably becomes suspended in a positive connection at the front edge 16 of the opening 09, as may be seen by referring to FIG. 21.

Figure 22:
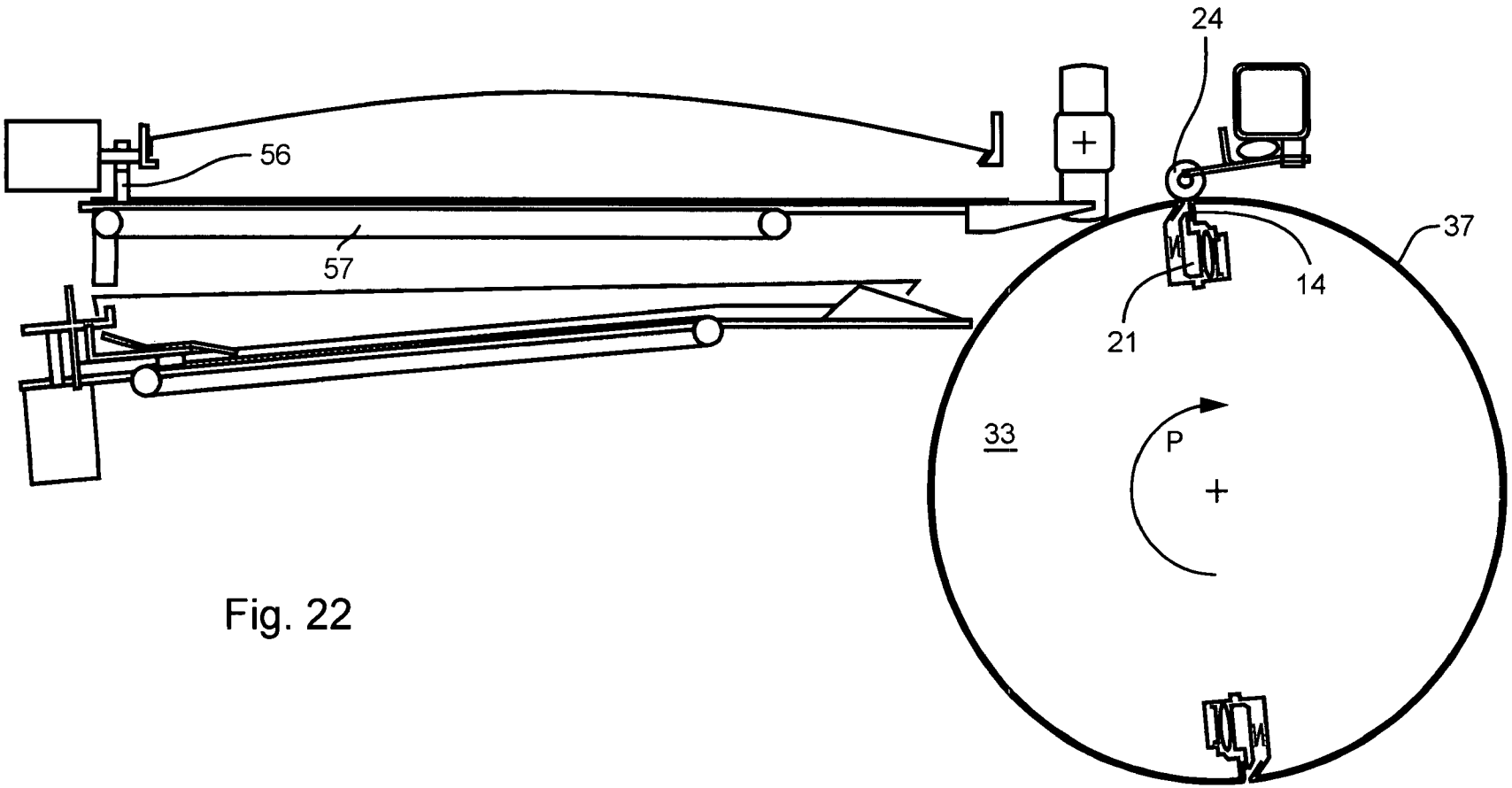

Further rotation of the forme cylinder 33 in its production direction P causes the printing forme 37, the suspension leg 13 of which has been suspended in the opening 09, to be drawn completely out of the chute 44 and onto the forme cylinder. This is depicted in FIG. 22. During this drawing out process, the printing forme 37 is rolled on to the forme cylinder 33 by the contact pressure element 24, which is engaged against the forme cylinder 33. When the forme cylinder 33 has completed one half rotation in its production direction P, the contact pressure element 24 forces the angled suspension leg 14 at the trailing end 04 of the printing forme 37 into the opening 09. The holding element 21 in the groove 08 that belongs to this opening 09 has been released and therefore is brought into an operating position in which it fixes the suspension leg 14 at the trailing end 04 of the printing forme 37, which suspension leg 14 has been inserted into the opening 09, for example, via a clamp. The conveyor mechanism 57 returns the stop 56 that is connected to it back to its end position on the side in the chute 44 that faces away from the forme cylinder 33, again as may be seen in FIG. 22.

Figure 23:
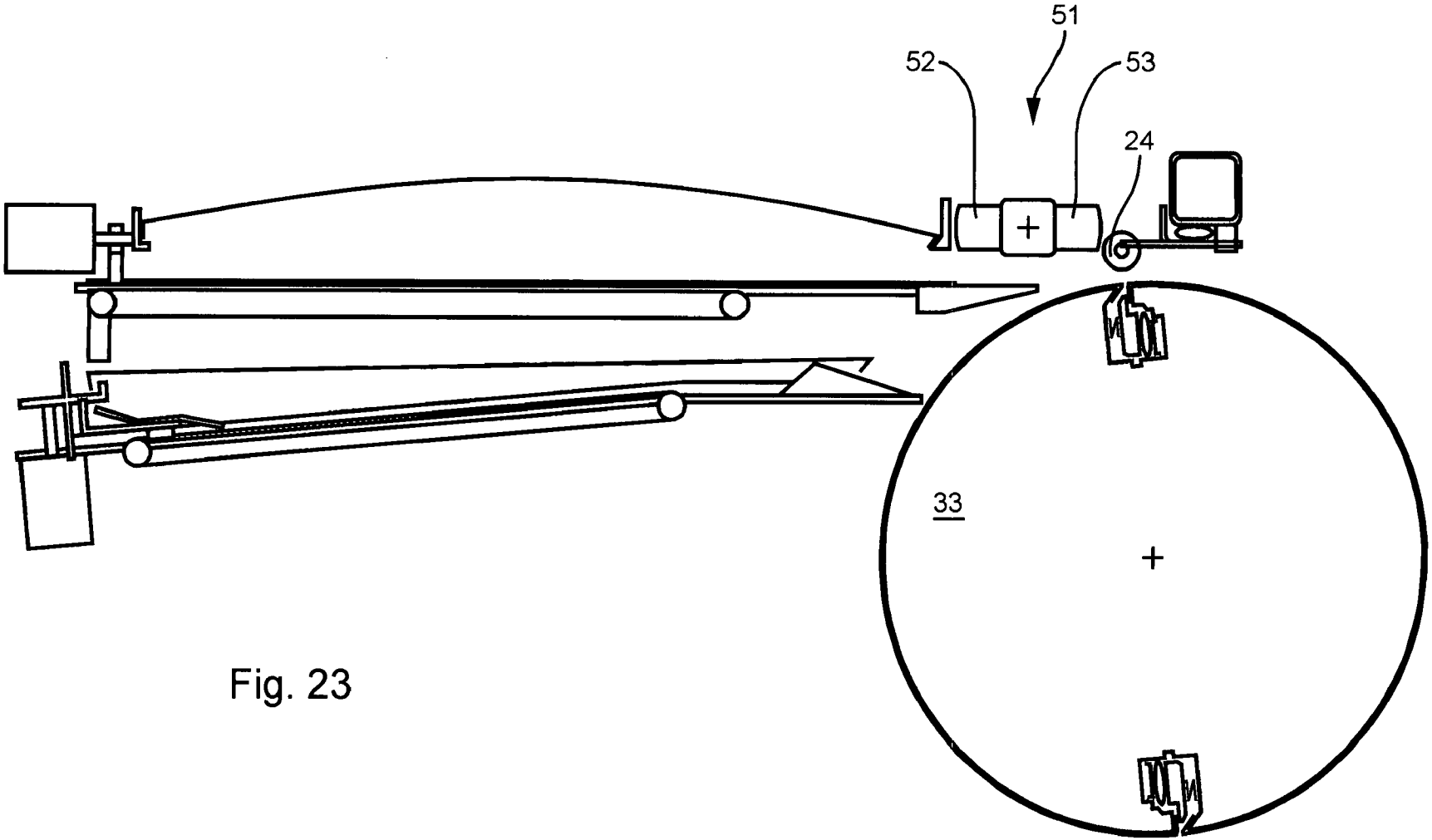
Figure 24:
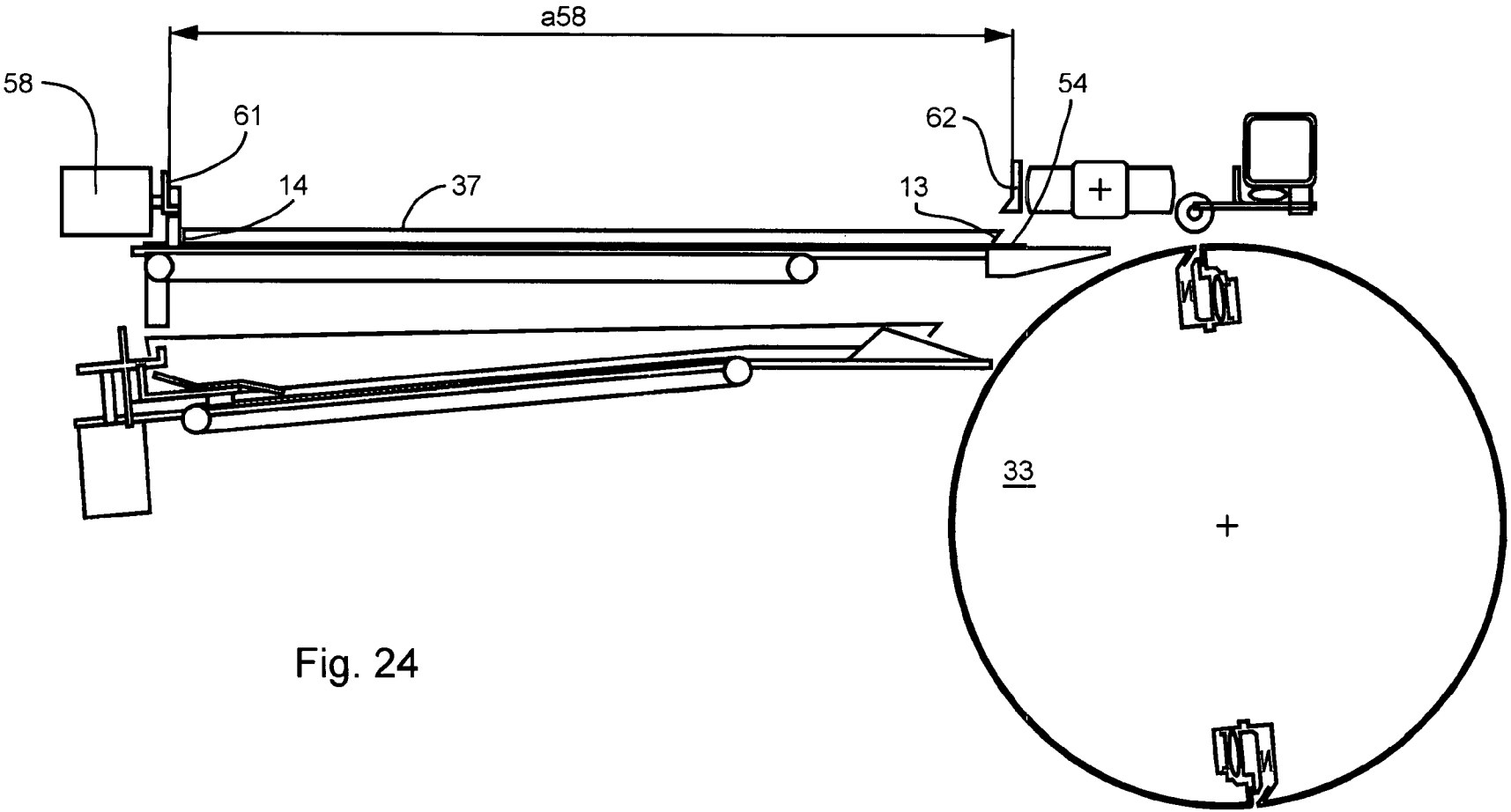
Figure 25:
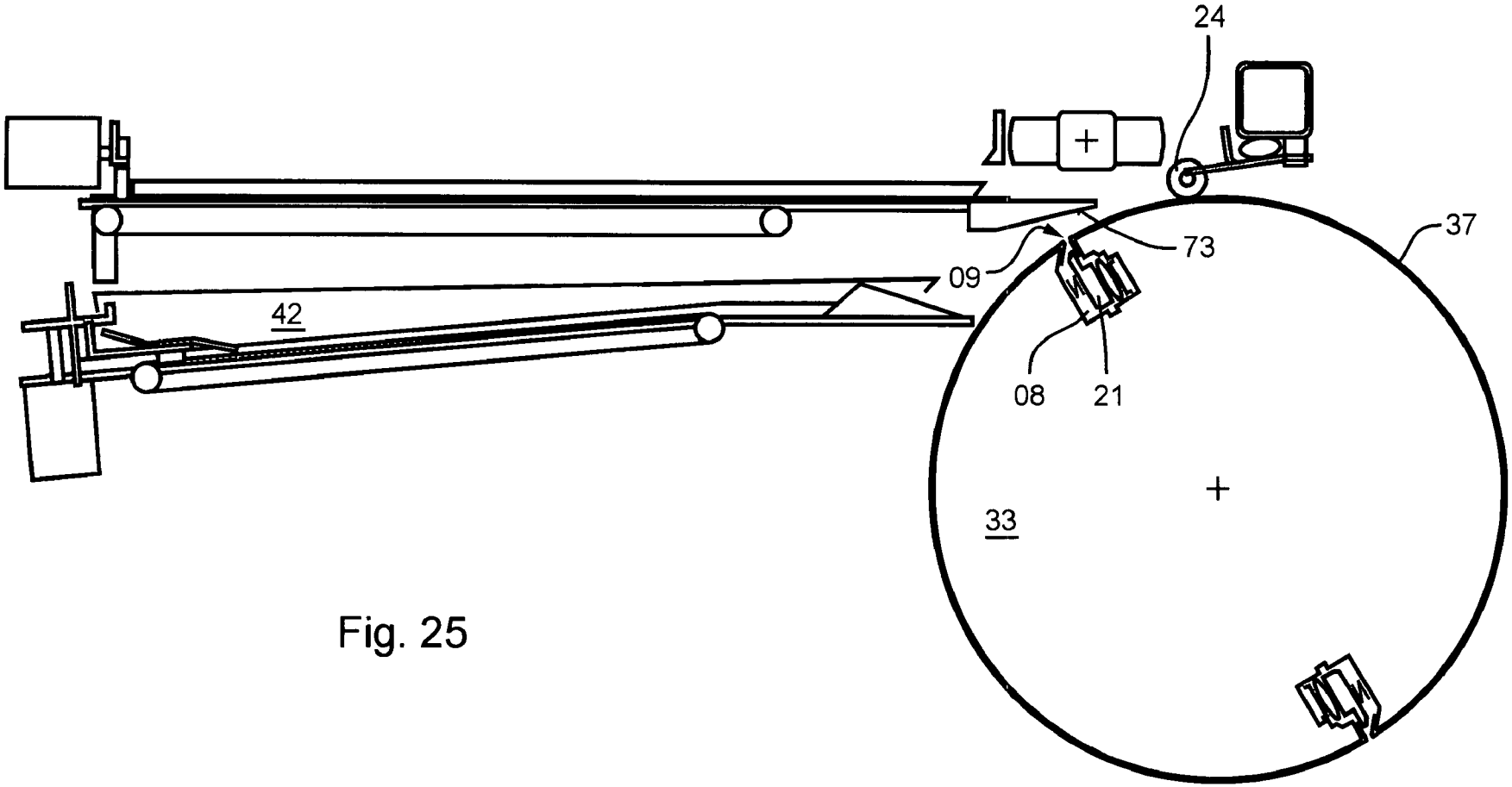
Figure 26:
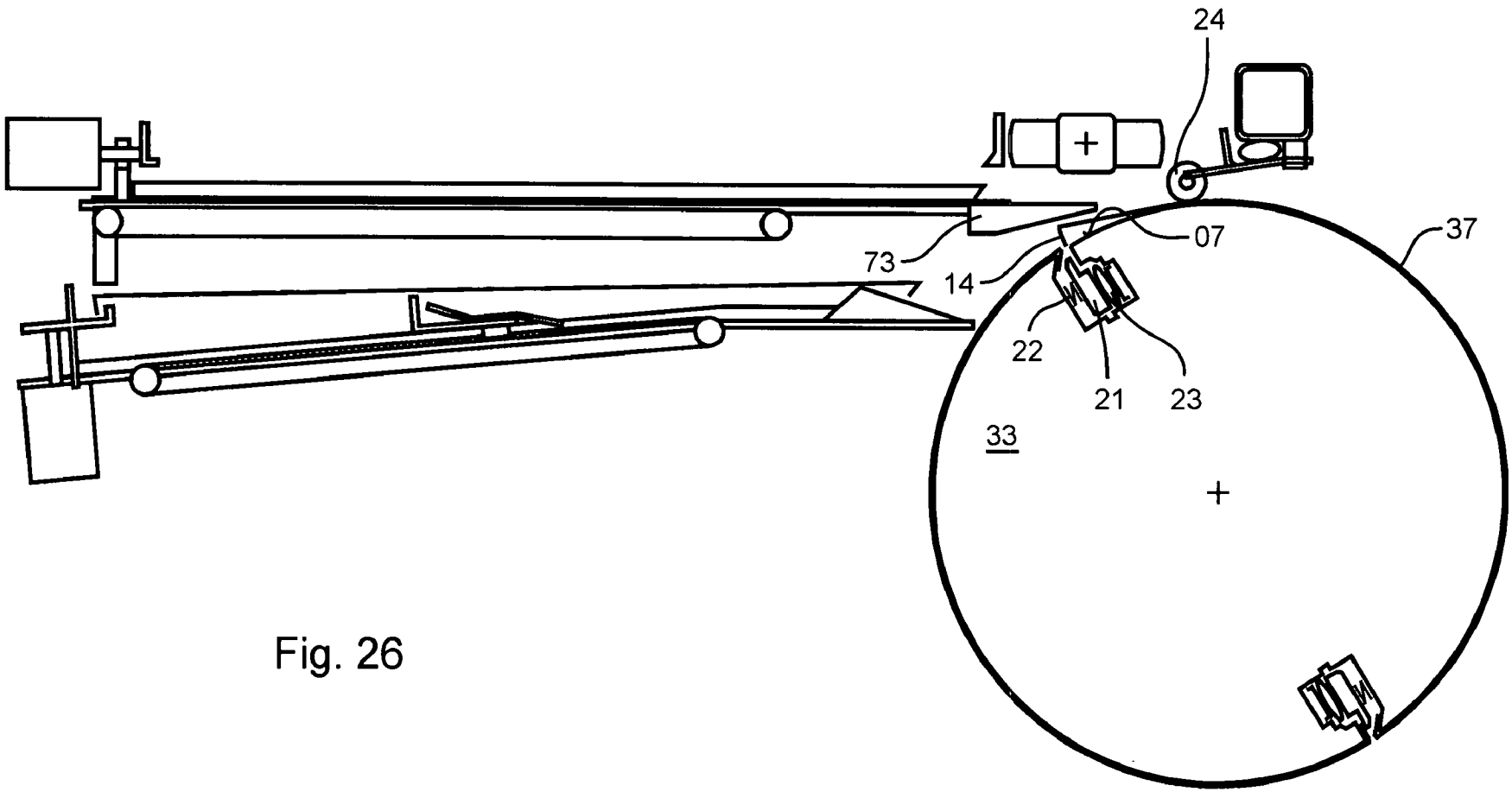
Figure 27:
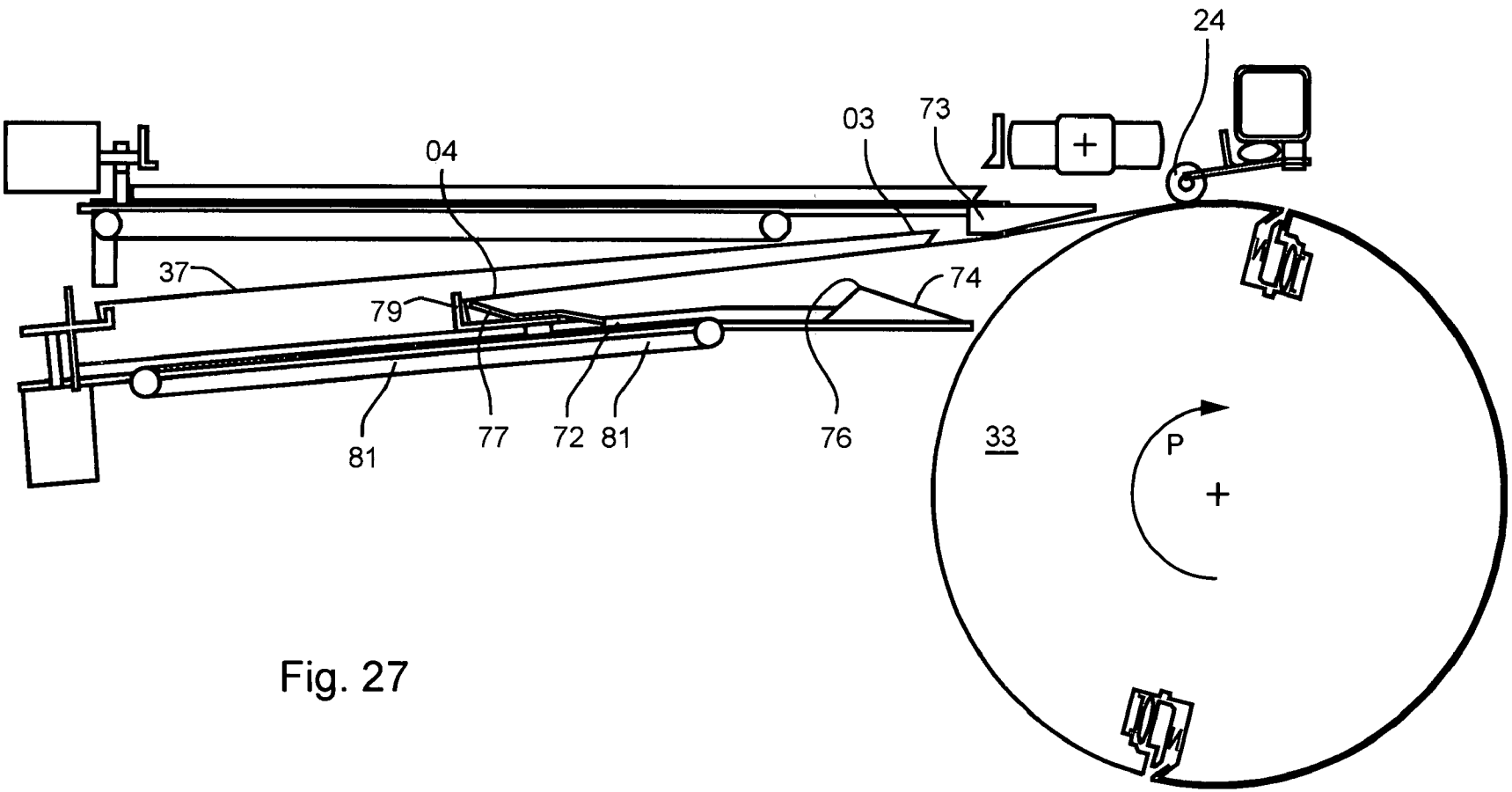

The contact pressure element 24 is now disengaged from the forme cylinder 33, and the alignment device 51, with its diametrically arranged stops 52; 53, preferably pivots back to a horizontal position. With the process steps that have been described thus far, a change of a first printing forme 37 on the forme cylinder 33 has been completed. A used printing forme 37 has been removed and a new printing forme 37 has been installed. This change of a printing forme 37 can be accomplished using the described device within a very short time, and preferably in less than one minute. The forme cylinder 33, as it is now depicted in FIG. 23 is then ready for production again.

The change of another, second printing forme 37, such as, for example, one that is arranged on the forme cylinder 33 along its circumference, after the ones removed and replaced, as discussed above, begins by a press operator placing the new, second printing forme 37 in the upper chute 44, preferably even during the preceding production run. The second printing forme 37 is held over or above the support surface 54 by a controllable, and preferably by a pneumatically controllable, printing forme holder 58. The printing forme 37 is, for example, either clamped at its ends 03; 04 between two stops 61; 62, wherein at least one of the stops 61; 62 is movable. Alternatively, the printing forme 37 is inserted, along its longitudinal sides, in guide rails 64, wherein at least one of the guide rails 64 is capable of moving along the width B of the printing forme 37. When the printing forme holder 58 releases the printing forme 37, so that its elements that hold the printing forme 37, such as, for example, the stops 61; 62 or the guide rails 64, temporarily increase their distance, for example, by a58, from one another, at least for a short period of time, the printing forme 37 falls onto the support 54, where it rests with its suspension legs 13; 14, as may be seen in FIG. 24.

To remove another, for example, second printing forme 37 from the forme cylinder 33, the forme cylinder 33 rotates the opening 09 of the groove 08, according to the method described with reference to FIG. 13. The suspension leg 14 at the trailing end 04 of the second printing forme 37, which is now to be removed from the forme cylinder 33, is held by a holding element 21, as the cylinder 33 is rotated opposite its production direction to the first position, where the trailing end suspension leg 14 is located below the guide element 73 that belongs to the lower chute 42. The controllable, and preferably pneumatically actuable, contact pressure element 24 is again engaged against the forme cylinder 33. This may be seen in FIG. 25.

In accordance with the method which was previously described in reference to FIG. 14, the preferably pneumatically actuable actuating element 23 pivots the holding element 21 against the force of the spring element 22. The suspension leg 14 at the trailing end 04 of the second printing forme 37 now snaps out of the opening 09 by virtue of its inherent elastic stress, and strikes against the guide element 73. The engaged contact pressure element 24 secures the second printing forme 37 against further release from the circumferential surface 07 of the forme cylinder 33, all as may now be seen by referring to FIG. 26.

The forme cylinder 33 now rotates further in the direction opposite its production direction P, thereby forcing the trailing end 04 of the second printing forme 37 into the chute 42. With the introduction of the second printing forme 37 into the lower chute 42, the suspension leg 14 at the trailing end 04 of that second printing forme 37 first slides along the guide element 73, and then comes to rest on the first ramp 74, which belongs to the lower chute 42. The suspension leg 14 of the second printing forme 37 slides upward along the ramp 74. It slides in under the first printing forme 37, which is resting in the chute 42 and lies on the peak point 76 of the first ramp 74, and raises the leading end 03 of that first printing forme 37, which is projecting beyond the peak point 76 and which is oriented toward the forme cylinder 33, while the suspension leg 14 of the second printing forme 37 being removed passes over the peak point 76 of the first ramp 74, thereby reaching the support 72. While the contact pressure element continues to be engaged against the forme cylinder 33, the second printing forme 37 is pushed farther into the chute 42 by virtue of the rotation of the forme cylinder 33 in the direction opposite its production direction P. As a result of this rotation and movement, the suspension leg 13 at the leading end 03 of the first printing forme 37, which is resting in the chute 42, slides over the printed image side of the second printing forme 37, which has been conveyed into the chute 42. As the process continues, the suspension leg 14 at the trailing end 04 of the second printing forme 37 also reaches the second ramp 77, which is connected to the conveyor mechanism 81, and strikes the stop 79, which is connected to the second ramp 77, as may be seen in FIG. 27.

Figure 28:
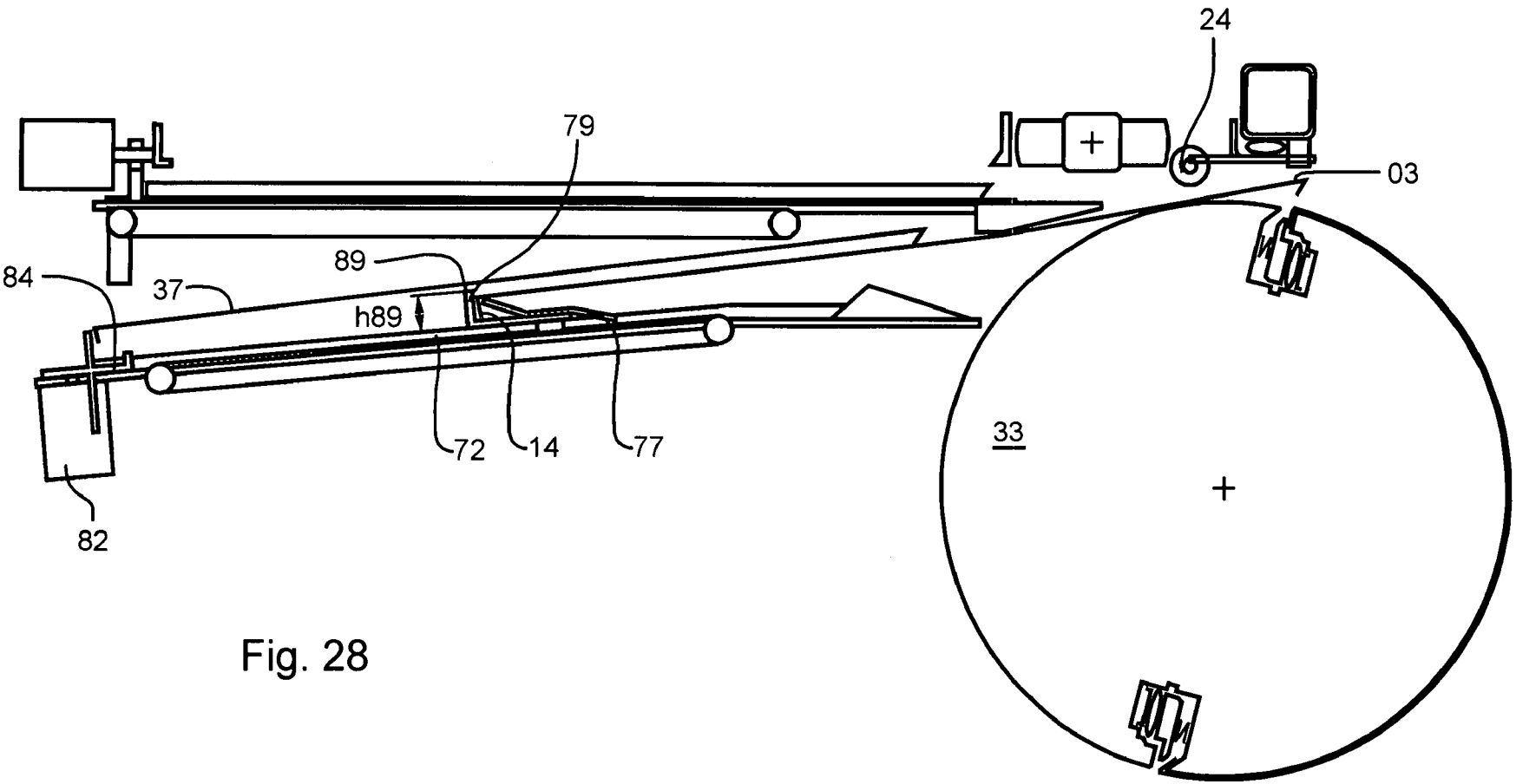

The contact pressure element 24 is now disengaged from the forme cylinder 33. When the suspension leg 14 at the trailing end 04 of the second removed printing forme 37 strikes the stop 79, the angled suspension leg 13 at the leading end 03 of the second printing forme 37, which is preferably suspended in a positive connection at the front edge 16 of the opening 09 in the forme cylinder 33, is now released from that opening 09. The leading end 03 of the suspension leg 13 of the second removed forme cylinder then rests freely on the circumferential surface 07 of the forme cylinder 33. From the time the suspension leg 14 at the trailing end 04 was released up to this point, the forme cylinder 33 has executed less than one half rotation. The angled suspension leg 14 at the trailing end 04 becomes hooked between the second ramp 77 and the stop 79. The lifting arm 84 of the printing forme lifter 82 descends. The first removed printing forme 37, which is resting in the chute 42 and which, up to this point, has been held at its trailing end 04, is now placed on a strip 89, which is formed on the stop 79, wherein the strip 89 has a height h89, perpendicular in relation to the support 72, which height h89 is greater than the length l14 of the angled suspension leg 14 at the trailing end 04 of the second printing forme 37. The height h89 preferably has a value that is between one and two times the length l14 of the angled suspension leg 14 at the trailing end 04 of the second printing forme 37, as is depicted in FIG. 28.

Figure 29:
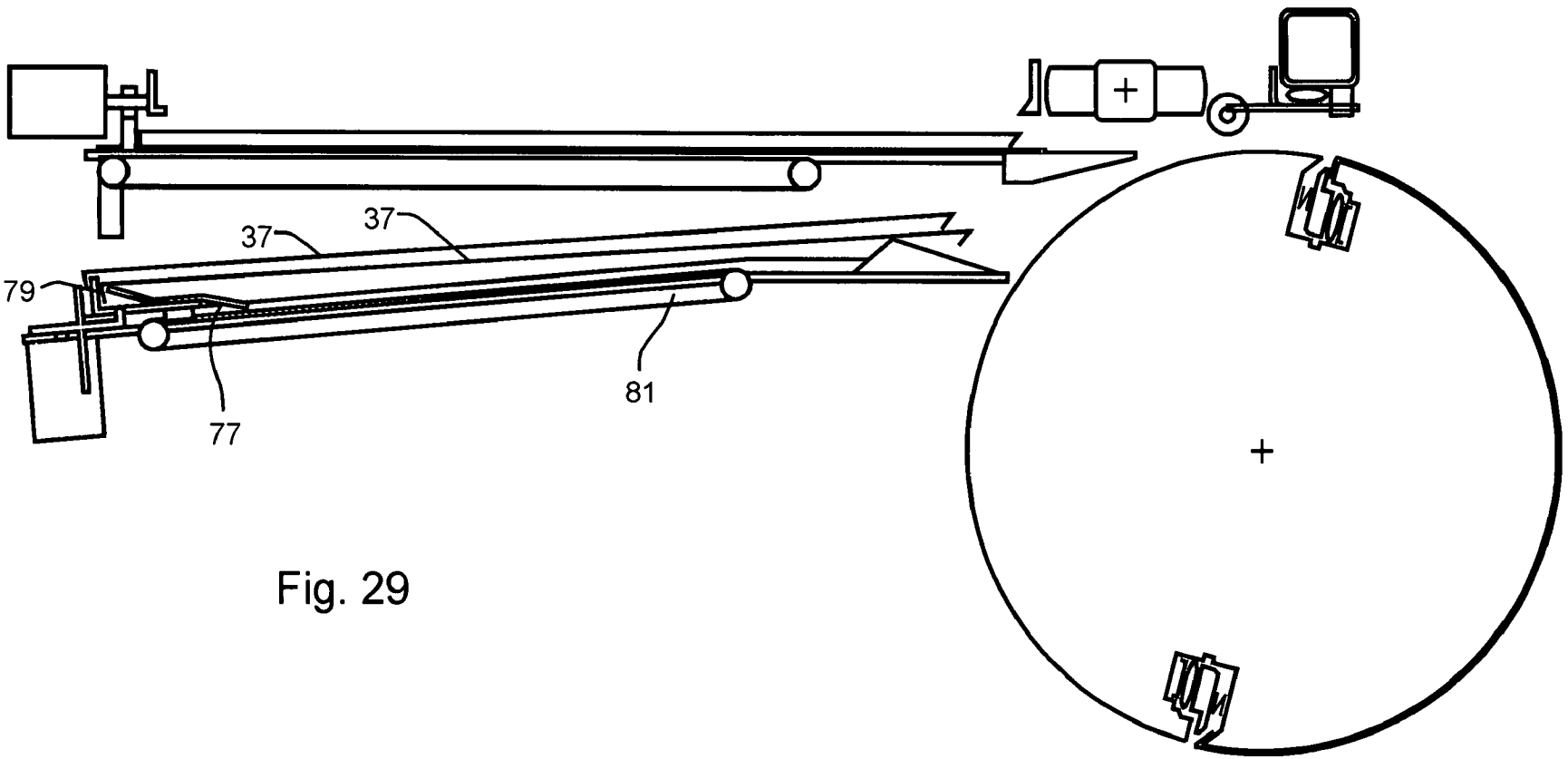
Figure 30:
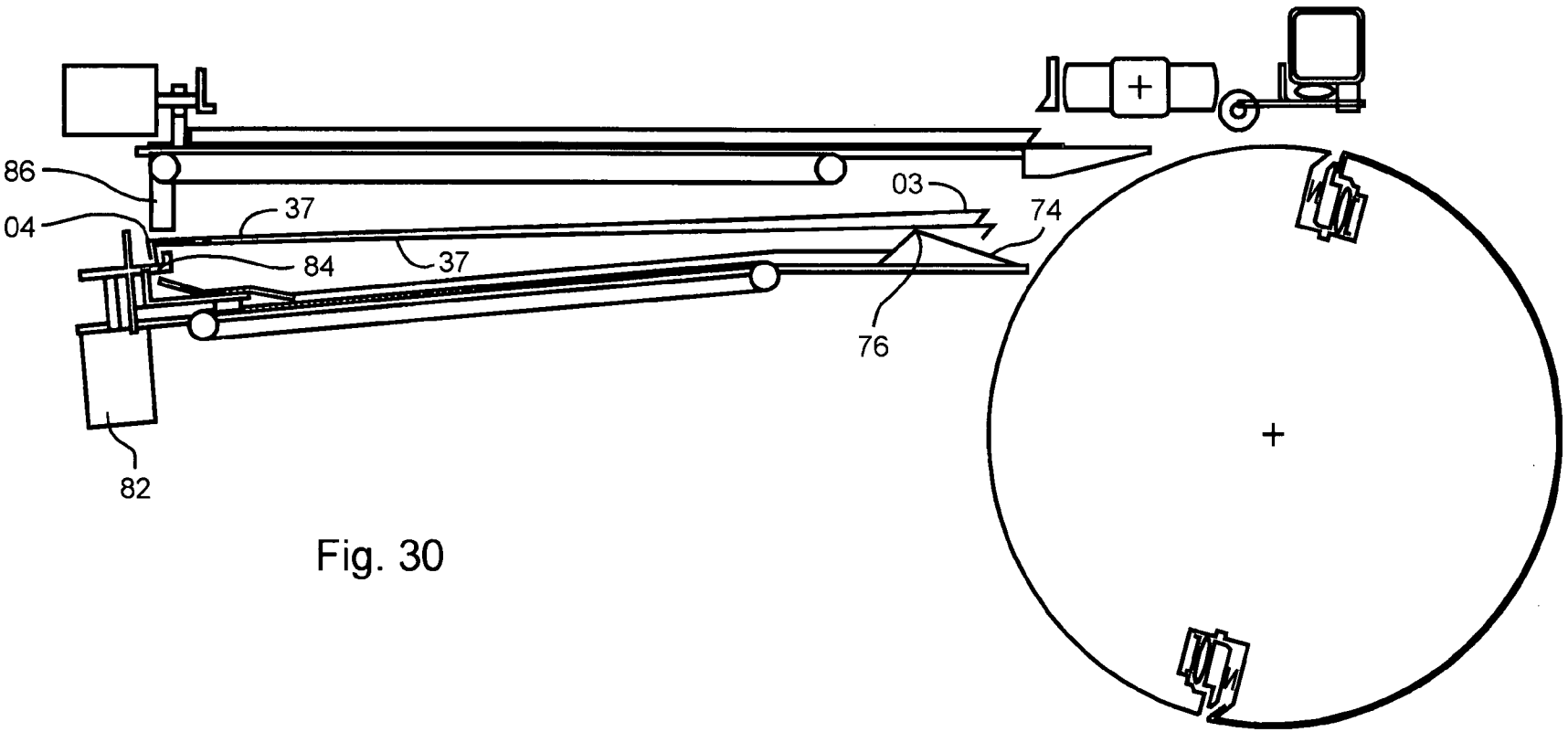
Figure 31:
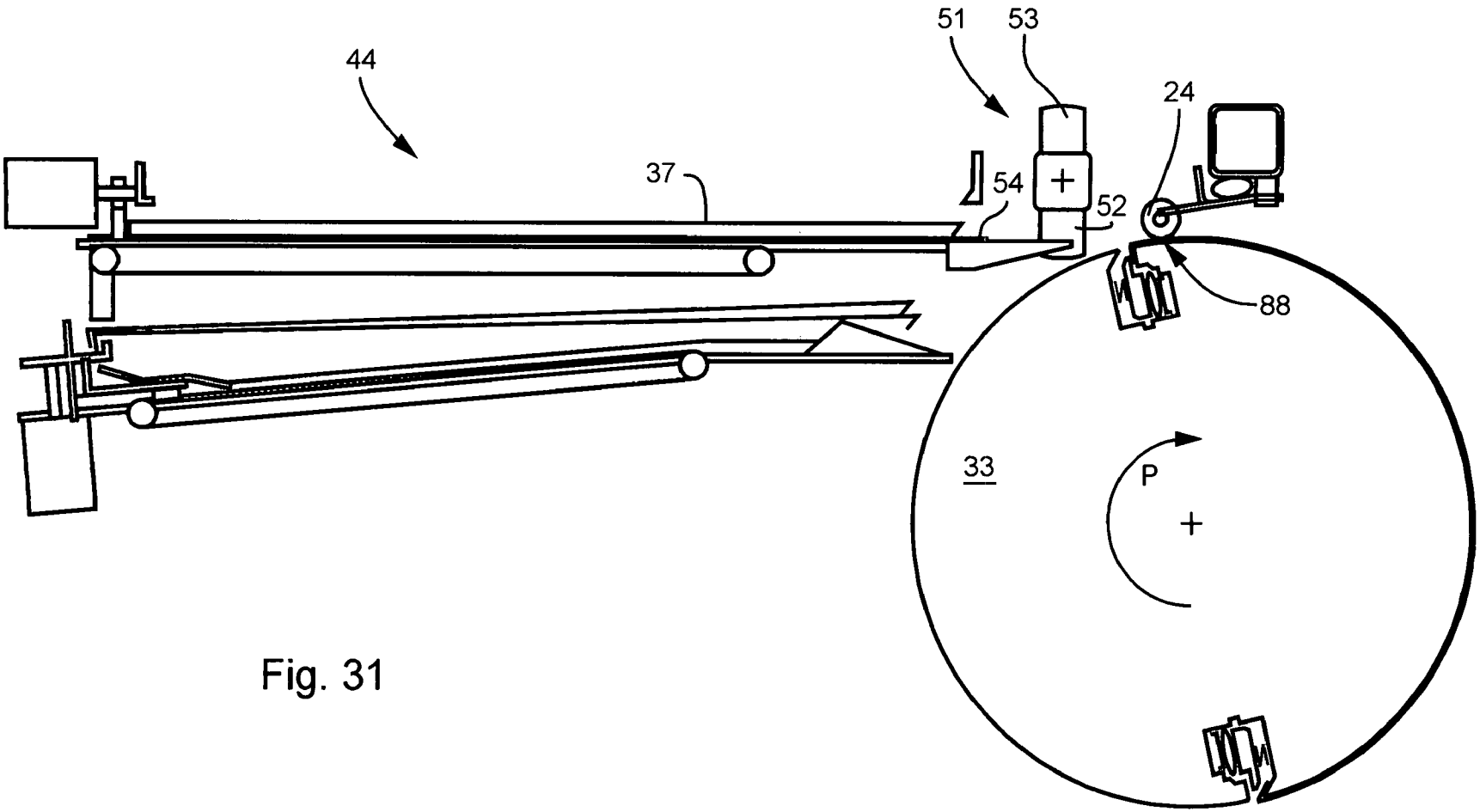
Figure 32:
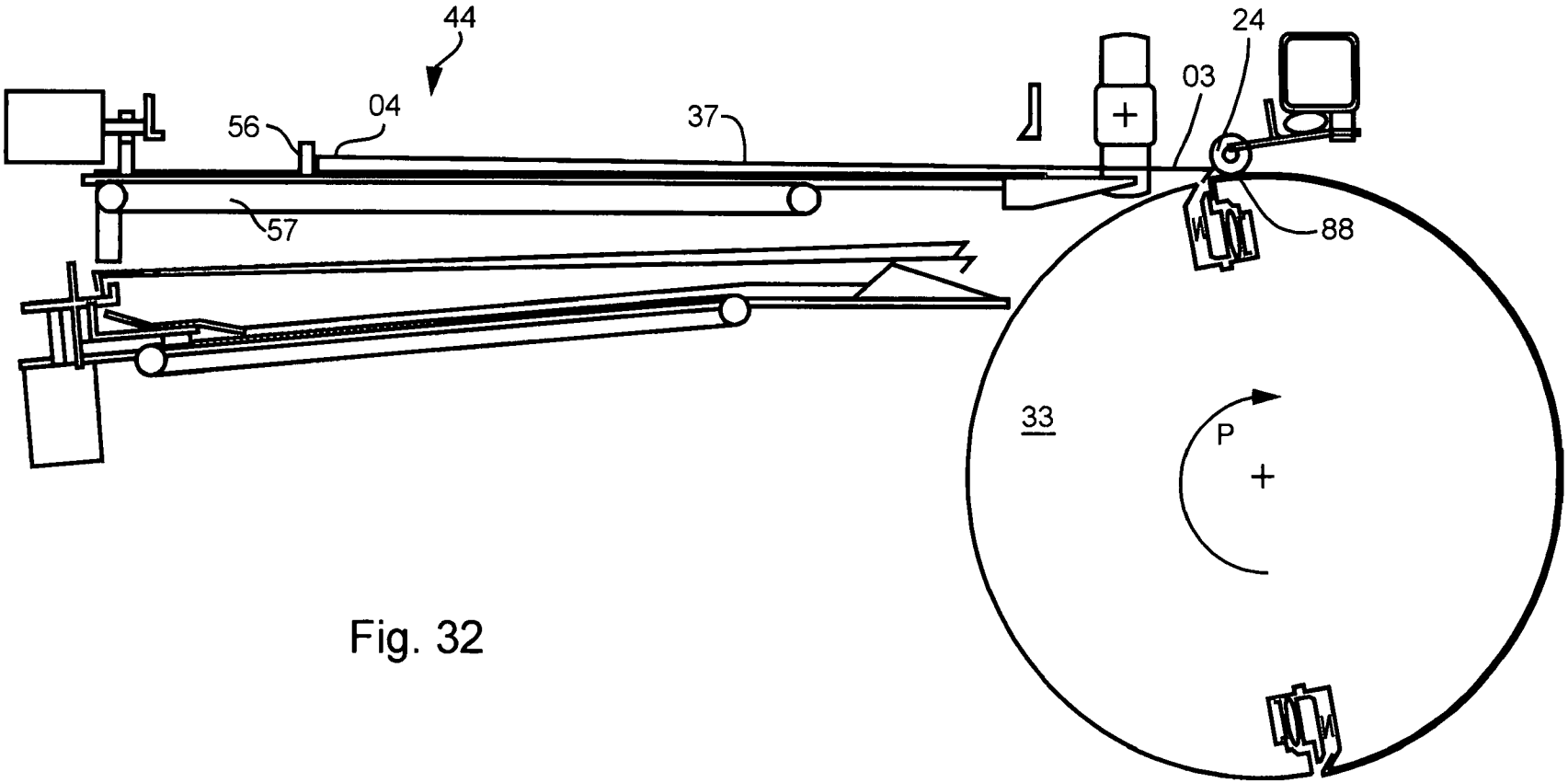

The conveyor mechanism 81, which is connected to the second ramp 77 and to the stop 79, then draws the second printing forme 37 all the way into the chute 42. The first and second removed printing formes 37 are now arranged one above another in the chute 42 along their length L. The conveyor mechanism 81, together with the second ramp 77 and the stop 79 for the angled suspension leg 14 at the trailing end 04 of the printing forme 37, which has been introduced into the chute 42, forms a carrier mechanism, as is seen in FIG. 29.

The printing forme lifter 82 then uses its lifting arm 84 to preferably lift the trailing end 04 of the two removed printing formes 37, which are situated in the chute 42, up to the securing element 86. The leading end 03 of the second printing forme 37 lies with a projection, which is oriented toward the forme cylinder 33, on the peak point 76 of the first ramp 74, and the angled suspension leg 13 at the leading end 03 of the first printing forme 37 rests on the leading end 03 of the second printing forme 37, as may be seen by referring to FIG. 30.

To install the second printing forme 37, which is positioned, ready for use, in the upper chute 44, the forme cylinder 33 continues to rotate farther in the direction opposite its production direction P, into the second position, until the opening 09, from which the suspension leg 13 at the leading end 03 of the second removed printing forme 37, which was previously removed from the forme cylinder 33, had been released, has passed the contact point 88 of the contact pressure element 24 that has been engaged against the forme cylinder 33, and until the rear edge 17 of the opening 09, in the production direction P of the forme cylinder 33, is located spaced a distance a88 from the contact point 88. The distance a88 lies within a range of a few millimeters, and preferably is fewer than 30 mm, and therefore corresponds to an arc length of less than one-thirtieth of the circumference of the forme cylinder 33, as was discussed in connection with FIG. 19. The contact pressure element 24 is preferably engaged against the forme cylinder 33, as the opening 09 is passing the contact point 88, or once it has passed the contact point 88. The alignment device 51, which is positioned near the forme cylinder 33, again preferably pivots 900 with its diametrically arranged stops, which have previously been oriented preferably horizontally, now again moved to a vertical position. A stop 52; 53, that has been adjusted to the width B of the second printing forme 37, which is to be mounted on the forme cylinder 33, drops into a transport plane, that is defined by the support 54 in the chute 44, for the second printing forme 37 to be mounted on the forme cylinder 33. The second printing forme 37 to be mounted on the forme cylinder 33 is thus aligned, in terms of its side register, with the forme cylinder 33 at the stop 52; 53 during its transport out of the chute 44. This is shown most clearly in FIG. 31.

The suspension leg 14 at the trailing end 04 of the second printing forme 37 which is to be mounted on the forme cylinder 33, is positioned at the stop 56, which is connected to the conveyor mechanism 57 of the upper chute 44. In accordance with the method previously described with reference to FIG. 20, the conveyor mechanism 57 is placed in operation, so that the stop 56 conveys the second printing forme 37 out of the chute 44, in a movement which is preferably directed tangentially in relation to the forme cylinder 33, until its leading end 03 of the second printing forme 37 to be mounted on the forme cylinder 33 comes into contact with the contact pressure element 24, which is engaged against the forme cylinder 33. The suspension leg 13 which is angled at this leading end 03 of this printing forme 37 now rests between the rear edge 17 of the opening 09, in production direction P of the forme cylinder 33, and the contact point 88 of the contact pressure element 24 on the forme cylinder 33, as may be seen in FIG. 32.

Figure 21:
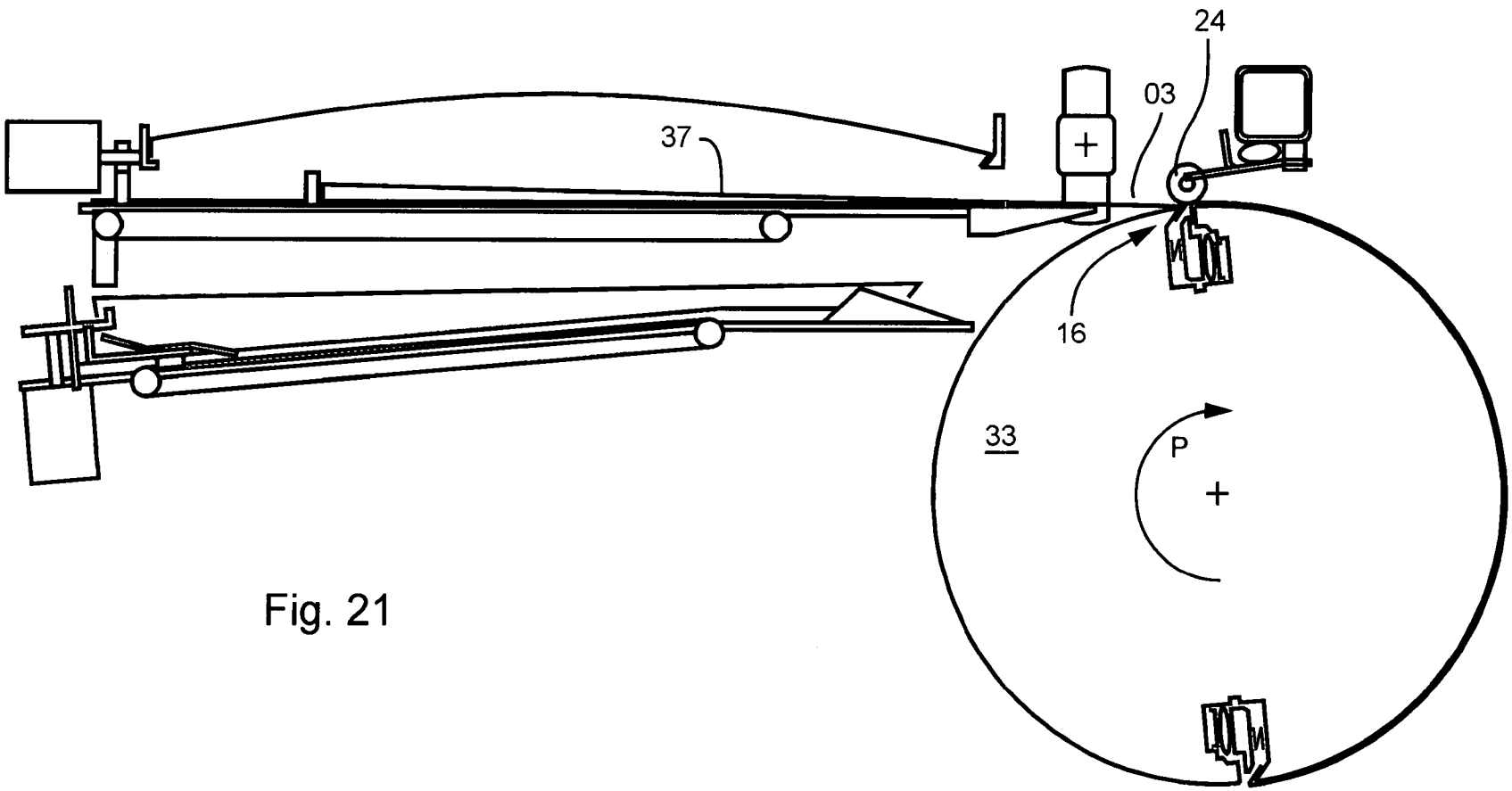
Figure 33:
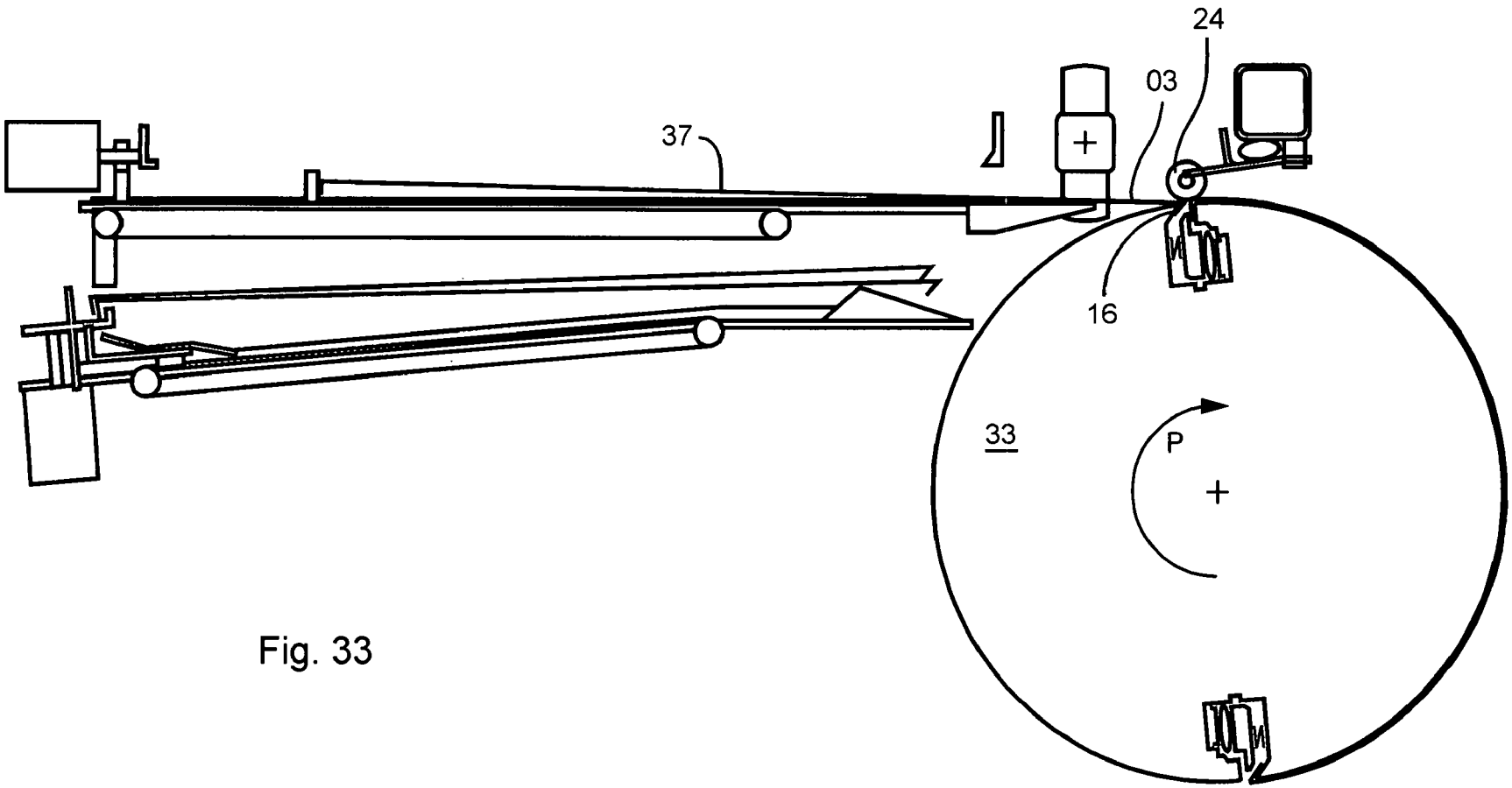

In accordance with the method which was previously described with reference to FIG. 21, the forme cylinder 33 again alters its direction of rotation and again begins to rotate in its production direction P. The suspension leg 13 at the leading end 03 of the second printing forme 37, which suspension leg 13 is placed against the forme cylinder 33, slides into the opening 09 and becomes suspended from the front edge 16 of the opening 09, preferably in a positive connection, as is illustrated in FIG. 33.

Figure 34:
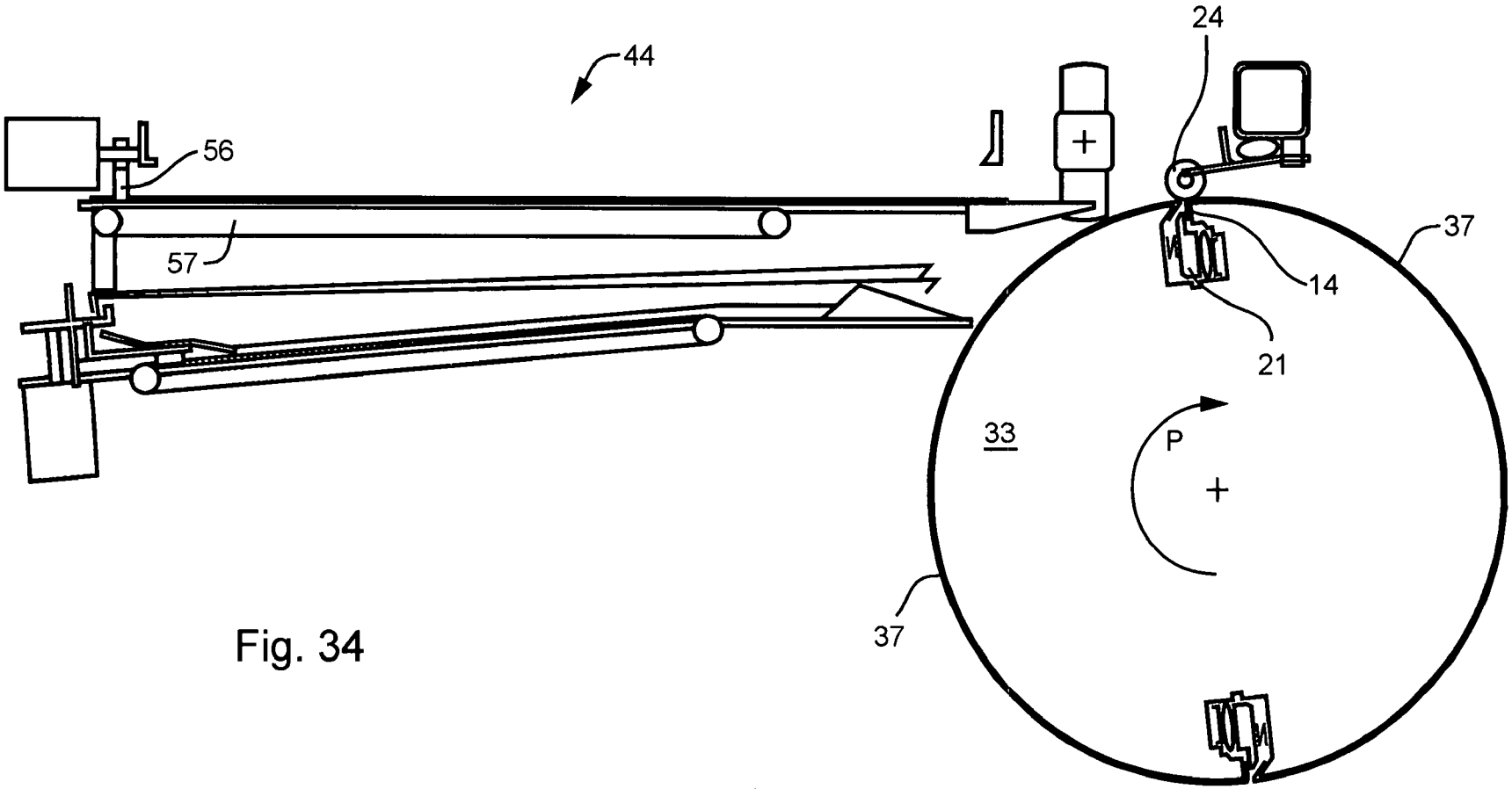

With the further rotation of the forme cylinder 33 in its production direction P, the second printing forme 37, which is suspended by its leading suspension leg 13 in the opening 09, is conveyed all the way out of the chute 44 and is drawn onto the forme cylinder 33. As it is being applied, the second printing forme 37 is rolled onto the forme cylinder 33 by the contact pressure element 24, which is engaged against the forme cylinder 33. When the forme cylinder 33 has executed a half rotation in its production direction P, the contact pressure element 24 forces the angled suspension leg 14 at the trailing end 04 of the second printing forme 37 into the opening 09. The holding element 21 in the groove 08 belonging to this opening 09 has been released, and has therefore been brought into the operating position in which it fixes in place the suspension leg 14 at the trailing end 04 of the second printing forme 37, which has been introduced into the opening 09, for example, via clamping. The conveyor mechanism 57 returns the stop 56, which is connected to it, back to its end position on the side in the upper chute 44 that faces away from the forme cylinder 33. The upper chute 44 is then empty, whereas two used printing formes 37 have now been placed in the lower chute 42, as is depicted in FIG. 34.

Figure 35:
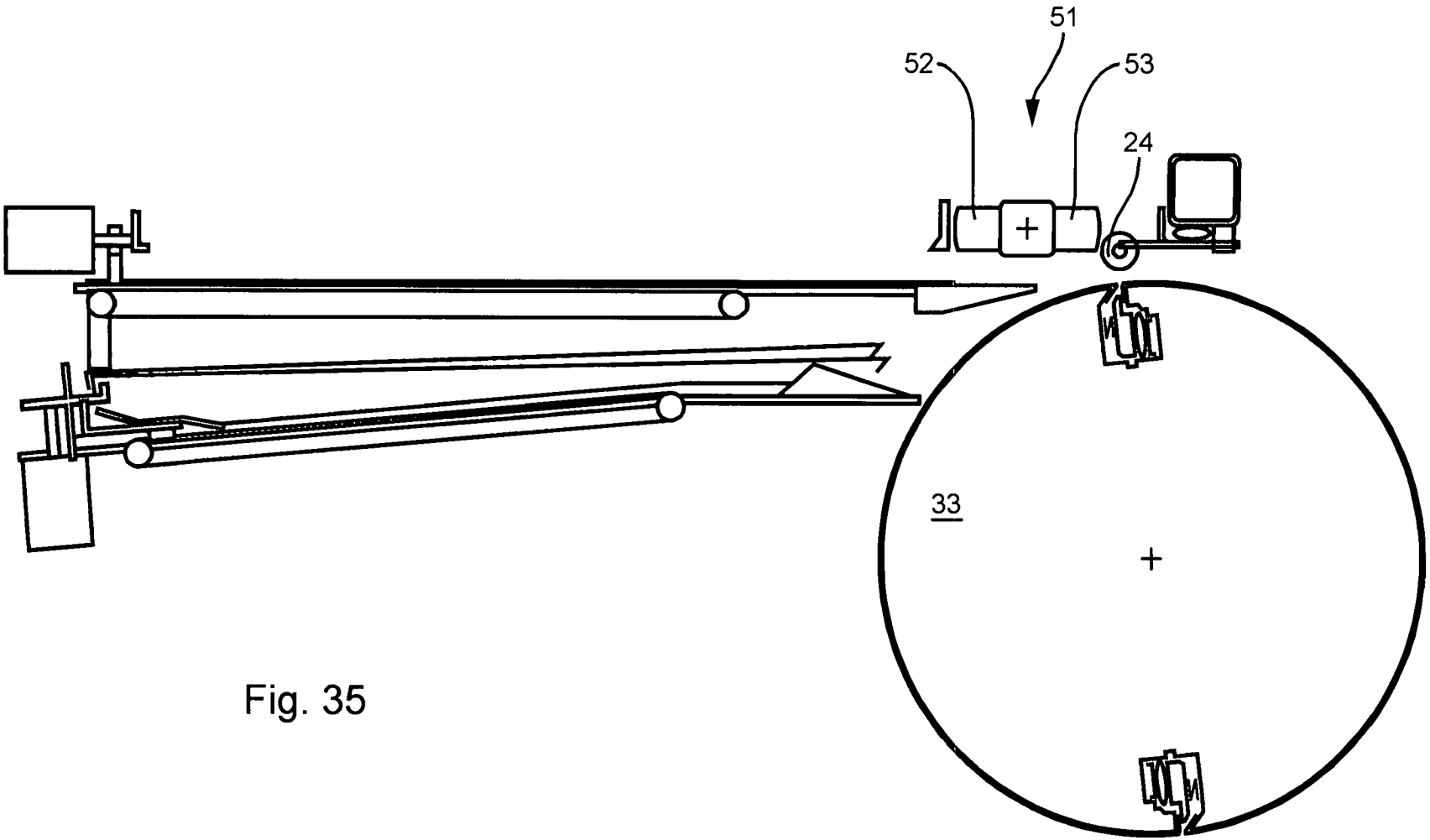

The contact pressure element is now disengaged from the forme cylinder 33, and the alignment device 51 preferably pivots, so that its diametrically arranged stops 52; 53 are moved back into a horizontal position. With the above described process steps, the change of a second printing forme 37 on the forme cylinder 33 has also been completed. A used second printing forme 37 was first removed, and a new second printing forme 37 has been installed. The forme cylinder 33 is again ready for production. This change can also be accomplished using the above-described device in less than one minute. The change of a first and a second printing forme 37 can therefore both be completed in less than two minutes, and preferably can be completed together in less than ninety seconds, as is shown in FIG. 35.

While preferred embodiments of systems for checking the loading of a printing forme magazine and systems for supplying at least one printing forme stored in a printing forme magazine to a cylinder, in accordance with the present invention have been set forth fully and completely hereinabove, it will be apparent to one of skill in the art that various changes in, for example, the drives for the cylinders, the specific structure of the plate end clamping devices and the like could be made without departing from the true spirit and scope of the subject invention which is accordingly to be limited only by the appended claims.

What is claimed is:

1. A system to check the loading of a printing forme magazine with a plurality of separate printing formes comprising:

a plurality of printing forme storage positions in the printing forme magazine;

at least two separate ones of the plurality of printing formes stored in two separate ones of the plurality of printing forme storage positions in the printing forme magazine;

at least one separate code on each of the at least two separate printing formes;

at least one code reader having an image sensor, the at least one code reader being usable to detect the codes of the at least two separate printing formes stored in the printing forme magazine;

a detection zone of the code reader, the detection zone of the code reader being usable to detect the at least one respective code of each of the at least two of the separate printing formes that are arranged adjacent to one another, at least one of horizontally and vertically, in the separate ones of the plurality of printing forme storage positions in the printing forme magazine, the detection zone of the code reader detecting the respective codes of the at least two adjacent, separate printing formes in the printing forme storage positions both together and simultaneously; and an image plane of said image sensor, said image plane imaging the codes detected by the detection zone of the code reader simultaneously, the image plane being subdivided into a plurality of selectively activatable inspection zones and wherein each of these selectively activatable inspection zones images precisely one of the codes detected by the detection zone.

2. The system according to claim 1, characterized in that the code reader has an illumination device that illuminates the detection zone.

3. The system according to claim 1, characterized in that the detection zone of the code reader, which detects the respective code of the printing formes, has one of an angled and a round cross-sectional surface.

4. The system according to claim 3, characterized in that the cross-sectional surface of the detection zone of the code reader and the image plane of the image sensor are arranged parallel to one another.

5. The system according to claim 1, characterized in that the image sensor is configured as one of a CCD sensor and a CMOS sensor.

6. The system according to claim 1, characterized in that the selectively activatable inspection zones can be read out sequentially.

7. The system according to claim 1, including a cylinder adapted to receive the printing formes and having an axial direction and wherein the printing forme magazine has at least four of the printing forme storage positions arranged side by side in the axial direction of a the cylinder, on the circumferential surface of which selected ones of the printing formes that are stored in the printing forme magazine are to be mounted, and further wherein one printing forme is to be stored in each of the printing forme storage positions.

8. The system according to claim 1, characterized in that the printing forme magazine has at least two of the printing forme storage positions which are arranged vertically, one above another, and further wherein one printing forme is stored in each of the printing forme storage positions.

9. The system according to claim 1, characterized in that the code reader is a component of a camera system.

10. The system according to claim 2, characterized in that at least one light source of the illumination device is embodied as one of a laser diode and as a light-emitting diode.

11. The system according to claim 10, characterized in that the light source of the illumination device emits white, yellow or green light.

12. The system according to claim 10, characterized in that the image sensor and the light source of the illumination device are arranged with their respective active directions at an angle of inclination of at least 5° in relation to a vertical line extending from the surface of the code.

13. The system according to claim 10, characterized in that the image sensor and the light source of the illumination device are arranged with their respective active directions at an angle of inclination that ranges from 10° to 60° in relation to a vertical line extending from the surface of the code.

14. The system according to claim 1, characterized in that the code reader is arranged a minimum distance of 10 mm from a surface of the code.

15. The system according to claim 1, characterized in that the code is configured two-dimensionally as a 2-D code.

16. The System according to claim 1, characterized in that the code is configured as a data matrix code.

17. The system according to claim 1, characterized in that the code is configured as an RFID label, which transmits information in a contactless fashion.

18. The System according to claim 1, characterized in that the code is configured in the form of a stamped marking.

19. The System according to claim 1, characterized in that the code reader converts structural elements acquired from the code into usable electronic information.

20. The System according to claim 1, characterized in that the code reader evaluates an image acquired from the code by comparing a detected code pattern with a stored, expected code pattern.

21. The System according to claim 1, characterized in that the code is configured on a suspension leg of each of the separate ones of the plurality of printing formes stored in the plurality of printing forme storage positions in the printing forme magazine.

22. The System according to claim 1, characterized in that the code of the printing formes has an index that continuously counts the printing formes.

23. The System according to claim 1, characterized in that printing formes, which are made of one of a metallic material, a plastic, and a paper are stored in the printing forme magazine.

24. The System according to claim 1, characterized in that printing formes that are usable in a dry offset printing process are stored in the printing forme magazine.

25. The System according to claim 1, characterized in that the printing formes, which are stored in the printing forme magazine, have their respective code in at least one side area of a trailing suspension leg of the respective printing forme.

26. The System according to claim 1, characterized in that at least one of the printing formes stored in the printing forme magazine is configured in a panorama format.

27. The System according to claim 26, characterized in that the printing forme configured in panorama format has its code at least in a central area of a trailing suspension leg of this printing forme.

28. The System according to claim 1, characterized in that the code reader is permanently installed, and is connected to the printing forme magazine.

29. The System according to claim 1, characterized in that the code reader which is connected to the printing forme magazine, and has two defined end positions, between which the code reader can move.

30. The System according to claim 1, characterized in that the code reader is connected to the printing forme magazine, and has a position of rest and a working position.

31. The System according to claim 30, characterized in that in the position of rest of the code reader, a cross-sectional surface of its detection zone is arranged substantially perpendicular to a code plane of the code that has been applied to a printing forme.

32. The System according to claim 30, characterized in that when the code reader is in its working position, a cross-sectional surface of its detection zone is arranged vertically, substantially parallel to a code plane of the code, which has been applied to a printing forme.

33. The System according to claim 30, characterized in that the code reader is arranged above the printing forme magazine in its position of rest.

34. The System according to claim 30, wherein the code reader has an image sensor and further wherein, in its position of rest, code reader directs an optically active side of its image sensor, in the direction of gravitational force.

* * * * *

UNITED STATES PATENT AND TRADEMARK OFFICE

CERTIFICATE OF CORRECTION

PATENT NO. : 8,001,897 B2
APPLICATION NO. : 12/223384
DATED : August 23, 2011
INVENTOR(S) : Gretsch It is certified that error appears in the above-identified patent and that said Letters Patent is hereby corrected as shown below:

Column 38, claim 7, line 5, after "of", delete "a".

Column 39, claim 29, line 15, after "reader", delete "which".

Signed and Sealed this
First Day of November, 2011

David J. Kappos

David J. Kappos
*Director of the United States Patent and Trademark Office*